US006696211B2

(12) United States Patent
Yoshida et al.

(10) Patent No.: US 6,696,211 B2
(45) Date of Patent: Feb. 24, 2004

(54) DEVELOPER, IMAGE-FORMING METHOD, AND PROCESS CARTRIDGE

(75) Inventors: Satoshi Yoshida, Tokyo (JP); Hirohide Tanikawa, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 88 days.

(21) Appl. No.: 09/788,397

(22) Filed: Feb. 21, 2001

(65) Prior Publication Data

US 2001/0031414 A1 Oct. 18, 2001

(30) Foreign Application Priority Data

Feb. 21, 2000 (JP) ..... 2000/043674

(51) Int. Cl.[7] ..... G03G 9/08

(52) U.S. Cl. ..... 430/108.3; 430/108.7; 430/110.4; 430/111.41; 430/125; 430/126; 430/108.6

(58) Field of Search ..... 430/110.4, 108.6, 430/108.7, 66, 67, 108.3, 125, 45, 120, 126; 399/174, 176

(56) References Cited

U.S. PATENT DOCUMENTS

| | | | | |
|---|---|---|---|---|
| 2,297,691 A | * | 10/1942 | Carlson | 430/97 |
| 4,769,676 A | | 9/1988 | Mukai et al. | 355/15 |
| 4,804,609 A | | 2/1989 | Imanaka et al. | 430/106.6 |
| 4,843,424 A | | 6/1989 | Oda et al. | 355/268 |
| 4,851,960 A | | 7/1989 | Nakamura et al. | 361/225 |
| 4,957,840 A | | 9/1990 | Sakashita et al. | 430/106.6 |
| 4,985,327 A | | 1/1991 | Sakashita et al. | 430/106.6 |
| 5,014,089 A | | 5/1991 | Sakashita et al. | 355/251 |
| 5,282,007 A | | 1/1994 | Oshiumi | 355/296 |
| 5,432,037 A | | 7/1995 | Nishikiori et al. | 430/126 |
| 5,437,955 A | * | 8/1995 | Michlin | 430/108.4 |
| 5,480,755 A | | 1/1996 | Uchiyama et al. | 430/106.6 |
| 5,561,021 A | * | 10/1996 | Yamazaki et al. | 430/66 |
| 5,721,433 A | | 2/1998 | Kosaka | 250/573 |
| 5,827,632 A | * | 10/1998 | Inaba et al. | 430/108.7 |
| 5,912,101 A | | 6/1999 | Karaki et al. | 430/110 |
| 5,976,755 A | | 11/1999 | Yoshida et al. | 430/126 |
| 6,017,670 A | | 1/2000 | Hashizume et al. | 430/109 |
| 6,060,202 A | | 5/2000 | Ogawa et al. | 430/111 |
| 6,077,635 A | | 6/2000 | Okado et al. | 430/45 |
| 6,081,681 A | * | 6/2000 | Nagase et al. | 399/174 |
| 6,096,463 A | * | 8/2000 | Hamano et al. | 430/110.4 |
| 6,128,456 A | * | 10/2000 | Chigono et al. | 399/176 |
| 6,258,499 B1 | * | 7/2001 | Itami | 430/66 |
| 2002/0048711 A1 | * | 4/2002 | Ito et al. | 430/66 |

FOREIGN PATENT DOCUMENTS

| | | |
|---|---|---|
| EP | 000867778 A2 * | 9/1998 |
| GB | 2074745 | 11/1981 |
| JP | 56-142540 | 11/1981 |
| JP | 57-151952 | 9/1982 |
| JP | 59-053856 | 3/1984 |
| JP | 59-061842 | 4/1984 |
| JP | 59-133573 | 7/1984 |
| JP | 59-168458 | 9/1984 |
| JP | 60-69660 | 4/1985 |
| JP | 61-141452 | 6/1986 |
| JP | 61-249059 | 11/1986 |
| JP | 61-275864 | 12/1986 |
| JP | 62-203182 | 9/1987 |
| JP | 62-258472 | 11/1987 |
| JP | 63-133179 | 6/1988 |
| JP | 63-149669 | 6/1988 |
| JP | 01-020587 | 1/1989 |
| JP | 02-120865 | 5/1990 |
| JP | 03-103878 | 4/1991 |
| JP | 04-9860 | 1/1992 |
| JP | 04-264453 | 9/1992 |
| JP | 05-2289 | 1/1993 |
| JP | 05-61383 | 3/1993 |
| JP | 05-66608 | 3/1993 |
| JP | 05-053482 | 3/1993 |
| JP | 05-150539 | 6/1993 |
| JP | 05-346682 | 12/1993 |
| JP | 08-136439 | 5/1996 |
| JP | 10-83096 | 7/1997 |
| JP | 09-197714 | 7/1997 |
| JP | 10-307421 | 11/1998 |
| JP | 10-307455 | 11/1998 |
| JP | 10-307456 | 11/1998 |
| JP | 10-307457 | 11/1998 |
| JP | 10-307458 | 11/1998 |
| JP | 11-15206 | 1/1999 |
| JP | 11-95479 | 4/1999 |
| JP | 11-174731 | 7/1999 |
| JP | 11-194530 | 7/1999 |
| JP | 11-202557 | 7/1999 |
| KP | 02-302772 | 12/1990 |

* cited by examiner

*Primary Examiner*—Christopher Rodee
(74) *Attorney, Agent, or Firm*—Fitzpatrick, Cella, Harper & Scinto

(57) ABSTRACT

A developer for developing an electrostatic latent image is formed from toner particles each comprising a binder resin and a colorant, inorganic fine powder having a number-average particle size of 4–80 nm based on primary particles, and electroconductive fine powder. The developer is characterized by having a number-basis particle size distribution in the range of 0.60–159.21 μm including 15–60% by number of particles in the range of 1.00–2.00 μm, and 15–70% by number of particles in the range of 3.00–8.96 μm, each particle size range including its lower limit and excluding its upper limit. As a result of inclusion an appropriate amount of the electroconductive fine powder represented by the particle size fraction of 1.00–2.00 μm, the developer is suitably used in an image forming method including a contact charging step of charging the image-bearing member based on the direct injection charging mechanism and also in an image forming method including a developing-cleaning step of developing the electrostatic latent image and recovering the developer remaining on the image-bearing member after the transfer step.

70 Claims, 9 Drawing Sheets

DEVELOPER, IMAGE-FORMING METHOD, AND PROCESS CARTRIDGE

FIELD OF THE INVENTION AND RELATED ART

The present invention relates to a developer used in image forming apparatus, such as electrophotographic apparatus, electrostatic recording apparatus, and magnetic recording apparatus, an image forming method using the developer, and a process-cartridge incorporating the developer. More specifically, the present invention relates to a developer used in image forming apparatus, such as copying machines, printers, facsimile apparatus, and plotters, wherein a toner image is first formed on an image-bearing member and a recording medium such as a transfer(-receiving) material; an image forming method using the developer and the image forming apparatus; and a process-cartridge including the developer.

Hitherto, image forming methods, such as electrophotography, electrostatic recording, magnetic recording, and toner jetting have been known. In the electrophotography, for example, an electrical latent image is formed on a latent image-bearing member which is generally a photosensitive member comprising a photoconductor material by various means, the electrostatic image is developed with a toner to form a visible toner image, and the toner image is, after being transferred onto a recording medium, such as paper, as desired, followed by fixing of the toner image onto the recording medium under application of heat, pressure or heat and pressure to form a fixed image.

Various methods are known, regarding the step of forming a visible image with a toner. For example, as methods for visualizing electrical latent images, there have been known, e.g., the cascade developing method, the pressure developing method, and the magnetic brush developing method using a two-component developer comprising a carrier and a toner. Further, there are also known a non-contact mono-component developing method wherein a toner carried on a toner-carrying member free from contact with a latent image-bearing member is caused to jump onto the latent image-bearing member; a magnetic mono-component developing method wherein a magnetic toner carried on a rotating sleeve containing therein a magnetic field generating means including magnetic poles is caused to jump between the sleeve and a photosensitive member and also a contact mono-component developing method; wherein a toner carried on a toner-carrying member in pressure contact with a latent image-bearing member is transferred under an electric field.

As the developers for visualizing latent images, there are known a two-component(-type) developer comprising a (particulate) carrier and a toner; a mono-component type developer (inclusive of a magnetic toner and a non-magnetic toner) not necessitating a (particulate) carrier. The toner is charged triboelectrically principally owing to friction between the carrier and the toner in the two-component developer, and principally owing to friction between the toner and a charging member, such as a developing sleeve in the mono-component developer.

Further, it has been proposed and widely practiced to use inorganic fine powder as an additive externally added to toner particles in order to improve the flowability or/and triboelectrification characteristic of the toner in both the two-component developer and the mono-component developer.

For example, Japanese Laid-Open Patent Application (JP-A) 5-66608 and JP-A 4-9860 have disclosed a method of adding inorganic fine powder which has been hydrophobized (i.e., hydrophobicity-imparted) and optionally further treated with silicone oil, to toner particles. Further, JP-A 61-249059, JP-A 4-264453 and JP-A 5-346682 have disclosed a method of adding both hydrophobized inorganic fine powder and inorganic fine powder treated with silicone oil.

Further, it has been also proposed to add electroconductive fine powder as an external additive to a developer. For example, it has been widely known to use carbon black as an example of electroconductive fine powder in a form of being attached or stuck onto the surfaces of toner particles, for the purpose of imparting electroconductivity to the toner, or for suppressing an excessive charge of the toner to provide a uniform triboelectric charge distribution. Further, JP-A 57-151952, JP-A 59-168458 and JP-A 60-69660 have disclosed to use electroconductive fine powders, such as tin oxide, zinc oxide and titanium oxide as external additives to high-resistivity magnetic toner particles. JP-A 56-142540 has proposed a developer formed by externally adding electroconductive magnetic particles of, e.g., iron oxide, iron powder or ferrite, to high-resistivity magnetic toner particles so as to satisfy developing performance and transferability by promoting charge induction to the magnetic toner particles with the electroconductive magnetic particles. Further, JP-A 61-275864, JP-A 62-258472, JP-A 61-141452, and JP-A 2-120865 have disclosed the addition of graphite, magnetite, polypyrrole conductor particles and polyaniline conductor particles, respectively, to the toner.

Various methods are also known as methods of forming latent images on image bearing members, such as an electrophotographic photosensitive member and an electrostatic recording dielectric member. In the electrophotography, for example, it is a general practice to uniformly charge a photosensitive member comprising a photoconductor as a latent image-bearing member in a desired polarity and at desired potential, and then subject the photosensitive member to imagewise pattern exposure to form an electrical latent image.

Hitherto, a corona charger (or corona discharger) has been generally used as a charging device for uniformly charging (including a case for charge removal) a latent image-baring member to desired polarity and potential.

A corona charger is a non-contact-type charging device comprising a discharge electrode such as a wire electrode and a shield electrode surrounding the discharge electrode while leaving a discharge opening, and the device is disposed in no contact with an image-bearing member as a member to be charged so that the discharge opening is directed to the image-bearing member for a prescribed charging operation wherein a high voltage is applied between the discharge electrode and the shield electrode to cause a discharge current (corona shower), to which the image-bearing member surface is exposed to be charged to a prescribed potential.

In recent years, a contact charging device has been proposed and commercialized as a charging device for a member to be charged such as a latent image-bearing member because of advantages, such as low ozone-generating characteristic and a lower power consumption, than the corona charging device.

A contact charging device is a device comprising an electroconductive charging member (which may also be called a contact charging member or a contact charger) in the form of a roller (charging roller), a fur brush, a magnetic brush or a blade, disposed in contact with a member-to-be-charged, such as an image-bearing member, so that the contact charging member is supplied with a prescribed charging bias voltage to charge the member-to-be-charged to prescribed polarity and potential.

The charging mechanism (or principle) during the contact charging may include (1) discharge (charging) mechanism and (2) direct injection charging mechanism, and may be classified depending on which of these mechanism is predominant.

(1) Discharge Charging Mechanism in the Contact Charging

This is a mechanism wherein a member is charged by a discharge phenomenon occurring at a minute gap between the member and a contact charging member. As a certain discharge threshold is present, it is necessary to apply to the contact charging member a voltage which is larger than a prescribed potential to be provided to the member-to-be-charged. Some discharge product occurs wile the amount thereof is remarkably less than in a corona charger, and active ions, such as ozone, occur though the amount thereof is small.

(2) Direct Injection Charging Mechanism in the Contact Charging

This is a mechanism wherein a member surface is charged with a charge which is directly injected into the member from a contact charging member. This mechanism may also be called direct charging, injection charging or charge-injection charging. More specifically, a charging member of a medium resistivity is caused to contact a member-to-be-charged to directly inject charges to the member-to-be-charged basically without relying on a discharge phenomenon. Accordingly, a member can be charged to a potential corresponding to an applied voltage to the charging member even if the applied voltage is below a discharge threshold. This mechanism is not accompanied with occurrence of active ions, such as ozone, so that difficulties caused by discharge products can be obviated. However, based on the direct injection charging mechanism, the charging performance is affected by the contactivity of the contact charging member onto the member-to-be-charged. Accordingly, it is preferred that the charging member is provided with a relative moving speed difference from the member-to-be-charged so as to provide a more frequent contact and more dense points of contact with the member-to-be-charged.

As a contact charging device, a roller charging scheme using an electroconductive roller as a contact charging member is preferred because of the stability of charging performance.

During the contact charging according to the conventional roller charging scheme, the above-mentioned discharge charging mechanism (1) is predominant. A charging roller has been formed of a conductive or medium-resistivity rubber or foam material optionally disposed in lamination to provide desired characteristics.

Such a charging roller is provided with elasticity so as to ensure a certain contact with a member-to-be-charged, thus causing a large frictional resistance. The charging roller is moved following the movement of the member-to-be-charged or with a small speed difference with the latter. Accordingly, even if the direct injection charging is intended, the lowering in charging performance, and charging irregularities due to insufficient contact, contact irregularity due to the roller shape and attachment onto the member-to-be-charged, are liable to be caused.

FIG. 3 is a graph illustrating examples of charging efficiencies for charging photosensitive members by several contact charging members. The abscissa represents a bias voltage applied to the contact charging member, and the ordinate represents a resultant charged potential provided to the photosensitive member. The charging performance in the case of roller charging is represented by a line A. Thus, the surface potential of the photosensitive member starts to increase at an applied voltage exceeding a discharge threshold of ca. −500 volts and thereafter increases linearly (at a slope of ca. 1) with respect to the applied voltage. The threshold voltage may be defined as a charging initiation Vth. Accordingly, in order to charge the photosensitive member to a charged potential of −500 volts, for example, it is a general practice to apply a DC voltage of −1000 volts, or a DC voltage of −500 volts in superposition of an AC voltage at a peak-to-peak voltage of, e.g., 1200 volts, so as to keep a potential difference exceeding the discharge threshold, thereby causing the charged photosensitive member potential to be converged to a prescribed charged potential.

Thus, in order to obtain a photosensitive member surface potential Vd required for electrophotography, it is necessary to apply a DC voltage of Vd+Vth exceeding the required potential to the charging roller. Such a charging scheme of applying only a DC voltage to a contact charging member may be termed a "DC charging scheme".

In the DC charging scheme, however, it has been difficult to charge the photosensitive member to a desired potential, since the resistivity of the contact charging member is liable to change in response to a change in environmental condition, and because of a change in Vth due to a surface layer thickness change caused by abrasion of the photosensitive member.

For this reason, in order to achieve a more uniform charging, it has been proposed to adopt an "AC charging scheme" wherein a voltage formed by superposing a DC voltage corresponding to a desired Vd with an AC voltage having a peak-to-peak voltage in excess of 2×Vth is applied to a contact charging member as described in JP-A 63-149669. According to this scheme, the charged potential of the photosensitive member is converged to Vd which is a central value of the superposed AC voltage due to the potential smoothing effect of the AC voltage, whereby the charged potential is not affected by the environmental change.

In the above-described contact charging scheme, the charging mechanism essentially relies on discharge from the contact charging member to the photosensitive member, so that a voltage exceeding a desired photosensitive member surface potential has to be applied to the contact charging member and a small amount of ozone is generated. Further, in the AC-charging scheme for uniform charging, ozone generation is liable to be promoted, a vibration noise (AC charging noise) between the contact charging member and the photosensitive member due to AC voltage electric field is liable to caused, and the photosensitive member surface is liable to be deteriorated due to the discharge.

Fur brush charging is a charging scheme, wherein a member (fur brush charger) comprising a brush of electroconductive fiber is used as a contact charging member, and the conductive fiber brush in contact with the photosensitive member is supplied with a prescribed charging bias voltage to charge the photosensitive member surface to prescribed polarity and potential. In the fur brush charging scheme, the above-mentioned discharge charging mechanism may be predominant.

As the fur brush chargers, a fixed-type charger and a roller-type charger have been commercialized. The fixed-type charger is formed by bonding a pile of medium-resistivity fiber planted to or woven together with a substrate to an electrode. The roller-type charger is formed by winding such a pile about a core metal. A fiber density of ca. $100/mm^2$ can be relatively easily obtained, but even at such a high fiber density, the contact characteristic is insufficient for realizing sufficiently uniform charging according to the direct injection charging. In order to effect a sufficiently uniform charging according to the direct injection charging, it is necessary to provide a large speed difference between the fur brush charger and the photosensitive member, and this is not practically feasible.

An example of the charging performance according to the fur brush charging scheme under DC voltage application is represented by a line B in FIG. 3. Accordingly, in the cases of fur brush charging using any of the fixed-type charger and the roller-type charger, a high charging bias voltage is applied to cause a discharge phenomenon to effect the charging.

In contrast to the above-mentioned charging schemes, in a magnetic brush scheme, a charging member (magnet brush charger) obtained by constraining electroconductive magnetic particles in the form of a magnetic brush under a magnetic field exerted by a magnet roll is used as a contact charging member, and the magnetic brush in contact with a photosensitive member is supplied with a prescribed charging bias voltage to charge the photosensitive member surface to prescribed polarity and potential. In the magnetic brush charging scheme, the above-mentioned direct injection charging scheme (2) is predominant.

Uniform direct injection charging becomes possible, e.g., by using magnetic particles of 5–50 $\mu$m in particle size and providing a sufficient speed difference with the photosensitive member.

An example of the charging performance according to the magnetic brush scheme under DC voltage application is represented by a line C in FIG. 3, thus allowing a charged potential almost proportional to the applied bias voltage.

The magnetic brush charging scheme is however accompanied with difficulties that the device structure is liable to be complicated, and the magnetic particles constituting the magnetic brush are liable to be liberated from the magnetic brush to be attached to the photosensitive member.

Based on the above circumstances, it has been desired to obtain a uniform charging device which is substantially free from discharge products, such as ozone, relies on the direct injection charging mechanism allowing uniform charging at a low applied voltage, is simple and yet can exhibit stable performances.

On the other hand, an image forming method free from generation of waste toner is desired from the viewpoints of economization of resonances, reduction of wastes and effective toner utilization.

The conventional image forming methods have generally included steps of forming a visible image by developing a latent image with a toner, transferring the toner image onto a recording medium such as paper, recovering the residual toner remaining on the latent image-bearing member without being transferred to the recording medium by various cleaning means into a waste toner vessel, and recycling these steps for a subsequent image forming cycle.

The toner recovery or cleaning step has been conventionally performed by using, e.g., a cleaning blade, a cleaning fur brush, a cleaning roller, etc. According to any of these methods, the transfer residual toner is mechanically scraped off or collected by damming into a waste toner vessel. Accompanying increasing demands for resource economization and environmental preservation, it has been desired to construct a system for re-utilizing or disposing the waste toner recovered in the waste toner vessel. In contrast thereto, a so-called toner re-use system of re-cycling the toner recovered in the cleaning step to a developing apparatus for re-use, has been commercialized. The system including such a cleaning step has been generally accompanied with a difficulty that the life of the latent image-bearing member is shortened due to abrasion caused by abutting of the cleaning member against the latent image-bearing member. The provision of the toner re-use system and the cleaning device results in an increase in apparatus size and has provided an obstacle against apparatus compactization.

In contrast thereto, a so-called development and simultaneous cleaning system (developing-cleaning sysetm) or cleanerless system has been proposed as a system free from generation of waste toner. Such a system has been developed principally for obviating image defects, such as positive memory and negative memory due to residual toner. This system has not been satisfactory for various recording media which are expected to receive transferred toner images in view of wide application of electrophotography in recent years.

Cleanerless systems have been disclosed in, e.g., JP-A 59-133573, JP-A 62-203182, JP-A 63-133179, JP-A 64-20587, JP-A 2-302772, JP-A 5-2289, JP-A 5-53482 and JP-A 5-61383. These systems have not been described with desirable image forming methods or toner compositions.

For a developing method suitably applicable to a system essentially free from a cleaning device, a cleanerless system or a development and simultaneous cleaning system, it has been considered essential to rub the electrostatic latent image-bearing member surface with a toner and a toner-carrying member, so that contact developing methods wherein the toner or developer is caused to contact the latent image-bearing member have been principally considered. This is because the mode of rubbing the latent image-bearing member with the toner or developer has been considered advantageous for recovery of the transfer residual toner particles by developing means. However, such a development and simultaneous cleaning system or a cleanerless system is liable to cause toner deterioration, and the deterioration or wearing of the toner-carrying member surface or photosensitive member surface, so that a sufficient solution has not been given to the durability problem. Accordingly, a simultaneous development and cleaning system according to a non-contact developing scheme is desired.

Now, the application of a contact charging scheme to such a development and simultaneous cleaning method or a cleanerless image forming method, is considered. The development and simultaneous cleaning method or the cleanerless image forming method does not use a cleaning member, so that the transfer residual toner particles remaining on the photosensitive member are caused to contact the contact charging system wherein the discharge charging mechanism is predominant. If an insulating toner is attached to or mixed into the contact charging member, the charging performance of the charging member is liable to be lowered.

In the charging scheme wherein the discharge charging mechanism is predominant, the lowering in charging performance is caused remarkably from a time when the toner layer attached to the contact charging member surface provides a level of resistance obstructing a discharge voltage. On the other hand, in the charging scheme wherein the direct injection charging mechanism is predominant, the lowering in charging performance is caused as a lowering in chargeability of the member-to-be-charged due to a lowering in opportunity of contact between the contact charging member surface and the member-to-be-charged due to the attachment or mixing of the transfer residual toner particles into the contact charging member.

The lowering in uniform chargeability of the photosensitive member (member-to-be-charged) results in a lowering in contrast and uniformity of latent image after imagewise exposure, and a lowering in image density and increased fog in the resultant images.

Further, in the development and simultaneous cleaning method or the cleanerless image forming method, it is important to control the charging polarity and charge of the transfer residual toner particles on the photosensitive member and stably recover the transfer residual toner particles in the developing step, thereby preventing the recovered toner from obstructing the developing performance. For this purpose, the control of the charging polarity and the charge of the transfer residual toner particles are effected by the charging member. This is more specifically described with respect to an ordinary laser beam printer as an example. In the case of a reversal development system using a charging member supplied with a negative voltage, a photosensitive member having a negative chargeability and a negatively charged toner, the toner image is transferred onto a recording medium in the transfer step by means of a transfer member applying a positive voltage. In this case, the transfer residual toner particles are caused to have various charges ranging from a positive polarity to a negative polarity depending on the properties (thickness, resistivity, dielectric constant, etc.) of the recording medium and the image area thereon. However, even if the transfer residual toner is caused to have a positive charge in the transfer step, the charge thereof can be uniformized to a negative polarity by the negatively charged charging member for negatively charging the photosensitive member. As a result, in the case of a reversal development scheme, the negatively charged residual toner particles are allowed to remain on the light-part potential where the toner is to be attached, and some irregularity charged toner attached to the dark-part potential is attracted to the toner carrying member due to a developing electric field relationship during the reversal development so that the transfer residual toner at the dark-part potential is not allowed to remain thereat but can be recovered. Thus, by controlling the charging polarity of the transfer residual toner simultaneously with charging of the photosensitive member by means of the charging member, the development and simultaneous cleaning or cleanerless image forming method can be realized.

However, if the transfer residual toner particles are attached to or mixed to the contact charging member in an amount exceeding the toner charge polarity-controlling capacity of the contact charging member, the charging polarity of the transfer residual toner particles cannot be uniformized so that it becomes difficult to recover the toner particles in the developing step. Further, even if the transfer residual toner particles are recovered by a mechanical force of rubbing, they adversely affect the triboelectric chargeability of the toner on the toner-carrying member if the charge of the recovered transfer residual toner particles has not been uniformized. In this way, in the development and simultaneous cleaning or cleanerless image forming method, the continuous image-forming performance and resultant image quality are closely associated with the charge-controllability and attachment-mixing characteristic of the transfer residual toner particles at the time of passing by the charging member.

In order to improve the charge control performance when the transfer residual toner particles are passed by the charging member in the development and simultaneous cleaning method, JP-A 11-15206 has proposed to use a toner comprising toner particles containing specific carbon black and a specific azo iron compound in mixture with inorganic fine powder. Further, it has been also proposed to use a toner having a specified shape factor and an improved transferability to reduce the amount of transfer residual toner particles, thereby improving the performance of the development and simultaneous cleaning image forming method. This image forming method however relies on a contact charging scheme based on the discharge charging scheme and not on the direct injection charging scheme, so that the system is not free from the above-mentioned problems involved in the discharge charging mechanism. Further, these proposals may be effective for suppressing the charging performance of the contact charging member due to transfer residual toner particles but cannot be expected to positively enhance the charging performance.

Further, among commercially available electrophotographic printers, there is a type of development and simultaneous cleaning image forming apparatus including a roller member abutted against the photosensitive member at a position between the transfer step and the charging step so as to supplement or control the performance of recovering transfer residual toner particles in the development step. Such an image forming apparatus may exhibit a good development and simultaneous cleaning performance and remarkably reduce the waste toner amount, but liable to result in an increased production cost and a difficulty against the size reduction.

Further, JP-A 3-103878 discloses to apply powder on a surface of a contact charging member contacting the member-to-be-charged so as to prevent charging irregularity and stabilize the uniform charging performance. This system however adopts an organization of moving a contact charging member (charging roller) following the movement of the member-to-be-charged (photosensitive member) wherein the charging principle generally relies on the discharge charging mechanism simultaneously as in the above-mentioned cases of using a charging roller while the amount of ozone adduct has been remarkably reduced than in the case of using a corona charger, such as scorotron. Particularly, as an AC-superposed DC voltage is used for accomplishing a stable charging uniformity, the amount of ozone adducts is increased thereby. As a result, in the case of a continuous use of the apparatus for a long period, the defect of image flow due to the ozone products is liable to occur. Further, in case where the above organization is adopted in the cleanerless image forming apparatus, the attachment of the powder onto the charging member is obstructed by mixing with-transfer-residual toner particles, thus reducing the uniform charging effect.

Further, JP-A 5-150539 has disclosed an image forming method using a contact charging scheme wherein a developer comprising at least toner particles and electroconductive particles having an average particle size smaller than that of the toner particles is used, in order to prevent the charging obstruction due to accumulation and attachment onto the charging member surface of toner particles and silica fine particles which have not been fully removed by the action of a cleaning blade on continuation of image formation for a long period. The contact charging or proximity charging scheme used in the proposal is one relying on the discharge charging mechanism and not based on the direct injection charging mechanism so that the above-problem accompanying the discharge mechanism accrues. Further, in case where the above organization is applied to a cleanerless image forming apparatus, larger amounts of electroconductive particles and toner particles are caused to pass through the charging step and have to be recovered in the developing step. No consideration on these matters or influence of such particles when such particles are recovered on the developing performance of the developer has been paid in the proposal. Further, in a case where a contact charging scheme relying on the direct injection charging scheme is adopted, the electroconductive fine particles are not supplied in a sufficient quantity to the contact charging member, so that the charging failure is liable to occur due to the influence of the transfer residual toner particles.

Further, in the proximity charging scheme, it is difficult to uniformly charge the photosensitive member in the presence of large amounts of electroconductive fine particles and transfer residual toner particles, thus failing to achieve the effect of removing the pattern of transfer residual toner particles. As a result, the transfer residual toner particles interrupt the imagewise exposure pattern light to cause a toner particle pattern ghost. Further, in the case of instantaneous power failure or paper clogging during image formation, the interior of the image forming apparatus can be remarkably soiled by the developer.

JP-A 10-307456 has disclosed an image forming apparatus adapted to a development and simultaneous cleaning image forming method based on a direct injection charging mechanism and using a developer comprising toner particles and electroconductive charging promoter particles having particle sizes smaller than ½ of the toner particle size. According to this proposal, it becomes possible to provide a development and simultaneous cleaning image forming apparatus which is free from generation of discharge product, can remarkably reduce the amount of waste toner and is advantageous for producing inexpensively a small size apparatus. By using the apparatus, it is possible to provide good images free from defects accompanying charging failure, and interruption or scattering of imagewise exposure light. However, a further improvement is desired.

Further, JP-A 10-307421 has disclosed an image forming apparatus adapted to a development and simultaneous cleaning method, based on the direct injection charging mechanism and using a developer containing electroconductive particles having sizes in a range of 1/50–½ of the toner particle size so as to improve the transfer performance.

JP-A 10-307455 discloses the use of electroconductive fine particles having a particle size of 10 nm–50 $\mu$m so as to reduce the particle size to below one pixel size and obtain a better charging uniformity.

JP-A 10-307457 describes the use of electroconductive particles of at most about 5$\mu$, preferably 20 nm–5 $\mu$m, so as to bring a part of charging failure to a visually less recognizable state in view of visual characteristic of human eyes.

JP-A 10-307458 describes the use of electroconductive fine powder having a particle size smaller than the toner particle size so as to prevent the obstruction of toner development and the leakage of the developing bias voltage via the electroconductive fine powder, thereby removing image defects. It is also disclosed that by setting the particle size of the electroconductive fine powder to be larger than 0.1 $\mu$m, the interruption of exposure light by the electroconductive fine powder embedded at the surface of the image-bearing member is prevented to realize excellent image formation by a development and simultaneous cleaning method based on the direct injection charging scheme. However, a further improvement is desired.

JP-A 10-37456 has disclosed a development and simultaneous cleaning image forming apparatus capable of forming without causing charging failure or interruption of imagewise exposure light, wherein electroconductive fine powder is externally added to a toner so that the electroconductive powder is attached to the image-bearing member during the developing step and allowed to remain on the image-bearing member even after the transfer step to be present at a part of contact between a flexible contact charging member and the image-bearing member.

These proposals however have left a room for further improvement regarding the stability of performance during repetitive use for a long period and performance in the case of using smaller size toner particles in order to provide an enhanced resolution.

The use of electroconductive particles having a specified average particle size externally added to toner particles has been proposed. For example, JP-A 9-146293 has proposed a toner comprising fine powder A having an average particle size of 5–50 nm and fine powder B having an average particle size of 0.1–3 $\mu$m externally added to and attached to toner particles at a strength larger than specified so as to reduce the proportion of the powder B isolated from the toner particles. Further, JP-A 11-95479 has proposed a toner containing hydrophobized inorganic oxide and electroconductive silica particles having specified particle sizes, but the electroconductive silica particles are added to merely promote the leakage of charge excessively accumulated at the toner.

Further, not a few proposals have been made regarding toner having specific particle size distributions and shapes. A proposal of a toner having a particle size distribution and a circularity measured by a flow-type particle image analyzer has been proposed in recent years JP-A 9-197714. As for proposals of toners having specified particle size distributions and shapes taking account of contributions of external additives, JP-A 11-174731 has proposed a toner containing inorganic fine powder A having a specific circularity and an average longer-axis diameter of 10–400 nm and non-spherical inorganic fine powder B wherein the powder B is expected to function as a spacer for suppressing the inorganic fine powder A from being embedded at the surface of the toner mother particles. JP-A 11-202557 has also proposed a toner having specific particle size distribution and circularity so as to provide a developed toner image having an increased density, thereby suppressing the image tailing phenomenon, and to improve the preservability of the toner in a high temperature/high humidity environment.

JP-A 11-194530 has proposed a toner containing externally added fine particles A of 0.6–4 $\mu$m and inorganic fine powder B and having a specific particle size distribution, wherein the toner deterioration due to embedding of the inorganic fine powder B at the toner particle surface is suppressed by the presence of the externally added fine particles A, and the attachment to or liberation from the toner particles of the externally added fine particles A is not considered. JP-A 10-83096 has proposed a toner comprising electroconductive fine particles and silica fine particles externally added to spherical resin fine particles enclosing a colorant therein, wherein the toner particles are expected to have a surface electroconductivity, thereby accelerating the movement and exchange of carrier between the toner particles and enhancing the toner triboelectric charge uniformity.

As described above, sufficient consideration has not been paid to external additives for a developer used in the image forming method including a direct injection charging step, or the development and simultaneous cleaning image forming method or cleanerless image forming method, and therefor a developer containing external additives fully adapted to such image forming methods has not been proposed.

SUMMARY OF THE INVENTION

In view of the above-mentioned problems of prior art, an object of the present invention is to provide a developer capable of toner image formation through a satisfactory developing-cleaning step (i.e., a developing and simultaneous cleaning step).

Another object of the present invention is to provide a developer allowing a simple and stable charging operation based on the direct injection charging mechanism substantially free from generation of discharge products such as ozone and allowing uniform charging at a low applied voltage.

Another object of the present invention is to provide an image forming method allowing a developing-cleaning step which can remarkably reduce the amount of waste toner and is advantageous for providing an inexpensive and small-sized image forming apparatus.

Another object of the present invention is to provide an image forming method including a charging step based on the direct injection charging mechanism substantially free from generation of discharge products such as ozone and allowing uniform charging at a low applied voltage, whereby a stable charging can be performed conveniently and without causing charging failure even in repetitive operation for a long period.

Another object of the present invention is to provide an image forming method adapted to a cleanerless image forming mode not requiring an independent cleaning step while ensuring a good and stable charging performance, and a process-cartridge therefor.

Another object of the present invention is to provide an image forming method adapted to a developing-cleaning step allowing excellent performance in recovery of transfer residual toner particles, and a process-cartridge therefor.

A further object of the present invention is to provide an image forming method including a developing-cleaning step allowing stable formation of good images even when toner particles of smaller particle size are used for providing a higher resolution, and a process-cartridge therefor.

According to the present invention, there is provided a developer for developing an electrostatic latent image, including: toner particles each comprising a binder resin and a colorant, inorganic fine powder having a number-average particle size of 4–80 nm based on primary particles, and electroconductive fine powder; wherein the developer has a number-basis particle size distribution in the range of 0.60–159.21 μm including 15–60% by number of particles in the range of 1.00–2.00 μm, and 15–70% by number of particles in the range of 3.00–8.96 μm, each particle size range including its lower limit and excluding its upper limit.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
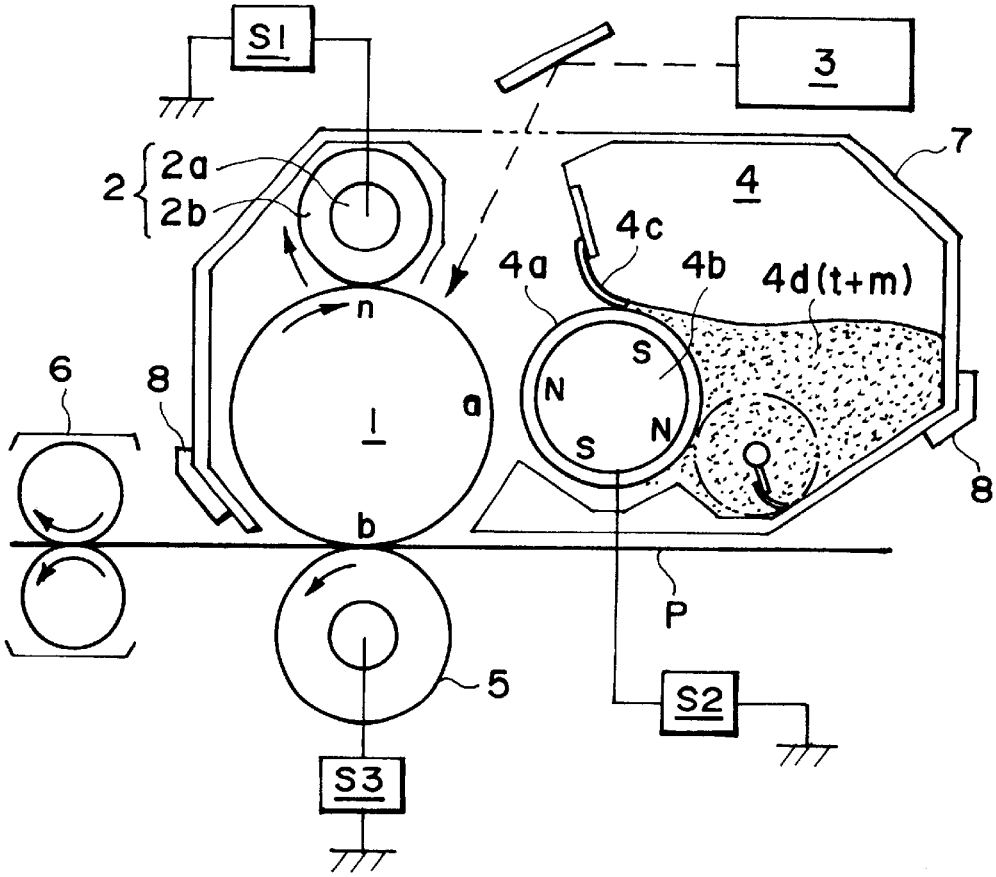
FIGS. 1 and 2 are respectively a schematic illustration of an image forming apparatus used for practicing an embodiment of the image forming method according to the invention.

The developer according to the present invention includes toner particles, inorganic fine powder having a number-average particle size of 4–80 nm based on primary particles, and electroconductive fine powder.

The developer according to the present invention (preferably constituted as a mono-component-type developer inclusive of the above-mentioned toner particles, inorganic fine powder and electroconductive fine powder and not inclusive of a particulate carrier) has a number-basis particle size distribution in the range of 0.60 μm–159.21 μm including 15–60% by number of particles in the range of 1.00–2.00 μm, and 15–70% by number of particles in the range of 3.00–8.96 μm. Herein, each number-basis particle size range for a developer is based on a measured distribution in a range of 0.60–159.21 μm, unless otherwise noted specifically, and is used to mean that the lower limit is included and the upper limit is excluded.

The developer may preferably contain 20–50% by number of particles in the range of 1.00–2.00 μm.

The developer may preferably contain 0–20% number of particles in the range of at least 8.96 μm.

It is preferred that the developer contains A % by number of particles in the range of 1.00–2.00 μm and B % by number of particles in the range of 2.00–3.00 μm, satisfying a relationship of A>B, more preferably A>2B.

It is further preferred that the developer according to the present invention has a variation coefficient of number-basis distribution Kn as defined below of 5–40, more preferably 5–30, in the particle size range of 3.00–15.04 μm:

$$Kn=(Sn/D1)\times 100,$$

wherein Sn represents a standard deviation of number basis distribution and D1 represents a number-average circle-equivalent diameter (μm), respectively, in the range of 3.00–15.04 μm.

The developer may preferably contain 90–100% by number, more preferably 93–100% by number of particles having a circularity $\underline{a}$ of at least 0.90 as determined by the following formula in the particle size range of 3.00–15.04 μm:

$$\text{Circularity } \underline{a}=L_0/L,$$

wherein L denotes a circumferential length of a particle projection image, and $L_0$ denotes a circumferential length of a circle having an area identical to that of the particle projection image.

The developer may preferably have a standard deviation of circularity distribution SD of at most 0.045 as determined according to the following formula:

$$SD=[\Sigma(a_i-a_m)^2/n]^{1/2},$$

wherein $a_i$ represents a circularity of each particle, $a_m$ represents an average circularity and n represents a number of total particles, respectively in the particle size range of 3.00–15.04 μm.

The developer may preferably contain 5–300 particles of the electroconductive fine powder having a particle size in the range of 0.6–3 μm per 100 toner particles (roughly regarded as equal to 100 particles having a particle size in the range of 3–15.04 μm in an ordinary case).

The developer may preferably contain 1–10 wt. % thereof of the electroconductive fine powder.

The electroconductive fine powder may preferably have a resistivity of at most $10^9$ ohm.cm, more preferably at most $10^6$ ohm.cm, further preferably $10^1$–$10^6$ ohm.cm.

The electroconductive fine powder may preferably be non-magnetic.

More specifically, the electroconductive fine powder may preferably comprise at least one species of oxide selected from zinc oxide, tin oxide and titanium oxide.

The developer may preferably contain 0.1–3.0 wt. % thereof of the inorganic fine powder.

It is preferred that the inorganic fine powder has been treated with at least silicone oil or/and a silane compound. It is further preferred that the inorganic fine powder has been treated with a silane compound simultaneously with or followed by treatment with silicone oil.

The inorganic fine powder may preferably comprise at least one species of inorganic oxides selected from silica, titania and alumina.

The developer according to the present invention as a whole may preferably be a magnetic developer having a magnetization of 10–40 $Am^2/kg$ at a magnetic field of 79.6 kA/m.

According to a first embodiment thereof, the image forming method according to the present invention comprises a repetition of image forming cycles each including:

a charging step of charging an image-bearing member, a latent image forming step of writing image data onto the charged surface of the image-bearing member to form an electrostatic latent image thereon, a developing step of developing the electrostatic latent image with the above-mentioned developer of the present invention to form a toner image thereon, and a transfer step of transferring the toner image onto a transfer(-receiving) material, wherein, in the above-mentioned charging step, a charging member is caused to contact the image-bearing member at a contact position in the presence of at least the electroconductive fine powder of the developer, and in this contact state, the charging member is supplied with a voltage to charge the image-bearing member.

In the above image forming method, each of the above-mentioned preferred embodiments of the developer of the present invention can be preferably used.

In the above image forming method, it is preferred that the electroconductive fine powder is present at the contact position between the charging member and the image-bearing member at a proportion higher than the content thereof in the developer initially supplied to the developing step.

In the image forming method, it is preferred that the developing step of developing or visualizing the electrostatic latent image is also operated as a step of recovering the developer remaining on the image-bearing member surface after the toner image is transferred to the transfer material.

In the image forming method, it is preferred to provide a relative speed difference between the surface moving speed of the charging member and the surface-moving speed of the image-bearing member at the contact position. More preferably, the charging member may be moved in a surface moving direction opposite to that of the image bearing member.

In the charging step, the image-bearing member may preferably be charged by means of a roller charging member having at least a surface layer of a foam material.

It is also preferred to use a roller charging member having an Asker C hardness of 25–50.

The roller charging member may preferably have a volume resistivity of $10^3$–$10^8$ ohm.cm.

It is also preferred that the image-bearing member is charged by means of a brush member having electroconductivity and supplied with a voltage.

The image-bearing member may preferably exhibit a volume resistivity of $1\times10^9$–$1\times10^{14}$ ohm.cm at its surfacemost layer.

The image-bearing member may preferably have a surfacemost layer comprising a resin with metal oxide conductor particles dispersed therein.

The image-bearing member may preferably have a surface exhibiting a contact angle with water of at least 85 deg., more preferably at least 90 deg., further preferably at least 95 deg.

The image-bearing member may preferably have a surfacemost layer containing fine particles of a lubricant selected from fluorine-containing resin, silicone resin and polyolefin resin.

In the developing step, it is preferred that a developer-carrying member carrying the developer is disposed opposite to and with a spacing of 100–1000 μm from the image-bearing member.

In the developing step, it is preferred that the developer is carried in a density of 5–30 $g/m^2$ on a developer-carrying member to form a developer layer, from which the developer is transferred to the image-bearing member.

In the developing step, it is preferred that the developer-carrying member is disposed with a prescribed spacing from the image-bearing member, the developer layer is formed in a thickness smaller than the spacing, and the developer is electrically transferred from the developer layer to the image-bearing member.

In the developing step, it is preferred that a developing bias voltage is applied so as to form an AC electric field having a peak-to-peak field strength of $3\times10^6$–$10\times10^6$ volts/m and a frequency of 100–5000 Hz between the developer-carrying member and the image-bearing member.

In the transfer step, the toner image formed in the developing step may preferably be first transferred onto an intermediate transfer member and then onto the transfer material.

In the transfer step, the transfer of the toner image may preferably be effected while abutting a transfer member against the image-bearing member or the intermediate transfer member via the transfer material.

According a second embodiment thereof, the image forming method according to the present invention comprises a repetition of image forming cycles each including:

a charging step of charging an image-bearing member, a latent image-forming step of writing image data onto the charged surface of the image-bearing member to form an electrostatic latent image thereon, a developing step of developing the electrostatic latent image with the above-mentioned developer of the present invention to form a toner image thereon, and a transfer step of transferring the toner image onto a transfer(-receiving) material, wherein the above-mentioned developing step is a step of developing the electrostatic latent image to form the toner image and also a step of recovering the developer remaining on the image-bearing member after the toner image is transferred onto the transfer material.

In the above image forming method, each of the above-mentioned preferred embodiments of the developer of the present invention can be preferably used.

In the charging step, it is preferred that the image-bearing member is charged by means of a charging member contacting the image-bearing member.

According to a first embodiment thereof, the process-cartridge of the present invention is a process-cartridge which is detachably mountable to a main assembly of an image forming apparatus for developing an electrostatic latent image formed on an image-bearing member with a developer to form a toner image, transferring the toner image onto a transfer(-receiving) material, and fixing the toner image on the transfer material, wherein the process-cartridge includes:

an image-bearing member for bearing an electrostatic latent image thereon, a charging means for charging the image-bearing member, and a developing means for developing the electrostatic latent image on the image-bearing member to form a toner image, wherein the developer includes: toner particles each comprising a binder resin and a colorant, inorganic fine powder having a number-average particle size of 4–80 nm based on primary particles, and electroconductive fine powder;

wherein the developer has a number-basis particle size distribution in the range of 0.60–159.21 $\mu$m including 15–60% by number of particles in the range of 1.00–2.00 $\mu$m, and 15–70% by number of particles in the range of 3.00–8.96 $\mu$m, each particle size range including its lower limit and excluding its upper limit, and the charging means includes a charging member disposed to contact the image-bearing member and supplied with a voltage to charge the image-bearing member at a contact position where at least the electroconductive fine powder of the developer is co-present as a portion of the developer attached to and allowed to remain on the image-bearing member after transfer of the toner image by the transfer means.

The developing means may preferably include at least a developer-carrying member disposed opposite to the image-bearing member, and a developer layer-regulating member for forming a thin developer layer on the developer-carrying member, so that the developer is transferred from the developer layer on the developer-carrying member onto the image-bearing member to form the toner image.

In the above image forming method, each of the above-mentioned preferred embodiments of the developer of the present invention can be preferably used.

The following are some preferred features of the above-mentioned process-cartridge.

At the contact position, it is preferred that the electroconductive fine powder is contained in the developer at a higher content than in the developer originally supplied to the developing means.

It is preferred that the developing means for developing or visualizing the electrostatic latent image is also operated as a means recovering the developer remaining on the image-bearing member surface after the toner image is transferred to the transfer material.

It is preferred to provide a relative speed difference between the surface moving speed of the charging member and the surface-moving speed of the image-bearing member at the contact position. More preferably, the charging member may be moved in a surface moving direction opposite to that of the image bearing member.

The charging means may preferably be a roller charging member having at least a surface layer of a foam material.

It is also preferred to use a roller charging member having an Asker C hardness of 25–50.

The roller charging member may preferably have a volume resistivity of $10^3$–$10^8$ ohm.cm.

It is also preferred that the charging means is a brush member having electroconductivity and supplied with a voltage.

The image-bearing member may preferably exhibit a volume resistivity of $1\times10^9$–$1\times10^{14}$ ohm.cm at its surface-most layer.

The image-bearing member may preferably have a surfacemost layer comprising a resin with metal oxide conductor particles dispersed therein.

The image-bearing member may preferably have a surface exhibiting a contact angle with water of at least 85 deg., more preferably at least 90 deg., further preferably at least 95 deg.

The image-bearing member may preferably have a surfacemost layer containing fine particles of a lubricant selected from fluorine-containing resin, silicone resin and polyolefin resin.

It is preferred that the developer-carrying member carrying the developer is disposed opposite to and with a spacing of 100–1000 $\mu$m from the image-bearing member.

In the developing means, it is preferred that the developer is carried in a density of 5–30 g/m$^2$ on a developer-carrying member to form a developer layer, from which the developer is transferred to the image-bearing member.

In the developing means, it is preferred that the developer-carrying member is disposed with a prescribed spacing from the image-bearing member, the developer layer is formed in a thickness smaller than the spacing, and the developer is electrically transferred from the developer layer to the image-bearing member.

In the developing means, it is preferred that a developing bias voltage is applied so as to form an AC electric field having a peak-to-peak field strength of $3\times10^6$–$10\times10^6$ volts/m and a frequency of 100–5000 Hz between the developer-carrying member and the image-bearing member.

According to a second embodiment thereof, the process-cartridge of the present invention is a process-cartridge which is detachably mountable to a main assembly of an image forming apparatus for developing an electrostatic latent image formed on an image-bearing member with a developer to form a toner image and transferring the toner image onto a transfer(-receiving) material, wherein the process-cartridge includes:

an image-bearing member for bearing an electrostatic latent image thereon, a charging means for charging the image-bearing member, and a developing means for developing the electrostatic latent image on the image-bearing member to form a toner image, wherein the developer includes: toner particles each comprising a binder resin and a colorant, inorganic fine powder having a number-average particle size of 4–80 nm based on primary particles, and electroconductive fine powder; wherein the developer has a number-basis particle size distribution in the range of 0.60–159.21 μm including 15–60% by number of particles in the range of 1.00–2.00 μm, and 15–70% by number of particles in the range of 3.00–8.96 μm, each particle size range including its lower limit and excluding its upper limit, and the above-mentioned developing means is a means for developing the electrostatic latent image to form the toner image and also a means for recovering the developer remaining on the image-bearing member after the toner image is transferred onto the transfer material.

In the above process-cartridge, each of the above-mentioned preferred-embodiments of the developer of the present invention can be preferably used.

In the process-cartridge, it is preferred that the image-bearing member is charged by means of a charging member contacting the image-bearing member.

Hereinbelow, some preferred embodiments of the present invention will be described in more detail.

Developer

The developer of the present invention may preferably be used in an image forming method using a contact charging scheme, which image forming method comprises a repetition of image forming cycles each including: a charging step of charging an image-bearing member; a latent image forming step of writing image data onto the charged surface of the image-bearing member to form an electrostatic latent image thereon, a developing step of developing the electrostatic latent image with a developer of the present invention to form a toner image thereon; and a transfer step of transferring the toner image onto a transfer(-receiving) material; wherein, in the above-mentioned charging step, a charging member is caused to contact the image-bearing member at a contact position in the presence of at least the electroconductive fine powder of the developer, and in this contact state, the charging member is supplied with a voltage to charge the image-bearing member. It is particularly preferred that the contact charging is performed based on the direct injection charging mechanism.

The developer of the present invention may preferably be used also in an image forming method using a developing-cleaning scheme, which image forming method comprises a repetition of image forming cycles each including: a charging step of charging an image-bearing member; a latent image-forming step of writing image data onto the charged surface of the image-bearing member to form an electrostatic latent image thereon; a developing step of developing the electrostatic latent image with a developer to form a toner image thereon; and a transfer step of transferring the toner image onto a transfer(-receiving) material; wherein the above-mentioned developing step is a step of developing the electrostatic latent to form the toner image and also a step of recovering the developer remaining on the image-bearing member after the toner image is transferred onto the transfer material.

The developer of the present invention includes toner particles each comprising a binder resin and a colorant, inorganic fine powder having a number-average particle size of 4–80 nm based on primary particles, and electroconductive fine powder; and the developer has a number-basis particle size distribution in the range of 0.60–159.21 μm including 15–60% by number of particles in the range of 1.00–2.00 μm, and 15–70% by number of particles in the range of 3.00–8.96 μm, each particle size range including its lower limit and excluding its upper limit.

By using the developer of the present invention, it becomes possible to well effect an image forming method including a developing-cleaning step, which allows the provision of a stable charge to the developer, provides good images free from charging failure even in repetitive use of the developer for a long period, allows a remarkable reduction of the waste toner, and is advantageous for inexpensive production of an image forming apparatus.

Further, by using the developer of the present invention, it becomes possible to realize contact charging based on the direct injection charging mechanism, which is substantially free from discharge products, such as ozone, and allows uniform charging at a low applied voltage, by a simple organization. As a result, it becomes possible to realize an image forming method providing good images without charging failure even in repetitive use of the developer for a long period. Further, by using the developer of the present invention, the charging performance of the contact charging member can be suppressed even if a large amount of the developer components are attached to or commingled into the contact charging member, so that it becomes possible to realize an image forming method capable of suppressing image defects due to charging failure of the image-bearing member.

In the image forming method including a developing-cleaning step, the developer of the present invention can stably exhibit a good triboelectric chargeability and provide good toner images free from image defects attributable to recovery failure of transfer-residual toner particles and obstruction of charging or latent image formation even in a repetitive use of the developer for a long period with remarkably suppressed waste toner amount.

The developer of the present invention includes toner particles each comprising at least a binder resin and a colorant, inorganic fine powder having a number-average particle size of 4–80 nm based on primary particles, and electroconductive fine powder. The electroconductive fine powder in the developer is transferred in an appropriate amount together with the toner particles from the developer-carrying member to the image-bearing member at the time of developing the electrostatic latent image formed on the image-bearing member. The resultant toner image formed on the image-bearing member as a result of development of the electrostatic latent image is transferred onto a transfer(-receiving) material, such as paper, in the transfer step. At this time, a portion of the electroconductive fine powder on the image-bearing member is attached to the transfer material, but the remainder thereof is retained by attachment and remains on the image-bearing member. In the case of transfer effected by application of a transfer bias voltage of a polarity which is opposite to the charged polarity of the toner particles, the toner particles are readily transferred onto the transfer material side but the electroconductive fine powder on the image-bearing member is not readily transferred to the transfer material because of its electroconductivity. As a result, while a (minor) portion of the electroconductive fine powder is attached to the transfer material, the remainder thereof remains by attachment onto the image-bearing member.

In the image forming method not including an independent cleaning step for removing the electroconductive fine powder remaining by attachment on the image-bearing member, a portion of toner particles remaining on the image-bearing member after the transfer step (therein referred to as "transfer-residual toner particles") and the electroconductive fine powder remaining on the image-bearing member are brought to a charging section along with movement of an image-bearing surface of the image-bearing member. As a result, in the case of using a contact charging member in the charging step, the electroconductive fine powder is moved to a contact position where the image-bearing member and the contact charging member contact each other, so that the electroconductive fine powder is attached to or commingled into the contact charging member. As a result, the contact charging of the image-bearing member is effected in the state where the electroconductive fine powder is co-present at the contact part between the image-bearing member and the contact charging member.

In the present invention, as the electroconductive fine powder is positively brought to the charging section, the contact resistance level of the contact charging member is kept at a low level though a small amount of transfer-residual toner particles can also be attached or commingled into the contact charging member, whereby the image-bearing member can be effectively charged by the contact charging member.

In case where a sufficient amount of the electroconductive fine powder is not present at the contact part of the contact charging member, the performance of charging image-bearing member is liable to be readily lowered due to attachment or mixing of the transfer-residual toner particles to the contact charging member, thus resulting in image soiling.

Further, by positively bringing the electroconductive fine powder to the contact part between the image-bearing member and the contact charging member, an intimate contact and a low-level contact resistance between the contact charging member and the image-bearing member are maintained, so that direct injection charging of the image-bearing member by the contact charging member is well effected.

The transfer-residual toner particles attached to or commingled into the contact charging member is gradually discharged from the contact charging member onto the image-bearing member and is brought along with the movement of the image-bearing surface to the developing section, where the transfer-residual toner particles are recovered as a result of developing and cleaning operation in the developing-cleaning step. The electroconductive fine powder attached to or commingled in the contact charging member is also gradually discharged out of the contact charging member to the image-bearing member and brought to the developing section along with the movement of the image-bearing surface. Thus, the electroconductive fine powder is, together with the transfer-residual toner particles, present on the image-bearing member and brought to the developing section where the transfer-residual toner particles are preferentially recovered. In the case where the developing step is operated under application of a developing bias electric field, the transfer-residual toner particles can be effectively recovered under the action of the electric field, while the electroconductive fine powder is not readily recovered due to its electroconductivity. As a result, a portion of the electroconductive fine powder can be recovered to the developing means, but the remainder thereof is allowed to remain by attachment on the image-bearing member. As a result of our study, it has been found that the presences of the electroconductive fine powder not readily recovered in the developing step but present on the image-bearing member promotes the efficiency of recovery of the transfer-residual toner particles in the developing step. In this way, the electroconductive fine powder present on the image-bearing member functions as a promoter for recovery of the transfer-residual toner particles on the image-bearing member, thus better ensuring the recovery of the transfer-residual toner particles in the developing step and effectively preventing the occurrence of image defects, such as positive ghost and fog, attributable to recovery failure of transfer-residual toner particles.

Hitherto, the external addition of electroconductive fine powder to toner particles has been mostly performed in order to provide a toner with a controlled triboelectric chargeability by attaching the electroconductive fine powder onto toner particle surfaces, so that electroconductive fine powder isolated or liberated from the toner particles has been considered as a difficulty or contaminant causing a change or deterioration of developer performance. In contrast thereto, in the developer of the present invention, the electroconductive fine powder is positively isolated from the toner particles and is therefore different from the electroconductive fine powder as a conventional external additive to the toner particle. As described above, the electroconductive fine powder in the developer of the present invention is brought via the image-bearing member after the transfer step to a charging section at the contact position between the image-bearing member and the contact charging member to be present thereat, thereby positively increasing the charging performance of the contact charging member to stably and uniformly charge the image-bearing member and preventing the occurrence of image defects due to the lowering in charge of the image-bearing member. Further, by the presence of the electroconductive fine powder or the image-bearing member in the developing step, the electroconductive fine powder functions as a promoter for recovery of the transfer-residual toner particles on the image-bearing member, thus better ensuring the recovery of the transfer-residual toner particles in the developing and effectively preventing the occurrence of image defects, such as positive ghost and fog, due to recovery failure of the transfer-residual toner particles.

Electroconductive fine powder attached onto toner particle surfaces and behaving along with the toner particles contributes little to the improvement in charging performance of the contact charging member and performance of the developing-cleaning step, but can result in a lowering in developing performance of the toner particles and obstruction of uniform charging performance due to increase in amount of transfer-residual toner particles caused by a lowering in rate of recovery of transfer-residual toner particles in the developing-cleaning step and a lowering in transferability.

During a repetition of image forming cycles, the electroconductive fine powder contained in the developer of the present invention is moved via the charging step and the developing step to be carried on the image-bearing surface, and along with further movement of the image-bearing surface, is moved via the transfer step again to the charging section, so that the charging section is continually supplied with the electroconductive fine powder. Accordingly, even when the amount of the electroconductive fine powder at the charging section is reduced, e.g., by falling, or the uniform charging performance-promoting function thereof is deteriorated, the lowering in chargeability of the image-bearing member is prevented in repetitive use of the image forming apparatus for a long period to retain a stable and uniform chargeability.

According to our study on the effect of the particle size of the electroconductive fine powder contained in the developer on the performance in the chargeability of the image-bearing member and the performance in the developing-cleaning step, electroconductive fine powder having a very small particle size (of, e.g., ca. 0.1 μm or smaller) is liable to firmly attach to the toner particle surfaces, thus cannot be sufficiently supplied to a non-image part of the image-bearing member during the developing step and cannot be readily separated from the toner particles in the transfer step. As a result, it becomes difficult to allow the electroconductive fine powder remain on the image-bearing member after the transfer step and positively supply the powder to the charging section. Accordingly, it becomes difficult to increase the chargeability of the image-bearing member, so that when the transfer-residual toner particle are attached to or commingled to the contact charging member, the chargeability of the image-bearing member is liable to be lowered to result in image defects.

Also in the developing-cleaning step, as such very small electroconductive fine powder is less allowed to remain on the image-bearing member and exhibits a smaller effect of improving the recovery of the transfer-residual toner particles because of its too small a particle size, it becomes difficult to effectively prevent the image defects, such as positive ghost and fog, due to insufficient recovery of the transfer-residual toner particles.

On the other hand, electroconductive fine powder having an excessively large particle size (of, e.g., ca. 4 μm or larger) cannot effectively enhance the chargeability of the image-bearing member because of too large a particle size even when supplied to the charging section but is liable to fall off the charging member, so that it becomes difficult to retain a sufficient number of electroconductive fine powder particles at the charging section. Further, as the number of electroconductive particles per unit weight is reduced, it becomes necessary to increase the addition amount of the electroconductive fine powder to the developer so as to have a sufficient number of particles thereof be present in order to attain the chargeability promoting effect. However, an excessively large amount of electroconductive fine powder is liable to result in lowering of triboelectric chargeability and developing performance of the developer as a whole, thus being liable to cause image density lowering or toner scattering. Further, because of a large particle size, it becomes difficult to attain the effect of promoting the recovery of the transfer-residual toner particles of the electroconductive fine powder in the developing step. If the amount thereof on the image-bearing member is increased in order to enhance the recovery of the transfer-residual toner particles, the electroconductive fine powder can adversely affect the latent image-forming step, such as occurrence of image defects caused by interruption of imagewise exposure light.

Starting from the particle size effect of the electroconductive fine powder mentioned above, we have further proceeded to study on the particle size distribution of a developer including external additives directly affecting the actual behavior of the developer and have finally arrived at the present invention.

Thus, by using the developer of the present invention toner particles each comprising a binder resin and a colorant, inorganic fine powder having a number-average primary particle size of 4–80 nm and electroconductive fine powder; and having a number-basis particle size distribution in the range of 0.60–159.21 μm including 15–60% by number of particles in the range of 1.00–2.00 μm, and 15–70% by number of particles in the range of 3.00–8.96 μm, it becomes possible to effectively prevent the charging failure of the image-bearing member by means of contact charging and provide as improved uniform chargeability of the image-bearing member based on the direct injection charging mechanism. Further, it becomes possible to improve the recovery of transfer-residual toner particles in the developing-cleaning step, thereby effectively preventing image defects, such as positive ghost and fog, due to recovery failure of transfer-residual toner particles.

More specifically, the inorganic fine powder having a number-average primary particle size of 4–80 nm attaches to the toner particle surfaces and behaves together with the toner particles to improve the flowability of the developer and uniformize the triboelectric chargeability of the toner particles. As a result, the transferability of the toner particles is improved to reduce the transfer-residual toner particles brought to the contact charging member, thereby preventing the lowering in chargeability of the image-bearing member, and reduce the load of recovery of transfer-residual toner particles in the developing step.

The inorganic fine powder in the developer does not substantially affect the number-basis particle size distribution of the developer in the particle size range of 0.60–159.21 μm, since the inorganic fine powder moves together with the toner particles in the form of being attached onto the toner particle surfaces, and has a very small number-average primary particle size of 4–80 nm so that it shows only a particle size of from the primary particle size up to at most 0.1 μm as in an aggregated form attached onto the toner particles.

In contrast thereto, the electroconductive fine powder in the developer contributes to the satisfaction of 15–60% by number of particles in the range 1.00–2.00 μm in the number-basis particle size distribution of the developer in the range of 0.60–159.21 μm. More specifically, by using electroconductive fine powder including at least particles having particle sizes in the range of 1.00–2.00 μm and adding the electroconductive fine powder to the developer so as to satisfy the above-mentioned content range of particles in the range of 1.00–2.00 μm, the above-mentioned effects of the present invention can be attained. According to our study, it has been found that the presence of electroconductive fine powder having particle sizes in the range of 1.00–2.00 μm in the developer shows remarkable effects of preventing the charging failure of the image-bearing member due to attachment and mixing of transfer-residual toner particles to the contact charging member to improve the uniform chargeability of the image-bearing member based on the direct injection charging mechanism and preventing the charging failure and recovery-failure of transfer-residual toner particles in an image forming method including a developing-cleaning step.

The particles of electroconductive fine powder in the particle size range of 1.00–2.00 μm are little liable to firmly attach to the toner particle surfaces but can be sufficiently supplied even to non-image parts on the image-bearing member in the developing step, and can be readily liberated from the toner particle surfaces in the transfer step, thus being effectively supplied to the charging section via the image-bearing surface after the transfer step. Further, the electroconductive fine powder can be present in a uniformly dispersed state and stably retained in the charging section, thereby exhibiting good effect of promoting the chargeability of the image-bearing member and maintaining stable uniform chargeability of the image-bearing member even in repetitive use of the image forming apparatus for a long period. Further, even in an image forming method including a charging step using a contact charging member as well as a developing-cleaning step wherein the contact charging member is inevitably soiled with transfer-residual toner particles, it is possible to prevent the lowering in chargeability of the image-bearing member and also promotes the recovery of the transfer-residual toner particles in the developing-cleaning step.

As mentioned above, the developer of the present invention contains 15–60% by number of particles in the particle size range of 1.00–2.00 μm (based on the number-basis particle size distribution in the range of 0.60–159.21 μm). By satisfying this requirement, it is possible to increase the uniform chargeability of the image-bearing member in the charging step. Further, as an appropriate amount of the electroconductive fine powder can be stably present in the charging section, it is possible to prevent exposure failure due to the presence of excessive electroconductive fine powder on the image-bearing member in the subsequent exposure step. If the content of the particles of 1.00–2.00 μm in the developer is below the above-described range, it becomes difficult to sufficiently attain the effect of improving uniform chargeability of the image-bearing member in the charging step and the effect of preventing recovery failure of transfer-residual toner particles in the developing-cleaning step. If the content of the particles of 1.00–2.00 μm exceeds the above-described range, the charging section is supplied with excessive electroconductive fine powder, and the electroconductive fine powder not retained by the charging section can be discharged to the image-bearing member in such an amount as to interrupt the exposure light to result in image defects due to exposure failure and can cause a difficulty of soiling by scattering within the apparatus.

It is further preferred that the developer of the present invention contains 20–50% by number, more preferably 20–45% by number, of particles in the range of 1.00–2.00 μm. By satisfying these preferred content ranges, it becomes possible to further enhance the effect of improving uniform chargeability of the image-bearing member in the charging step and the effect of preventing the charging failure of transfer residual toner particles in the developing-cleaning step. The supply of excessive electroconductive fine powder to the charging section can be more reliably prevented, and it becomes possible to more reliably ensure the effect of preventing the occurrence of image defects due to exposure failure caused by discharge of excessive amount of electroconductive fine powder onto the image-bearing member not sufficiently retained at the charging section.

As mentioned above, the content of particles of 1.00–2.00 μm of 15–60% by number in the developer can be achieved by adding the electroconductive fine powder of an appropriate particle size into the developer in an amount suitable for satisfying the above content range. However, particles of 1.00–2.00 μm are not necessarily limited to those of the electroconductive fine powder, but the developer of the present invention can contain particles of external additives other the electroconductive fine powder having particle sizes in the above described range within an extent of satisfying the above-mentioned content range.

The toner particle in the developer of the present invention comprising at least a binder resin and a colorant can be produced through any of known processes. The amount of toner particles having particle sizes in the range of 1.00–2.00 μm among the total toner particles and thus in the developer can vary depending on the toner production process and production conditions (e.g., average particle size of the toner and pulverization condition in the case of production through the pulverization process. In the developer of the present invention, if the content of toner particles in the particle size range of 1.00–2.00 μm exceeds 10% by number of the total particles in the range of 0.60–159.21 μm, the developer is liable to have a broad triboelectric charge distribution and show a lowering in developing performance since the triboelectric chargeability of such ultra-fine toner particles of 1.00–2.00 μm is remarkably different from that of toner particles having particle sizes closer to their average particle size.

It is preferred that the developer of the present invention contains 5–60% by number of particles of the electroconductive fine powder in the range of 1.00–2.00 μm.

The developer of the present invention is also characterized by containing 15–70% by number of particles in the particle size range of 3.00–8.96 μm.

In the developer of the present invention, the particles of 3.00–8.96 μm has to be contained in a prescribed amount in order to develop the electrostatic latent image on the image-bearing member to form a toner image and transfer the toner image onto a transfer material to form a toner image on the transfer material. The particles in the particle size range of 3.00–8.96 μm may be provided with a triboelectric chargeability suitable to be attached to the electrostatic latent image formed on the image-bearing member to develop a toner image faithful to the latent image.

Particles smaller than 3.00 μm are liable to have an excessive chargeability or an excessively large triboelectric charge attenuation characteristic, so that it is difficult to provide such particles with a stable triboelectric chargeability. As a result, such particles are liable to attach to a portion of no electrostatic latent image (corresponding to a white background portion in the resultant image) on the image-bearing member, so that it is difficult to develop a toner image faithful to the electrostatic latent image. Further, it is difficult for the particles smaller than 3.00 μm to retain a good transferability onto a transfer material rich in fibrous surface unevenness, such as paper, so that the amount of the transfer-residual toner particles is liable to be increased. As a result, a large amount of transfer-residual toner particles remaining on the image-bearing member are brought to the charging section and attached to or commingled with the contact charging member, thus obstructing the chargeability of the image-bearing member, whereby it becomes difficult to attain the effect of enhancing the chargeability of the image-bearing member attained by intimate contact via the electroconductive fine powder between the contact charging member and the image-bearing member. Further, if the particle size of the transfer-residual toner particles is smaller, the external forces acting on the transfer-residual toner particles in the developing step, such as mechanical force, electrostatic force and further magnetic force in the case of a magnetic toner, for recovery in the developing step, become smaller, so that the force of attachment acting between the transfer-residual toner particles and the image-bearing member becomes relatively larger, whereby the rate of recovery of the transfer-residual toner particles in the developing step is lowered, thus being liable to result in image defects, such as positive ghost and fog, due to recovery failure of the transfer-residual toner particles.

On the other hand, it is difficult for particles of 8.96 μm or larger to have a high triboelectric chargeability sufficient for providing a developed toner image faithful to the electrostatic latent image. A toner of a larger particle size generally results in a toner image of a lower resolution. Especially in the developer of the present invention caused to contain electroconductive fine powder so as to provide a prescribed content of particles of 1.00–2.00 μm, larger toner particles are liable to have a lower triboelectric chargeability because of the presence of the electroconductive fine powder, so that it becomes difficult to provide the particles of 8.96 μm or larger with a sufficiently high triboelectric chargeability required for faithfully reproducing the electrostatic latent image to form a toner image.

By containing the particles of 3.00–8.96 μm in the above-described content range, the developer of the present invention is allowed to secure a sufficient amount of toner particles suitable for providing a toner image faithfully reproducing an electrostatic latent image. As a result, the developer of the present invention also containing the electroconductive fine powder in an amount sufficient to provide a prescribed amount of particles of 1.00–2.00 μm, is allowed to provide images with a high image density and excellent resolution.

If the content of the particles of 3.00 μm–8.96 μm is below the above-described range, it becomes difficult to secure toner particles having a triboelectric chargeability suitable for faithful reproduction of electrostatic latent images, thus being liable to result in images with much fog, low image density or low resolution.

If the content of the particles of 3.00–8.96 μm is larger than the above-described range, it becomes difficult to secure the particles of 1.00–2.00 μm in the above-mentioned content range. Further, even if the content of the particles of 1.00–2.00 μm is secured within the prescribed range, the amount of the particles of 1.00–2.00 μm becomes relatively short, so that it becomes difficult to sufficiently attain the effect of improving uniform chargeability of the image-bearing member in the charging step and the effect of preventing recovery failure of transfer-residual toner particles in the developing-cleaning step.

It is preferred that the developer contains 20–65% by number, more preferably 25–60% by number, of the particles of 3.00–8.96 μm. By satisfying these preferred content ranges, it becomes possible to further enhance the effect of improving uniform chargeability of the image-bearing member in the charging step and the effect of preventing the charging failure of transfer residual toner particles in the developing-cleaning step. It is further possible to provide image with higher image density, less fog and better resolution.

As described above, in order to ensure particles having a triboelectric chargeability suitable for faithful reproduction of electrostatic latent images and provide images with high image density and excellent resolution, the developer of the present invention is caused to contain 15–70% by number of particles of 3.00–8.96 μm. Accordingly, it is preferred that the developer contains 15–70% by number of toner particles of 3.00–8.96 μm. However, the particles of 3.00–8.96 μm contained in the developer of the present invention are not necessarily restricted to toner particles but can contain electroconductive fine powder and other external additives to the developer.

It is preferred that the developer of the present invention contains 0–20% by number (i.e., at most 20% by number, if any) of particles of 8.96 μm or larger.

As described above, in the developer caused to contain a prescribed amount of particles of 1.00–2.00 μm, it becomes difficult to provide such particles of 8.96 μm or larger with a sufficient triboelectric chargeability suitable for faithful reproduction of an electrostatic latent image because the developer contains a substantial amount of electroconductive fine powder. If the content of the particles of 8.96 μm or larger exceeds the above-mentioned range, it becomes difficult to provide the entire developer with a sufficiently high triboelectric chargeability suitable for faithful reproduction of an electrostatic latent image. Further, the resultant images are liable to have a low resolution.

Further, if large toner particles are brought as transfer-residual toner particles to the charging section, the charging failure of the image-bearing member is liable to be caused, and the contact between the contact charging member and the image-bearing member can be impaired, so that the effect of the present invention of enhancing the uniform chargeability of the image-bearing member based on the intimate contact via the electroconductive fine powder between the contact charging member and the image-bearing member is not ensured. Further, even if such large transfer-residual toner particles are recovered in the developing step, the toner particles are liable to interrupt the imagewise exposure light in the preceding latent image-forming step to leave image defects.

For the above reason, it is preferred that the developer of the present invention contains 0–10% by number, more preferably 0–7% by number, of particles of 8.96 μm or larger. By satisfying these preferred ranges, it becomes possible to provide images with higher image density, less fog and better resolution.

It is further preferred that the developer of the present invention contains A % by number of particles of 1.00–2.00 μm and B % by number of particles of 2.00–3.00 μm satisfying A>B, more preferably A>2B.

Thus it is preferred that the content (B % by number) of the particles of 2.00–3.00 μm is smaller than the content (A % by number) of the particles of 1.00–2.00 μm. By satisfying this relationship, the electroconductive fine powder is allowed to be uniformly dispersed in the charging section to provide a good uniform chargeability of the image-bearing member. In case where the relationship of A>B is not satisfied, the uniform dispersibility of the electroconductive fine powder at charging section is lowered, so that the effect of uniformly charging the image-bearing member is liable to be lowered. Further, the supply of the electroconductive fine powder to the charging section is liable to be lowered or the retentivity of the electroconductive fine powder by the contact charging member is liable to be lowered so that the effect of charge promotion on the image-bearing member is lowered to result in unstable chargeability of the image-bearing member in repetitive use for a long period. Further, if the relationship of A>B is not satisfied, a larger proportion of fine toner particle fraction having a lower transferability is supplied in a larger amount to the charging section and held thereat, so that the retentivity of the electroconductive fine powder at the charging section is relatively lowered and the uniform charging performance of the image-bearing member is liable to be obstructed. Further, as the transfer-residual toner particles are caused to contain a larger amount of fine particle fraction, so that the recovery rate of the transfer-residual toner particles is lowered, thus being liable to cause positive ghost and fog.

For the above reason, it is preferred that the content (A % by number) of the particles of 1.00–2.00 μm is larger than the content (B % by number) of the particles of 2.00–3.00 μm, more preferably more than twice the content (B % by number) of the particles of 2.00–3.00 μm.

Further, it is preferred that the developer of the present invention has a variation coefficient of number-basis distribution Kn as defined below of 5–40 in the particle size range of 3.00–15.04 μm:

$$Kn=(Sn/D1)\times 100,$$

wherein Sn represents a standard deviation of number-basis distribution and D1 represents a number-average circle-equivalent diameter ($\mu$m), respectively, in the range of 3.00–15.04 $\mu$m.

By providing a variation coefficient Kn=5 to 40 as defined above, it becomes possible to provide a uniform mixability between the toner particles and the electroconductive fine powder, so that the electroconductive fine powder can be supplied onto the image-bearing member at a better uniformity, thereby enhancing the uniform chargeability of the image-bearing member. Further, the charge distribution of the toner particles can be narrowed, so that fog-forming toner particles and transfer-residual toner particles can be reduced to better suppress the charging obstruction on the image-bearing member. Further, the transfer-residual toner particles can be recovered at a better stability in the developing step, so that it becomes possible to more surely suppress the image defects due to the recovery failure. A variation coefficient Kn=5–30 as defined above is further preferred in order to provide a narrower toner charge distribution.

It is also preferred that based on a volume-basis particle size distribution in the particle size range of 0.60–159.21 $\mu$m (as obtained by re-calculation of the number-basis particle size distribution), the developer of the present invention has a weighte-average particle size of 4–10 $\mu$m and has a variation coefficient of volume-basis distribution Kv as defined below of 10–30 in the particle size range of 3.00–15.04 $\mu$m:

$$Kv=(Sv/D4)\times 100,$$

wherein Sv represents a standard deviation of volume-basis distribution and D4 represents a weight-average particle size ($\mu$m) based on a volume-basis distribution, respectively, in the range of 3.00–15.04 $\mu$m.

By providing a variation coefficient Kv=10 to 30 as defined above, the charge distribution of the toner particles in the range of 3.0–15.04 $\mu$m can be narrowed, so that fog-forming toner particles and transfer-residual toner particles can be reduced to better suppress the charging obstruction on the image-bearing member. Further, the transfer-residual toner particles can be recovered at a better stability in the developing step, so that it becomes possible to more surely suppress the image defects due to the recovery failure. A variation coefficient Kv=10–25 as defined above is further preferred for a similar reason.

In the case of the above variation coefficient Kn or Kv below the above-described range, the production of toner particles becomes difficult. In the case of Kn or Kv exceeding the above-described range, it becomes difficult to obtain a uniform mixability among the toner particles, the inorganic fine powder and the electroconductive fine powder, so that it becomes difficult to attain the stable charging promotion effect on the image-bearing member. Further, the developer as a whole is caused to have a broader charge distribution, thus being liable to cause lowering of image qualities due to, e.g., image density lowering and increased fog. Further, the amount of the transfer residual toner particles is liable to be increased, thus obstructing the chargeability and lowering the rate of recovery of the transfer-residual toner particles in the developing-cleaning step.

It is preferred that the developer of the present invention contains 90–100% by number, more preferably 93–100% by number of particles having a circularity $\underline{a}$ of at least 0.90 as determined by the following formula in the particle size range of 3.00–15.04 $\mu$m:

$$\text{Circularity } \underline{a}=L_0/L,$$

wherein L denotes a circumferential length of a particle projection image, and $L_0$ denotes a circumferential length of a circle having an area identical to that of the particle projection image.

Our study has revealed that the circularity $\underline{a}$ of the particles of 3.00–15.04 $\mu$m in the developer largely affect the suppliability of the electroconductive fine powder to the charging section. Further, in a developer containing a large proportion of particles having a high circularity in the particle size range of 3.00–15.04 $\mu$m, the electroconductive fine powder can be readily liberated from the toner particles and supplied to the charging section at a better suppliability, so that it is possible to stably retain good uniform chargeability of the image-bearing member even in a repetitive use of the image forming apparatus for a long period.

From toner particles having a distorted shape among the particles of 3.00–15.04 $\mu$m, the electroconductive fine powder having particle sizes in a prescribed range giving the effect of the present invention cannot be readily liberated. For this reason, a developer containing a large proportion of distorted particles in the particle size range of 3.00–15.04 $\mu$m, is liable to exhibit an inferior suppliability of the electroconductive fine powder to the toner, so that the chargeability promoting effect on the image-bearing member is liable to be lowered and it becomes difficult to stably exhibit good uniform chargeability during a repetitive use of the image forming apparatus for a long period. Further, it has been also found that distorted particles in the particle size of 3.00–15.04 $\mu$m show a noticeable tendency of capturing (not liberating) the electroconductive fine powder. Further, even when the electroconductive fine powder attached to distorted particles of 3.00–15.04 $\mu$m is supplied to the charging section, the electroconductive fine powder cannot be stably retained at the charging section, thus showing little chargeability promotion effect on the image-bearing member. Thus, it has been found possible to effect a smooth and stable supply of the electroconductive fine powder to the charging section by reducing the proportion of particles having a lower circularity among the particles in the particle size range of 3.00–15.04 $\mu$m.

As for toner particles having particle sizes below about 3 $\mu$m, the correlation between the toner particle shape and the liberatability of the electroconductive fine powder in the above mentioned specific particle size range is weak, the electroconductive fine powder shows a stronger tendency of moving together with such small toner particles without liberation regardless of the toner particle shape.

Further, the particles of 3.00–15.04 $\mu$m having a high circularity exhibit small attachment force onto the image-bearing member, thus showing excellent transferability and also excellent recoverability in the developing-cleaning step. Further, as mentioned above, the electroconductive fine powder can be readily liberated from such toner particles, thus exhibiting a better effect of promoting the recovery of the transfer-residual toner particles in the developing-cleaning step. Thus, by increasing the proportion of particles having a high circularity in the particle size range of 3.00–15.04 $\mu$m, it becomes possible to more stably suppress the occurrence of image defects due to recovery failure of toner particles in the developing-cleaning step.

As a result of further study, it has been found that in a developer containing 90–100% by number of particles having a circularity $\underline{a}$ of at least 0.90, the electroconductive fine powder having a range of particle size exhibiting the charging promotion effect on the image-bearing member through uniform dispersion and stable retention when brought to the charging section and also exhibiting a high degree of promoting the recovery of transfer-residual toner particles, can be readily liberated from the toner particles and supplied to the charging section at a better stability, so that it becomes possible to stably retain the good uniform chargeability on the image-bearing member even in a repetitive use of the image forming apparatus for a long period. Further, as the electroconductive fine powder can be more stably supplied to the image-bearing member after the transfer step, the electroconductive fine powder can exhibit better function of promoting the recovery of transfer residual toner particles in the developing-cleaning step.

It is further preferred that the developer contains 93–100% by number of particles having a circularity a of at least 0.90 in the particle size range of 3.00–15.04 μm. As a result, the supply of the electroconductive fine powder to the charging section can be performed at a better stability to exhibit a higher charging promotion effect on the image-bearing member, and further enhance the recovery of transfer-residual toner particles in the cleanerless image forming method.

The particles of 3.00–15.04 μm in the developer of the present invention principally comprise toner particles but need not be restricted to toner particles. Thus, the particles of 3.00–15.04 μm can partially include electroconductive fine powder or other additives and can still exhibit their particle shape effect of easily liberating the electroconductive fine powder in the specified particle size range.

The developer may preferably have a standard deviation of circularity distribution SD of at most 0.045 as determined according to the following formula with respect to the particles of 3.00–15.04 μm:

$$SD=[\Sigma(a_i-a_m)^2/n]^{1/2},$$

wherein $a_i$ represents a circularity of each particle, $a_m$ represents an average circularity and n represents a number of total particles, respectively in the particle size range of 3.00–15.04 μm.

By satisfying the above-mentioned feature of the standard deviation of circularity distribution SD being at most 0.045, the liberation characteristic or releasability of the electroconductive fine powder from the toner particles is stabilized, and the supply of the electroconductive fine powder onto the image-bearing member is stabilized, thereby further stabilizing the effect of improving uniform chargeability of the image-bearing member in the charging step and the effect of promoting the recovery of toner particles in the developing-cleaning step.

The particle size distribution and circularity distribution of a developer described herein in the particle size range of 0.60–159.21 μm is based on a number-basis distribution measured by using a flow particle image analyzer ("FPIA-1000" available from Toa Iyou Denshi K.K.) in the following manner. Herein, a circle-equivalent diameter (denoted by "$D_{CE}$") measured by the analyzer is taken as a "particle size".

Into ca. 10 ml of a solution (at 20° C.) formed by adding 0.1–0.5 wt. % of a surfactant (preferably an alkylbenzensulfonic acid salt) into deionized water from which fine dirt has been removed by passing through a filter so as to reduce the number of contaminant particles having particle sizes in the measurement range (i.e., circle-equivalent diameters of 0.60 μm (inclusive) to 159.21 μm (not inclusive)) to at most 20 particles, ca. 0.5 to 20 mg of a sample is added and uniformly dispersed by means of an ultrasonic disperser (output: 50 watt, with a 6 mm-dia. step chip) for 3 min. to form a sample dispersion liquid containing 7000–10,000 particles in the prescribed $D_{CE}$ range per μl, which is then subjected to measurement of particle size distribution and circularity distribution of particles in a circle-equivalent diameter range of 0.60–159.21 μm (upper limit, not inclusive) by using the above-mentioned flow particle image analyzer.

The details of the measurement is described in a technical brochure and an attached operation manual on "FPIA-1000" published from Toa Iyou Denshi K.K. (Jun. 25, 1995) and JP-A 8-136439. The outline of the measurement is as follows.

A sample dispersion liquid is caused to flow through a flat thin transparent flow cell (thickness=ca. 200 μm) having a divergent flow path. A strobe and a CCD camera are disposed at mutually opposite positions with respect to the flow cell so as to form an optical path passing across the thickness of the flow cell. During the flow of the sample dispersion liquid, the strobe is flashed at intervals of 1/30 second each to capture images of particles passing through the flow cell, so that each particle provides a two dimensional image having a certain area parallel to the flow cell. From the two-dimensional image area of each particle, a diameter of a circle having an identical area (an equivalent circle) is determined as a circle-equivalent diameter.

Further, for each particle, a peripheral length (Lo) of the equivalent circle is determined and divided by a peripheral length (L) measured on the two-dimensional image of the particle to determine a circularity (a) of the particle.

The results (frequency % and cumulative %) may be given for 226 channels in the range of 0.60 μm–400.00 μm (30 channels (divisions) for one octave) as shown in the following Table 1 (for each channel, the lower limit size value is included and the upper limit size value is excluded), whereas particles having circle-equivalent diameters in a range of 0.60 μm–159.21 μm (upper limit, not inclusive) are subjected to an actual measurement.

TABLE 1

| $D_{CE}$ range (μm) | $D_{CE}$ range (μm) | $D_{CE}$ range (μm) | $D_{CE}$ range (μm) |
|---|---|---|---|
| 0.60~0.61 | 3.09~3.18 | 15.93~16.40 | 82.15~84.55 |
| 0.61~0.63 | 3.18~3.27 | 16.40~16.88 | 84.55~87.01 |
| 0.63~0.65 | 3.27~3.37 | 16.88~17.37 | 87.01~89.55 |
| 0.65~0.67 | 3.37~3.46 | 17.37~17.88 | 89.55~92.17 |
| 0.67~0.69 | 3.46~3.57 | 17.88~18.40 | 92.17~94.86 |
| 0.69~0.71 | 3.57~3.67 | 18.40~18.94 | 94.86~97.63 |
| 0.71~0.73 | 3.67~3.78 | 18.94~19.49 | 97.63~100.48 |
| 0.73~0.75 | 3.78~3.89 | 19.49~20.06 | 100.48~103.41 |
| 0.75~0.77 | 3.89~4.00 | 20.06~20.65 | 103.41~106.43 |
| 0.77~0.80 | 4.00~4.12 | 20.65~21.25 | 106.43~109.53 |
| 0.80~0.82 | 4.12~4.24 | 21.25~21.87 | 109.53~112.73 |
| 0.82~0.84 | 4.24~4.36 | 21.87~22.51 | 112.73~116.02 |
| 0.84~0.87 | 4.36~4.49 | 2Z.51~23.16 | 116.02~119.41 |
| 0.87~0.89 | 4.49~4.62 | 23.16~23.84 | 119.41~122.89 |
| 0.89~0.92 | 4.62~4.76 | 23.84~24.54 | 122.89~126.48 |
| 0.92~0.95 | 4.76~4.90 | 24.54~25.25 | 126.48~130.17 |
| 0.95~0.97 | 4.90~5.04 | 25.25~25.99 | 130.17~133.97 |
| 0.97~1.00 | 5.04~5.19 | 25.99~26.75 | 133.97~137.88 |
| 1.00~1.03 | 5.19~5.34 | 26.75~27.53 | 137.88~141.90 |
| 1.03~1.06 | 5.34~5.49 | 27.53~28.33 | 141.90~146.05 |
| 1.06~1.09 | 5.49~5.65 | 28.33~29.16 | 146.05~150.31 |
| 1.09~1.12 | 5.65~5.82 | 29.16~30.01 | 150.31~154.70 |
| 1.12~1.16 | 5.82~5.99 | 30.01~30.89 | 154.70~159.21 |
| 1.16~1.19 | 5.99~6.16 | 30.89~31.79 | 159.21~163.86 |
| 1.19~1.23 | 6.16~6.34 | 31.79~32.72 | 163.86~168.64 |
| 1.23~1.28 | 6.34~6.53 | 32.72~33.67 | 168.64~173.56 |
| 1.28~1.30 | 6.53~6.72 | 33.67~34.65 | 173.56~178.63 |
| 1.30~1.34 | 6.72~6.92 | 34.65~35.67 | 178.63~183.84 |
| 1.34~1.38 | 6.92~7.12 | 35.67~36.71 | 183.84~189.21 |
| 1.38~1.42 | 7.12~7.33 | 36.71~37.78 | 189.21~194.73 |
| 1.42~1.46 | 7.33~7.54 | 37.78~38.88 | 194.73~200.41 |
| 1.46~1.50 | 7.54~7.76 | 38.88~40.02 | 200.41~206.26 |
| 1.50~1.55 | 7.76~7.99 | 40.02~41.18 | 206.26~212.28 |
| 1.55~1.59 | 7.99~8.22 | 41.18~42.39 | 212.28~218.48 |
| 1.59~1.64 | 8.22~8.46 | 42.39~43.62 | 218.48~224.86 |

TABLE 1-continued

| $D_{CE}$ range (μm) | $D_{CE}$ range (μm) | $D_{CE}$ range (μm) | $D_{CE}$ range (μm) |
|---|---|---|---|
| 1.64~1.69 | 8.46~8.71 | 43.62~44.90 | 224.86~231.42 |
| 1.69~1.73 | 8.71~8.96 | 44.90~46.21 | 231.42~238.17 |
| 1.73~1.79 | 8.96~9.22 | 46.21~47.56 | 238.17~245.12 |
| 1.79~1.84 | 9.22~9.49 | 47.56~48.94 | 245.12~252.28 |
| 1.84~1.89 | 9.49~9.77 | 48.94~50.37 | 252.28~259.64 |
| 1.89~1.95 | 9.77~10.05 | 50.37~51.84 | 259.64~267.22 |
| 1.95~2.00 | 10.05~10.35 | 51.84~53.36 | 267.22~275.02 |
| 2.00~2.08 | 10.35~10.65 | 53.36~54.91 | 275.02~283.05 |
| 2.08~2.12 | 10.65~10.96 | 54.91~56.52 | 283.05~291.31 |
| 2.12~2.18 | 10.96~11.28 | 56.52~58.17 | 291.31~299.81 |
| 2.18~2.25 | 11.28~11.61 | 58.17~59.86 | 299.81~308.56 |
| 2.25~2.31 | 11.61~11.95 | 59.86~61.61 | 308.56~317.56 |
| 2.31~2.38 | 11.95~12.30 | 61.61~63.41 | 317.56~326.83 |
| 2.38~2.45 | 12.30~12.66 | 63.41~65.26 | 326.83~336.37 |
| 2.45~2.52 | 12.66~13.03 | 65.26~67.16 | 336.37~346.19 |
| 2.52~2.60 | 13.03~13.41 | 67.16~69.12 | 346.19~356.29 |
| 2.60~2.67 | 13.41~13.80 | 69.12~71.14 | 356.29~366.69 |
| 2.67~2.75 | 13.80~14.20 | 71.14~73.22 | 366.69~377.40 |
| 2.75~2.83 | 14.20~14.62 | 73.22~75.36 | 377.40~388.41 |
| 2.83~2.91 | 14.62~15.04 | 75.36~77.56 | 388.41~400.00 |
| 2.91~3.00 | 15.04~15.48 | 77.56~79.82 | |
| 3.00~3.09 | 15.48~15.93 | 79.82~82.15 | |

Each $D_{CE}$ range does not include the upper limit.

For actual calculation of an average circularity ($a_m$), the measured circularity values of the individual particles were divided into 61 classes in the circularity range of 0.40–1.00, and a central value of circularity of each class was multiplied with the frequency of particles of the class to provide a product, which was then summed up to provide an average circularity. It has been confirmed that the thus-calculated average circularity ($a_m$) is substantially identical to an average circularity value obtained as an arithmetic mean of circularity values directly measured for individual particles without the above-mentioned classification adopted for the convenience of data processing, e.g., for shortening the calculation time.

Incidentally, the particle size distribution and the circularity distribution of the developer of the present invention may also be confirmed by measurement using other apparatus based on similar principles as mentioned above.

The developer of the present invention may preferably contain 5–300 particles of the electroconductive fine powder having a particle size in the range of 0.6–3 μm per 100 toner particles. Such particles having particle sizes of 0.6–3 μm of the electroconductive fine powder can be readily separated from the toner particles and can be uniformly attached to and stably retained by the charging member. Accordingly, if such particles of the electroconductive fine powder are retained in a proportion of 5–300 particles per 100 toner particles, the supply of the electroconductive fine powder onto the image-bearing member is further promoted in the developing step and the transfer step, thereby further stabilizing the uniform chargeability of the image-bearing member. This is also effective for further stabilization of the recovery of the transfer-residual toner particles in the developing cleaning step.

If the electroconductive fine powder particles of 0.6–3 μm are less than 5 particles per 100 toner particles, it becomes difficult to provide 15–60% by number of particles of 1.00–2.00 μm attributable to the electroconductive fine powder in the developer, thus being liable to reduce the effect of charging promotion on the image-bearing member and the effect of promoting the recovery of the transfer-residual toner particles in the developing-cleaning step. On the other hand, if the electroconductive fine powder particles of 0.6–3 μm are excessively more than 300 particles per 100 toner particles, because of excessive electroconductive fine powder relative to the toner particles, the triboelectrification of the toner particles can be obstructed to lower the developing performance and transferability of the developer, thus resulting in lower image densities and increased transfer-residual toner particles which lead to the lowering in uniform chargeability of the image-bearing member and the recovery failure of the transfer-residual toner particles in the developing-cleaning step. For the above reason, it is preferred that the developer contains 5–300 particles, more preferably 10–100 particles, of 0.6–3 μm of the electroconductive fine powder per 100 toner particles.

The number of the electroconductive fine powder particles of 0.6–3 μm per 100 toner particles referred to herein is based on the values measured in the following manner. A developer sample is photographed in an enlarged form through a scanning electron microscope (SEM) equipped with an elementary analyzer such as XMA (X-ray microanalyzer) to provide an ordinary SEM picture and also an XMA picture mapped with elements contained in the electroconductive fine powder. Then, by comparing these pictures, electro-conductive fine powder particles are specified per 100 toner particles on the pictures, and image data thereof (at a magnification of 3000–5000 obtained from "FE-SEMS-800", available from Hitachi Seisakusho K.K.) are supplied via an interface to an image analyzer (e.g., "Luzex III", available from Nireco K.K.) to count the number of electroconductive fine powder particles having circle-equivalent diameters in the range of 0.06–3 μm (per 100 toner particles).

The developer of the present invention may preferably contain 1–10 wt. % thereof of the electroconductive fine powder. By containing the electroconductive fine powder in the above-described range, an appropriate amount of the electroconductive fine powder for promoting the chargeability of the image-bearing member can be supplied to the developing section, and a sufficient amount of the electroconductive fine powder for promoting the recovery of the transfer-residual toner particles in the developer-cleaning step is supplied onto the image-bearing member. If the content of the electroconductive fine powder in the developer is less than the above-mentioned range, the amount of the electroconductive fine powder supplied to the charging section is liable to be insufficient for attaining a stable effect of promoting the chargeability of the image-bearing member. In this instance, the amount of the electroconductive fine powder present on the image-bearing member together with the transfer-residual toner particles is liable to be insufficient for promoting the recovery of the transfer-residual toner particles in the developer-cleaning step. On the other hand, if the amount of the electroconductive fine powder is larger than the above-described range, an excessive amount of the electroconductive fine powder is liable to be supplied to the charging section, so that a large amount of the electroconductive fine powder not retainable at the charging section is liable to be discharged onto the image-bearing member to cause exposure failure. Further, the triboelectric chargeability of the toner particles is liable to be lowered or disordered thereby to cause image density lowering and increased fog. From these viewpoints, the electroconductive fine powder content in the developer may more preferably be 1.2–5 wt. %.

The electroconductive fine powder of the present invention may preferably have a resistivity of at most $10^9$ ohm.cm, so as to provide the developer with the effect of promoting the chargeability of the image-bearing member and the affect of promoting the recovery of transfer-residual toner particles. If the electroconductive fine powder has a resistivity exceeding the above-mentioned range, the effect of promoting the uniform chargeability of the image-bearing member becomes small, even if the electroconductive fine powder is present at the contact position between the charging member and the image-bearing member or in the charging region in the vicinity thereof so as to retain an intimate contact via the electroconductive fine powder between the contact charging member and the image-bearing member. Also in the developing-cleaning step, the electroconductive fine powder is liable to be charged to a polarity identical to that of the transfer-residual toner particles, thus remarkably lowering the effect of promoting the recovery of the transfer-residual toner particle.

In order to sufficiently attain the effect of promoting the chargeability of the image-bearing member owing to the electroconductive fine powder, thereby stably accomplishing good uniform chargeability of the image-bearing member, it is preferred that the electroconductive fine powder has a resistivity lower than the resistivity at the surface or at contact part with the image-bearing member of the contact charging member, more preferably 1/100 or below of the resistivity of the contact charging member.

It is further preferred that the electroconductive fine powder has a resistivity of at most $10^6$ ohm.cm, so as to better effect the uniform charging of the image-bearing member by overcoming the attachment to or mixing with the contact charging member of the insulating transfer-residual toner particles, and more stably attain the effect of promoting the recovery of the transfer-residual toner particles. It is further preferred that the electroconductive fine powder has a resistivity of 1 to $10^5$ ohm.cm.

The resistivity of electroconductive fine powder may be measured by the tablet method and normalized. More specifically, ca. 0.5 g of a powdery sample is placed in a cylinder having a bottom area of 2.26 $cm^2$ and sandwiched between an upper and a lower electrode under a load of 15 kg. In this state, a voltage of 100 volts is applied between the electrodes to measure a resistance value, from which a resistivity value is calculated by normalization.

It is also preferred that the electro-conductive fine powder is transparent, white or only pale-colored, so that it is not noticeable as fog even when transferred onto the transfer material. This is also preferred so as to prevent the obstruction of exposure light in the latent image-step. It is preferred that the electroconductive fine powder shows a transmittance of at least 30%, more preferably at least 35%, with respect to imagewise exposure light used for latent image formation, as measured in the following manner.

A sample of electroconductive fine powder is attached onto an adhesive layer of a one-side adhesive plastic film to form a mono-particle densest layer. Light flux for measurement is incident vertically to the powder layer, and light transmitted through to the backside is condensed to measure the transmitted quantity. A ratio of the transmitted light to a transmitted light quantity through an adhesive plastic film alone is measured as a net transmittance. The light quantity measurement may be performed by using a transmission-type densitometer (e.g., "310", available from X-Rite K.K.).

It is also preferred that the electro-conductive fine powder is non-magnetic. One reason for this is that a magnetic electroconductive fine powder is liable to be colored. Further, in an image forming method using a magnetic force for conveyance and retention of a developer on a developer-carrying member, a magnetic electroconductive fine powder is not readily transferred onto the image-bearing member, so that the supply of the electroconductive fine powder onto the image-bearing member is liable to be insufficient or the electroconductive fine powder is liable to be accumulated on the developer-carrying member, thus obstructing the development with the toner particles. Further, when a magnetic electroconductive fine powder is added to magnetic toner particles, the liberation of the electroconductive fine powder from the toner particles is liable to be difficult due to magnetic agglomeration force, thus obstructing the supply of the electroconductive fine powder onto the image-bearing member.

The electroconductive fine powder used in the present invention may for example comprise: carbon fine powder, such as carbon black and graphite powder; and fine powders of metals, such as copper, gold, silver, aluminum and nickel; metal oxides, such as zinc oxide, titanium oxide, tin oxide, aluminum oxide, indium oxide, silicon oxide, magnesium oxide, barium oxide, molybdenum oxide, iron oxide, and tungsten oxide; and metal compounds, such as molybdenum sulfide, cadmium sulfide, and potassium titanate; an complex oxides of these. The electroconductive fine powders may be used after adjustment of particle size and particle size distribution, as desired.

Among the above, it is preferred that the electroconductive fine powder comprises at least one species of oxide selected from the group consisting of zinc oxide, tin oxide and titanium oxide. These oxides are preferred since they provide an electroconductive fine powder with a low resistivity, and they are non-magnetic and white or pale-colored so as to be less liable to leave noticeable fog even when transferred onto the transfer material.

It is also possible to use an electroconductive fine powder comprising a metal oxide doped with an element such as antimony or aluminum, or fine particles surface-coated with an electroconductive material. Examples of these are zinc oxide particles containing aluminum, titanium oxide fine particles surface coated with antimony tin oxide, stannic oxide fine particles containing antimony, and stannic oxide fine particles.

Commercially available examples of electroconductive titanium oxide fine powder coated with antimony-tin oxide may include: "EC-300" (Titan Kogyo K.K.); "ET-300", "HJ-1" and "HI-2" (Ishihara Sangyo K.K.) and "W-P" (Mitsubishi Material K.K.).

Commercially available examples of antimony-doped electroconductive tin oxide fine powder may include: "T-1" (Mitsubishi Material K.K.) and "SN-100P" (Ishihara Sangyo K.K.).

Commercially available examples of stannic oxide fine powder may include: "SM-S" (Nippon Kagaku Sankyo K.K.).

The electroconductive fine powder may preferably have a volume-average particle size of 0.5–10 $\mu$m. If the electroconductive fine powder has a volume-average particle size below the above range, the content of the electroconductive fine powder in the developer has to be set lower in order to obviate the lowering in developing performance, and if the content is excessively low, an effective amount of the electroconductive fine powder cannot be ensured, thus failing to provide an amount of the electroconductive fine powder sufficient to well effect the charging of the image-bearing member by overcoming the charging obstruction caused by the attachment and mixing of the insulating transfer-residual toner particles with the contact charging member in the charging section at the contact position between the charging member and the image-bearing member or in a region proximity thereto, whereby charging failure is liable to be caused. For this reason, it is further preferred that the volume-average particle size of the electroconductive fine powder is 0.6 μm or larger, particularly 0.8 μm or larger.

On the other hand, if the electroconductive fine powder has a volume-average particle size exceeding the above-mentioned range, the electroconductive fine powder having dropped off the charging member can interrupt or diffuse exposure light for latent image formation to result in lower image quality due to electrostatic latent image defect. If the volume-average particle size is larger than the above-mentioned range, the number of electroconductive fine powder particles per unit weight is reduced, so that it becomes difficult to sufficiently attain the effect of promoting the recovery of the transfer-residual toner particles. Further, because of the decrease in number of the electroconductive fine powder particles, in view of the decrease and deterioration of the electroconductive fine powder at a vicinity of the charging member, it becomes necessary to increase the content of the electroconductive fine powder in the developer in order to continually supply the electroconductive fine powder to the charging section and stabilize the uniform chargeability of the image-bearing member ensured by intimate contact via the electroconductive fine powder between the image-bearing member and the contact charging member. However, if the content of the electroconductive fine powder is excessively increased, the developer as a whole is liable to have a lower chargeability and developing performance, thus causing image density lowering and toner scattering, especially in a low humidity environment. For a similar reason, it is further preferred that the volume-average particle size of the developer is 5 μm or smaller, optimally 0.8–3 μm.

The volume-average particle size and particle size distribution of the electroconductive fine powder described herein are based on values measured in the following manner. A laser diffraction-type particle size distribution measurement apparatus ("Model LS-230", available from Coulter Electronics Inc.) is equipped with a liquid module, and the measurement is performed in a particle size range of 0.04–2000 μm to obtain a volume-basis particle size distribution. For the measurement, a minor amount of surfactant is added to 10 cc of pure water and 10 mg of a sample electroconductive fine powder is added thereto, followed by 10 min. of dispersion by means of an ultrasonic disperser (ultrasonic homogenizer) to obtain a sample dispersion liquid, which is subjected to a single time of measurement for 90 sec.

The particle size and particle size distribution of the electroconductive fine powder used in the present invention may for example be adjusted by setting the production method and conditions so as to produce primary particles of the electroconductive fine powder having desired particle size and its distribution. In addition, it is also possible to agglomerate smaller primary particles or pulverize larger primary particles or effect classification. It is further possible to obtain such electroconductive fine powder by attaching or fixing electroconductive fine particles onto a portion or the whole of base particles having a desired particle size and its distribution, or by using particles of desired particle size and distribution containing an electroconductive component dispersed therein. It is also possible to provide electroconductive fine powder with a desired particle size and its distribution by combining these methods.

In the case where the electroconductive fine powder is composed of agglomerate particles, the particle size of the electroconductive fine powder is determined as the particle size of the agglomerate. The electroconductive fine powder in the form of agglomerated secondary particles can be used as well as that in the form of primary particles. Regardless of its agglomerated form, the electroconductive fine powder can exhibit its desired function of charging promotion by presence in the form of the agglomerate in the charging section at the contact position between the charging member and the image-bearing member or in a region in proximity thereto.

The developer of the present invention further contains inorganic fine powder having a number-average primary particle size of 4–80 nm. In case where the inorganic fine powder has a number-average primary particle size larger than the above range or the inorganic fine powder is not added, the transfer-residual toner particles, when attached to the charging member, are liable to stick to the charging member, so that it becomes difficult to stably attain good uniform chargeability of the image-bearing member. Further, it becomes difficult to have the electroconductive fine powder be dispersed with the toner particles in the developer, so that the electroconductive fine powder is liable to be supplied irregularly onto the image-bearing member, whereby the portion of the image-bearing member with insufficient electroconductive fine powder is liable to cause charging failure, thus resulting in image defects. Further, in the developing-cleaning step, the portion of the image-bearing member with insufficient electroconductive fine powder is liable to cause temporary or local recovery failure of the transfer-residual toner particles. Further, the developer fails to be provided with a good flowability, the triboelectric charge of the toner particle is liable to be ununiform, thus resulting in difficulties of increased fog, image density lowering and toner scattering. In case where the inorganic fine powder has a number-average particle size below 4 nm, the inorganic fine powder is caused to have strong agglomeratability, so that the inorganic fine powder is liable to have a broad particle size distribution including agglomerates of which the disintegration is difficult, rather than the primary particles, thus being liable to result in image defects such as image dropout due development with the agglomerates of the inorganic fine powder and defects attributable to damages on the image-bearing member, developer-carrying member or contact charging member, by the agglomerates. For similar reasons, it is further preferred that the number-average primary particle size of the inorganic fine powder is in the range of 6–50 nm, particularly 8–35 nm.

In the developer of the present invention, the inorganic fine powder having the above-mentioned number-average primary particle size is added not only for improving the flowability of the developer to uniformize the triboelectric charge of the toner particle in the form of being attached onto the toner particles but also for uniformly dispersing the electroconductive fine powder relative to the toner particles in the developer, thereby uniformly supplying the electroconductive fine powder onto the image-bearing member.

The number-average primary particle size of inorganic fine powder described herein is based on the values measured in the following manner. A developer sample is photographed in an enlarged form through a scanning electron microscope (SEM) equipped with an elementary analyzer such as XMA to provide an ordinary SEM picture and also an XMA picture mapped with elements contained in the inorganic fine powder. Then, by comparing these pictures, the sizes of 100 or more inorganic fine powder primary particles attached onto or isolated from the toner particles are measured to provide a number-average particle size.

The inorganic fine powder used in the present invention may preferably comprise fine powder of at least one species selected from the group consisting of silica, titania and alumina. For example, silica fine powder may be dry process silica (sometimes called fumed silica) formed by vapor phase oxidation of a silicon halide or wet process silica formed from water glass. However, dry process silica is preferred because of fewer silanol groups at the surface and inside thereof and also fewer production residues such as $Na_2O$ and $SO_3^{2-}$. The dry process silica can be in the form of complex metal oxide powder with other metal oxides for example by using another metal halide, such as aluminum chloride or titanium chloride together with silicon halide in the production process.

The inorganic fine powder used in the present invention may preferably have been hydrophobized. By hydrophobizing the inorganic fine powder, the lowering in chargeability of the inorganic fine powder in a high humidity environment is prevented, and the environmental stability of the triboelectric chargeability of the toner particles on which the inorganic fine powder is attached is improved, whereby the developer can exhibit good developing performances, such as image density and fog-freeness, regardless of the environmental conditions. Thus, by suppressing the change in chargeability of the inorganic fine powder and triboelectric chargeability of the toner particles on which the inorganic fine powder is attached depending on changes in environmental conditions, it becomes possible to prevent the change in releasability of the electroconductive fine powder from the toner particles, thus stabilizing the supply of the electroconductive fine powder onto the image-bearing member to enhance the effects of promoting the chargeability of the image-bearing member and the recovery of the transfer-residual toner particles regardless of environmental changes.

As the hydrophobization agents, it is possible to use silicone varnish, various modified silicone varnish, silicone oil, various modified silicone oil, silane compounds, silane coupling agents, other organic silicon compounds and organic titanate compounds singly or in combination. Among these, it particularly preferred that the inorganic fine powder has been treated with at least silicone oil.

The silicone oil may preferably have a viscosity at 25° C. of 10–200,000 $mm^2/s$, more preferably 3,000–80,000 $mm^2/s$. If the viscosity is below the above range, the silicone oil is liable to lack in stable treatability of the inorganic fine powder, so that the silicone oil coating the inorganic fine powder for the treatment is liable to be separated, transferred or deteriorated due to heat or mechanical stress, thus resulting in inferior image quality. On the other hand, if the viscosity is larger than the above range, the treatment of the inorganic fine powder with the silicone oil is liable to become difficult.

Particularly preferred species of the silicone oil used may include: dimethylsilicone oil, methylphenylsilicone oil, α-methylstyrene-modified silicone oil, chlorophenylsilicone oil, and fluorine-containing silicone oil.

The silicone oil treatment may be performed, e.g., by directly blending the inorganic fine powder (optionally preliminarily treated with e.g., silane coupling agent) with silicone oil by means of a blender such as a Henschel mixer; by spraying silicone oil onto the inorganic fine powder; or by dissolving or dispersing silicone oil in an appropriate solvent and adding thereto the inorganic fine powder for blending, followed by removal of the solvent. In view of less by-production of the agglomerates, the spraying is particularly preferred.

It is also preferred that the inorganic fine powder is treated with a silane compound simultaneously with or in advance of the treatment with silicone oil. The treatment of the inorganic fine powder with a silane compound promotes the adhesion of silicone oil onto the inorganic fine powder, further uniformizing the hydrophobicity and chargeability of the inorganic fine powder.

In such a preferred fine of the treatment of the inorganic fine powder, silylation is performed in a first step to remove a hydrophilic site, such as a silanol group of silica, by a chemical bonding, and then a hydrophobic film is formed of silicone oil in a second step.

Such an inorganic fine powder may preferably be contained in 0.1–3.0 wt. % of the developer. If the content of the inorganic fine powder is less than the above-mentioned range, it is difficult to sufficiently attaint the effect of the inorganic fine powder. On the other hand, in excess of the above range, an excessive amount of the inorganic fine powder coats the electroconductive fine powder, so that the resultant developer behaves similarly as in the case where the electroconductive fine powder has a high resistivity. As a result, the supply of the electroconductive fine powder onto the image-bearing member is lowered to result in lower performances of the chargeability promotion effect and the recovery of the transfer-residual toner particles. It is further preferred that the inorganic fine powder content is 0.3–2.0 wt. %, more preferably 0.5–1.5 wt. %.

The inorganic fine powder having a number-average primary particle size of 4–80 nm may preferably have a specific surface area of 20–250 $m^2/g$, more preferably 40–200 $m^2/g$; as measured by the nitrogen adsorption BET method, e.g., the BET multi-point method using a specific surface area meter ("Autosorb 1", made by Yuasa Ionix K.K.).

The toner particles constituting the developer of the present invention are colored resinous particles comprising at least a binder resin and a colorant. The toner particles may preferably have a resistivity of at least $10^{10}$ ohm.cm, more preferably at least $10^{12}$ ohm.cm, which represents a substantially insulating characteristic. Unless the toner particles are substantially insulating, it is difficult to satisfy the developing performance and the transferability in combination, and charge injection to the toner particles under the developing electric field is liable to occur, thus causing chargeability disturbance of the developer leading to fog.

Examples of the binder resin constituting the toner particles may include; styrene resins, styrene copolymer resins, polyester resins, polyvinyl chloride resin, phenolic resin, natural resin-modified phenolic resin, natural resin-modified maleic acid resin, acrylic resin, methacrylic resin, polyvinyl acetate, silicone resin, polyurethane resin, polyamide resin, furan resin, epoxy resin, xylene resin, polyvinyl butyral, terpene resin, coumarone-indene resin, and petroleum resin.

Examples of the comonomer constituting a styrene copolymer together with styrene monomer may include other vinyl monomers inclusive of: styrene derivative, such as vinyltoluene; acrylic acid; acrylate esters, such as methyl acrylate, ethyl acrylate, butyl acrylate, dodecyl acrylate, octyl acrylate, 2-ethylhexyl acrylate, phenyl acrylate; methacrylic acid; methacrylate esters, such as methyl methacrylate, ethyl methacrylate, butyl methacrylate and octyl methacrylate; acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

It is possible that the binder resin inclusive of styrene polymers or copolymers has been crosslinked or can assume a mixture of crosslinked and un-crosslinked polymers.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

It is preferred the binder resin has a glass transition temperature (Tg) in the range of 50–70° C. If Tg is below the above range, the developer is liable to have lower preservability, and if Tg is excessively high, the fixability of the developer is liable to be lowered.

It is a preferred mode of the present invention to incorporate a wax in the toner particle. Examples of the wax incorporated in the present invention may include: aliphatic hydrocarbon waxes, such as low-molecular weight polyethylene, low-molecular weight polypropylene, polyolefin, polyolefin copolymers, microcrystalline wax, paraffin wax and Fischer-Tropsche wax; oxides of hydrocarbon waxes, such as polyethylene oxide; block copolymer waxes of these; waxes principally comprising waxes, such as carnauba wax, and montanate wax; and waxes formed by partially or sholly deacidifying aliphatic acid esters, such as deacidified carnauba wax. If it also possible to use a waxy product, examples of which may include: saturated linear aliphatic acids, such as palmitic acid, stearic acid, montanic acid, and long chain alkylcarboxylic acids longer alkyl chains; unsaturated aliphatic acids, such as brassidic acid, eleostearic acid, and parinaric acid; saturated alcohols, such as stearyl alcohol, arachidic alcohol, behenyl alcohol, carnaubyl alcohol, cetyl alcohol, melissyl alcohol, and long-chain alkyl alcohols having longer alkyl chains; polyhydric alcohols, such as sorbitol; aliphatic acid amides, such as linoleyl amide, oleyl amide, and lauryl amide; saturated aliphatic acid bisamides, such as methylenebisstearmide), ethylenebiscapamide, ethylenebisloaramide, and hexamethylenebisstearamide; unsaturated acid amides, such as ethylenebisoleic amide, hexamethylenebisoleic amide, N,N'-dioleyladipic amide, and N,N'-dioleylsebacamide; aromatic bisamides, such as m-xylenebisstearamide, N,N'-distearylisophthalamide; aliphatic acid metal salts (generally called metallic soap), such as calcium stearate, calcium laurate, zinc stearate and magnesium stearate; waxes formed by grafting vinyl monomers, such as styrene and acrylic acid onto aliphatic hydrocarbon waxes; partial esters between aliphatic acids and polyhydric alcohols, such as behenyl monoglyceride; and methyl ester compounds having hydroxyl groups obtained by hydrogenation of vegetable oils and fats.

In the present invention, the wax may preferably be used in 0.5–20 wt. parts, more preferably 0.5–15 wt. parts, per 100 wt. parts of the binder resin.

Examples of the colorant contained in the toner particles may include: carbon black, lamp black, ultramarine, nigrosin dyes, Aniline Blue, Phthalocyanine Blue, Hanza Yellow G, Rhodamine 6G, Calcooil Blue, Chrome Yellow, Quinacridone, Benzidine Yellow, Rose Bengal, triarylmethane dyes, and monoazo and disazo dyes and pigments. These dyes and pigments may be used singly or in mixture.

The developer according to the present invention may preferably be a magnetic developer having a magnetization (intensity) of 10–40 $Am^2/kg$, more preferably 20–35 $Am^2/kg$, as measured in a magnetic field of 79.6 kA/m.

The magnetization of the developer in a magnetic field of 79.6 kA/m is defined in the present invention for the following reason. Ordinarily, a magnetization at a saturated magnetism (i.e., a saturation magnetization) is used as a parameter for representing a magnetic property of a magnetic material, but a magnetization (intensity) of the developer in a magnetic field actually acting on the developer in the image forming apparatus is a more important factor in the present invention. In the case where a magnetic developer is used in an image forming apparatus, the magnetic field acting on the developer is on the order of several tens to a hundred and several tens kA/m in most commercially available image forming apparatus so as not to leak a large magnetic field out of the apparatus or suppress the cost of the magnetic field source. For this reason, a magnetic field of 79.6 kA/m (1000 oersted) is taken as a representative of magnetic field actually acting on a magnetic field in the image forming apparatus to determine a magnetization at a magnetic field of 79.6 kA/m.

If the magnetization at a magnetic field of 79.6 kA/m of the developer is below the above-described range, it becomes difficult to convey the developer by means of a magnetic force and difficult to have the developer carrying member uniformly carry the developer. Further, in the case of conveying the developer under a magnetic force, it becomes difficult to form uniform ears of the developer, so that the suppliability of the electroconductive fine powder onto the image-bearing member is lowered to result in a lower performance of recovery of the transfer-residual toner particles. If the magnetization at a magnetic field of 79.6 kA/m is larger than the above-described range, the toner particles are caused to have an increased magnetic agglomeratability, so that the uniform dispersion in the developer and the supply to the image-bearing member of the electroconductive fine powder become difficult, thus being liable to impair the effects of the present invention of promoting the chargeability of the image-bearing member and promoting the toner recovery.

In order to obtain such a magnetic developer, a magnetic material is incorporated in the toner particles. Examples of the magnetic material may include: magnetic iron oxides, such as magnetite, maghemite and ferrites; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium.

It is preferred to use a magnetic material having a saturation magnetization (at a magnetic field of 795.8 kA/m) of 10–200 $Am^2/kg$, a residual magnetization of 1–100 kA/m. The magnetic material may be used in 20–200 wt. parts per 100 wt. parts of the binder resin. Among the magnetic material, one principally comprising magnetite is particularly preferred.

The magnetization of a developer may be measured by using an oscillation-type magnetometer ("VSM P-1-10", made by Toei Kogyo K.K.) under an external magnetic field of 79.6 kA/m at room temperature (25° C.). Further, the magnetic properties of a magnetic material may be measured by applying an external magnetic field of 796 kA/m at room temperature (25° C.).

The developer of the present invention may preferably have a triboelectric chargeability in terms of absolute value of 20–100 mC/kg relative to spherical ion powder particles of 100 mesh-pass and 200 mesh-on. If the triboelectric chargeability of the developer is below the above range in absolute value, the transferability of the toner particles is lowered to increase the transfer-residual toner particles, so that the chargeability of the image-bearing member is lowered and the load of recovery of the transfer-residual toner particles is increased, thus being liable to cause recovery failure. If the triboelectric chargeability of the developer is larger than the above-described range in absolute value, the developer is caused to have an excessive electrostatic agglomeratability, so that it becomes difficult to ensure the uniform dispersion of the electroconductive fine powder in the developer and supply of the electroconductive fine powder onto the image-bearing member, thus impairing the effect of the present invention of promoting the chargeability of the image-bearing member and promoting the toner recovery. Particularly in the case of a magnetic developer also having a magnetic agglomeratability, it is necessary to further suppress the electrostatic agglomeratability, so that it is further preferred for the developer to have a triboelectric chargeability in absolute value of 25–50 mC/kg with respect to iron powder of 100 mesh-pass and 200 mesh-on.

Figure 5:
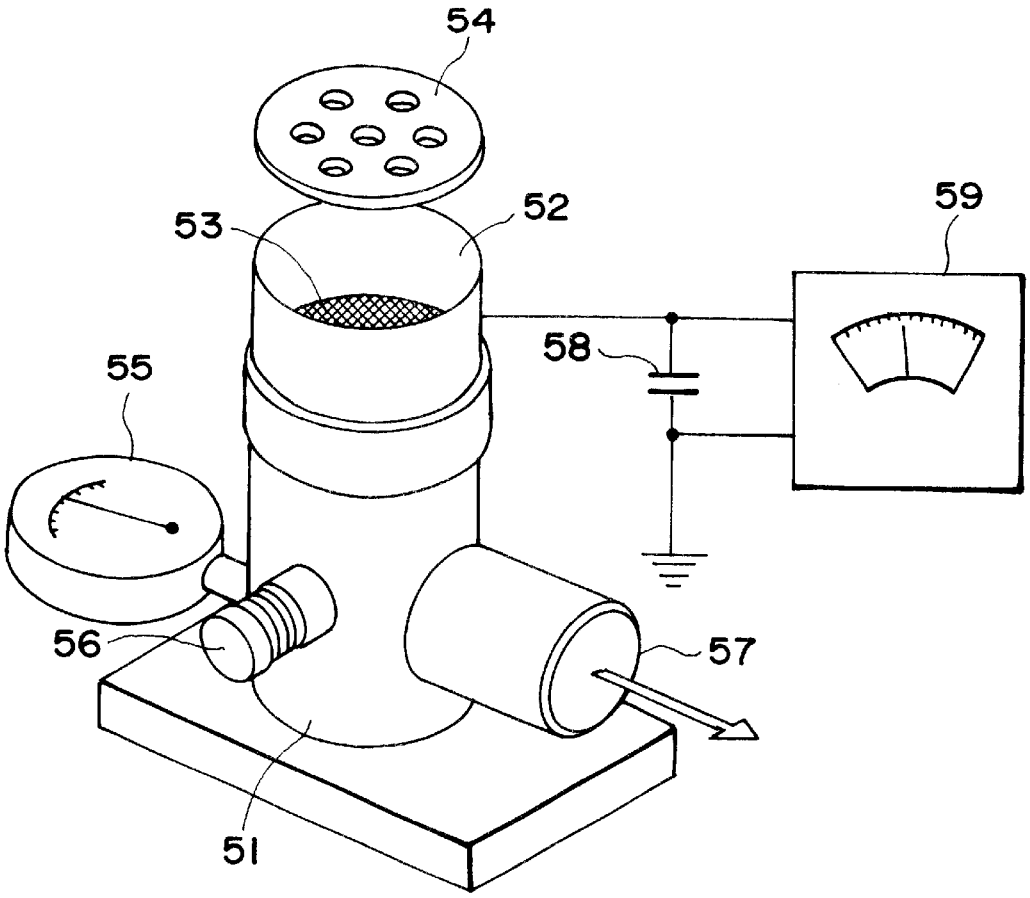
FIG. 5 illustrates an instrument for measuring the chargeability of a developer.

A method of measuring a triboelectric chargeability of a developer will now be described with reference to a drawing. FIG. 5 is an illustration of the apparatus. A 5:95 by weight mixture of a sample developer and spherical iron powder carrier of 100 mesh-pass and 200 mesh-on (e.g., "DSP138" available from Dowa Teppun K.K.) (e.g., 0.5 g of a developer and 9.5 g of iron powder) is charged in a 50 to 100 ml-polyethylene bottle and shaken for 100 times. Then, ca. 0.5 g of the mixture is placed in a metal measurement vessel 52 bottomed with a 500-mesh screen 53 and then covered with a metal lid 54. The weight of the entire measurement vessel 52 at this time is weighed at $W_1$ (g). Then, an aspirator 51 (composed of an insulating material at least with respect to a portion contacting the measurement vessel 52) is operated to suck the toner through a suction port 57 while adjusting a gas flow control value 56 to provide a pressure of 2450 Pa at a vacuum gauge 55. Under this state, the developer is sufficiently removed by sucking, preferably for ca. 1 min.

The potential reading on a potentiometer 59 at this time is denoted by V (volts) while the capacitance of a capacitor 58 is denoted by C (mF), and the weight of the entire measurement vessel is weighed at $W_2$ (g). Then, the triboelectric charge Q (mC/kg) of the sample developer is calculated by the following equation:

$$Q(\text{mC/kg})=C\times V/(W_1-W_2).$$

The developer according to the present invention may preferably further contain a positive or negative charge control agent.

Examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; diorganotin borates, such as dibutyltin borate, dioctyltin borate and dicyclohexyltin borate; quanidine compounds, and imidazole compounds. These may be used singly or in mixture of two or more species. Among these, it is preferred to use a triphenylmethane compound or a quaternary ammonium salt having a non-halogen counter ion. It is also possible to use as a positive charge control agent a homopolymer of or a copolymer with another polymerizable monomer, such as styrene, an acrylate or a methacrylate, as described above of a monomer represented by the following formula (1):

(1)

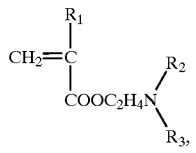

wherein $R_1$ denotes H or $CH_3$; $R_2$ and $R_3$ denotes a substituted or unsubstituted alkyl group (preferably $C_1$–$C_4$). In this instance, the homopolymer or copolymer may be function as (all or a portion of) the binder resin.

It is also preferred to use a compound of the following formula (2) as a positive charge control agent:

(2)

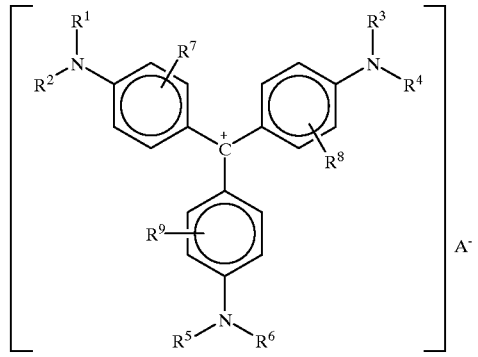

wherein $R^1$, $R^2$, $R^3$, $R^4$, $R^5$ and $R^6$ independently denote a hydrogen atom, a substituted or unsubstituted alkyl group, or a substituted or unsubstituted aryl group; $R^7$, $R^8$ and $R^9$ independently denote a hydrogen atom, a halogen atom, an alkyl group, or an alkoxy group; $A^-$ denotes an anion selected from sulfate, nitrate, borate, phosphate, hydroxyl, organo-sulfate, organo-sulfonate, organo-phosphate, carboxylate, organo-borate and tetrafluoroborate ions.

Examples of the negative charge control agent may include: organic metal complexes, chelate compounds, monoazo metal complexes, acetylacetone metal complexes, organometal complexes of aromatic hydroxycarboxylic acids and aromatic dicarboxylic acids, metal salts of aromatic hydroxycarboxylic acids, metal salts of aromatic polycarboxylic acids, and anhydrides and esters of such acids, and phenol derivatives.

It is also preferred to use as a negative charge control agent an azo metal complex represented by the following formula (3):

(3)

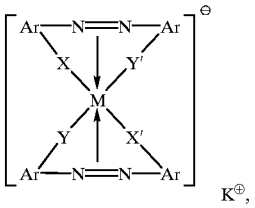

wherein M denotes a coordination center metal, such as Sc, Ti, V, Cr, Co, Ni, Mn or Fe; Ar denotes an aryl group, such as phenyl or naphthyl, capable of having a substituent, examples of which may include: nitro, halogen, carboxyl, anilide, or alkyl or alkoxy having 1–18 carbon atoms; X, X', Y and Y' independently denote —O—, —CO—, —NH—, or —NR— (wherein R denotes an alkyl having 1–4 carbon atoms; and $K^+$ denotes a cation, such as hydrogen, sodium, potassium, ammonium or aliphatic ammonium. The cation $K^{\oplus}$ can be omitted.

It is particularly preferred that the center metal is Fe or Cr; the substituent is halogen, alkyl or anilide group; and the cation is hydrogen, ammonium or aliphatic ammonium. It is also preferred to use a mixture of complex salts having different counter ions.

It is also preferred to use as a negative charge control agent as a basic organic acid metal complex represented by the following formula (4):

(4)

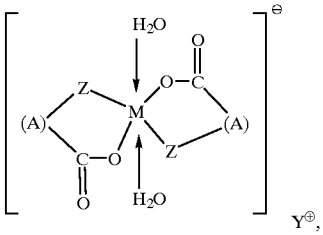

wherein M denotes a coordination center metal, such as Cr, Co, Ni, Mn, Fe, Zn, Al, Si or B; A denotes

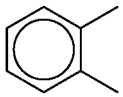

(capable of having a substituent, such as an alkyl,

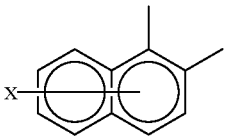

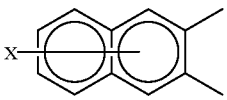

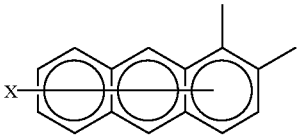

-continued

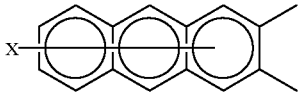

(X denotes hydrogen, halogen, nitro, or alkyl),

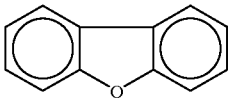

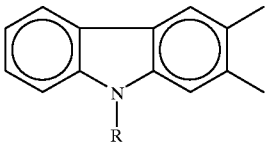

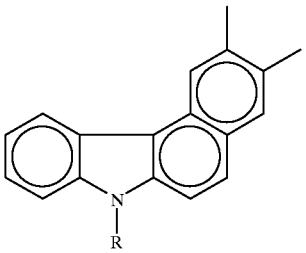

(R denotes hydrogen, $C_1$–$C_{18}$ alkyl or $C_1$–$C_{18}$ alkenyl); $Y^{\oplus}$ denotes a cation, such as hydrogen, sodium, potassium, ammonium, or aliphatic ammonium; and Z denotes —O— or —CO—O—. The cation can be omitted.

It is particularly preferred that the center metal is Al, Zn, Ar or Cr; the substituent is halogen alkyl anilide group; and the cation is hydrogen, alkalimetal, ammonium or aliphatic ammonium. It is also preferred to use a mixture of complex salts having different cations.

Such a charge control agent may be incorporated in a toner by internal addition into the toner particles or external addition to the toner particles. The charge control agent may be added in a proportion of 0.1–10 wt. parts, preferably 0.1–5 wt. parts, per 100 wt. parts of the binder resin while it can depend on the species of the binder resin, other additives, and the toner production process including the dispersion method.

The toner particles constituting the developer may preferably be produced through, e.g., a process wherein the above ingredients are sufficiently blended in a blender, such as a ball mill, and well kneaded by means of a hot kneading means, such as hot rollers, a kneader or an extruder, followed by cooling for solidification, pulverization, classification, and optionally a surface treatment for tone shape adjustment, as desired, to obtain toner particles. In addition to the above, it is also possible to adopt a process for producing spherical toner particles by spraying a molten mixture into air by using a disk or a multi-fluid nozzle as disclosed in JP-B 56-13945, etc.; a process of dispersing ingredients in a binder resin solution and spray-drying the mixture to obtain toner particles; a process for directly producing toner particles according to suspension polymerization as disclosed in JP-B 36-10231, JP-A 59-53856, and JP-A 59-61842; a process for producing toner particles according to emulsion polymerization as represented by soap-free polymerization wherein toner particles are directly formed by polymerization in the presence of a water-soluble polymerization initiator; an association process of causing resin fine particles and colorant particles to associate with each other in a solution to form toner particles; a dispersion polymerization process for directly producing toner particles in an aqueous organic solvent in which the monomer is soluble but the resultant polymer is insoluble; and a process for producing a so-called microcapsule toner wherein prescribed materials incorporated in the core particles or the shell material, or both of these.

The treatment for toner particle shape adjustment may be performed by various methods, including: a method of dispersing tone or particles produced through the pulverization process into water or an organic solution followed by heating or swelling; a heat-treating method of passing toner particles through a hot gas stream; and a mechanical impact method of treating toner particles under application of a mechanical force. The application of a mechanical impact force may be effected such means as the Mechanofusion System (of Hosokawa Micron K.K.) and the Hybridization System (of Nara Kikai Seisakusho K.K.) wherein toner particles are pressed against an inner wall of a casing under action of a centrifugal force exerted by blades stirring at high speeds, thereby applying mechanical impact forces including compression and abrasion forces to the toner particles.

For the mechanical impact application treatment for sphering of toner particles, it is preferred that the treatment atmosphere temperature to a range of temperature of Tg±30° C. around the glass transition temperature (Tg) of the toner particles, in view of agglomeration prevention and productivity. A treatment temperature in a range of Tg±20° C. is further preferred for effective action of the electroconductive fine powder.

Figure 7:
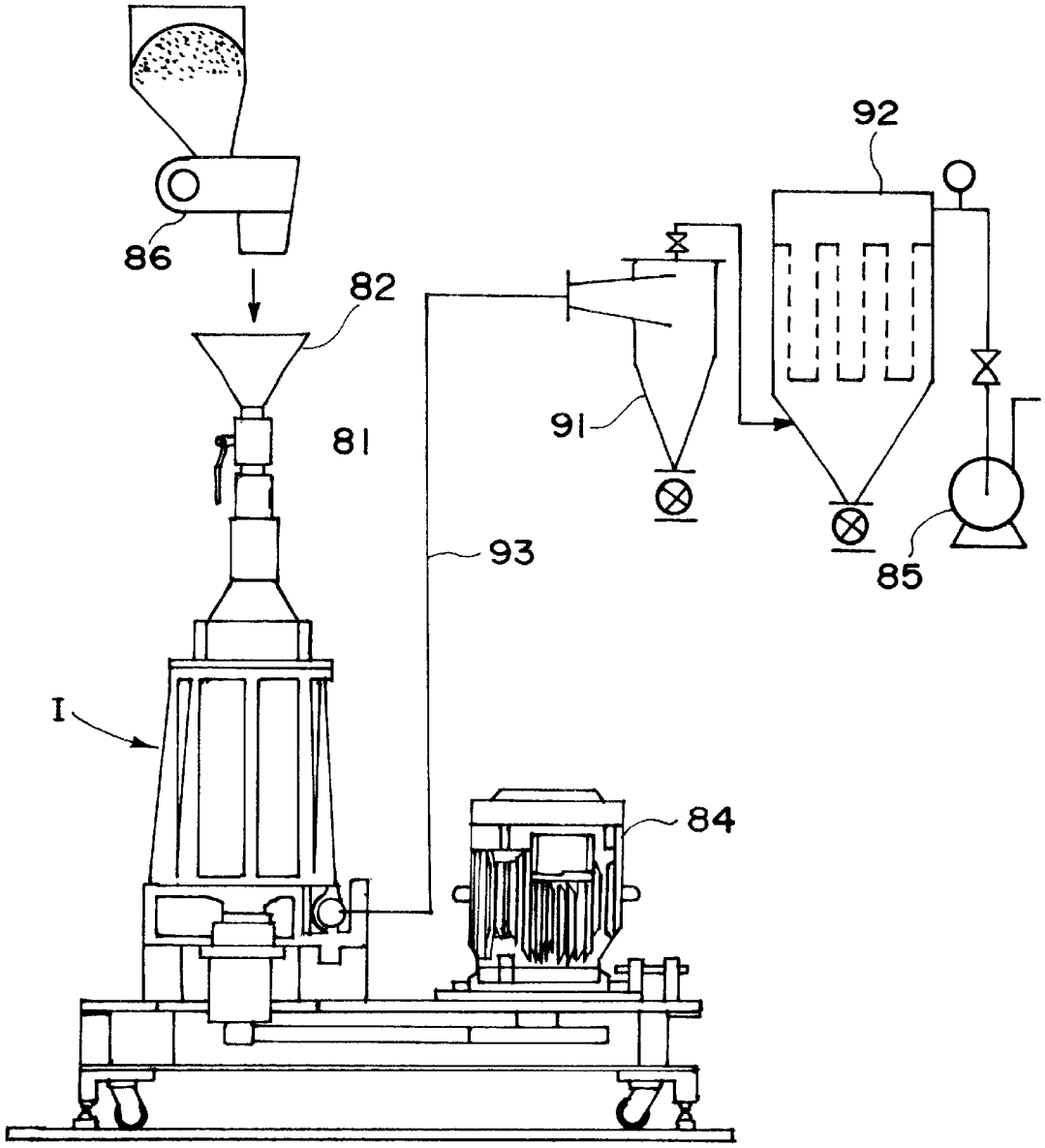
FIG. 7 is a system illustration of a toner particle sphering apparatus used in the invention.
Figure 8:
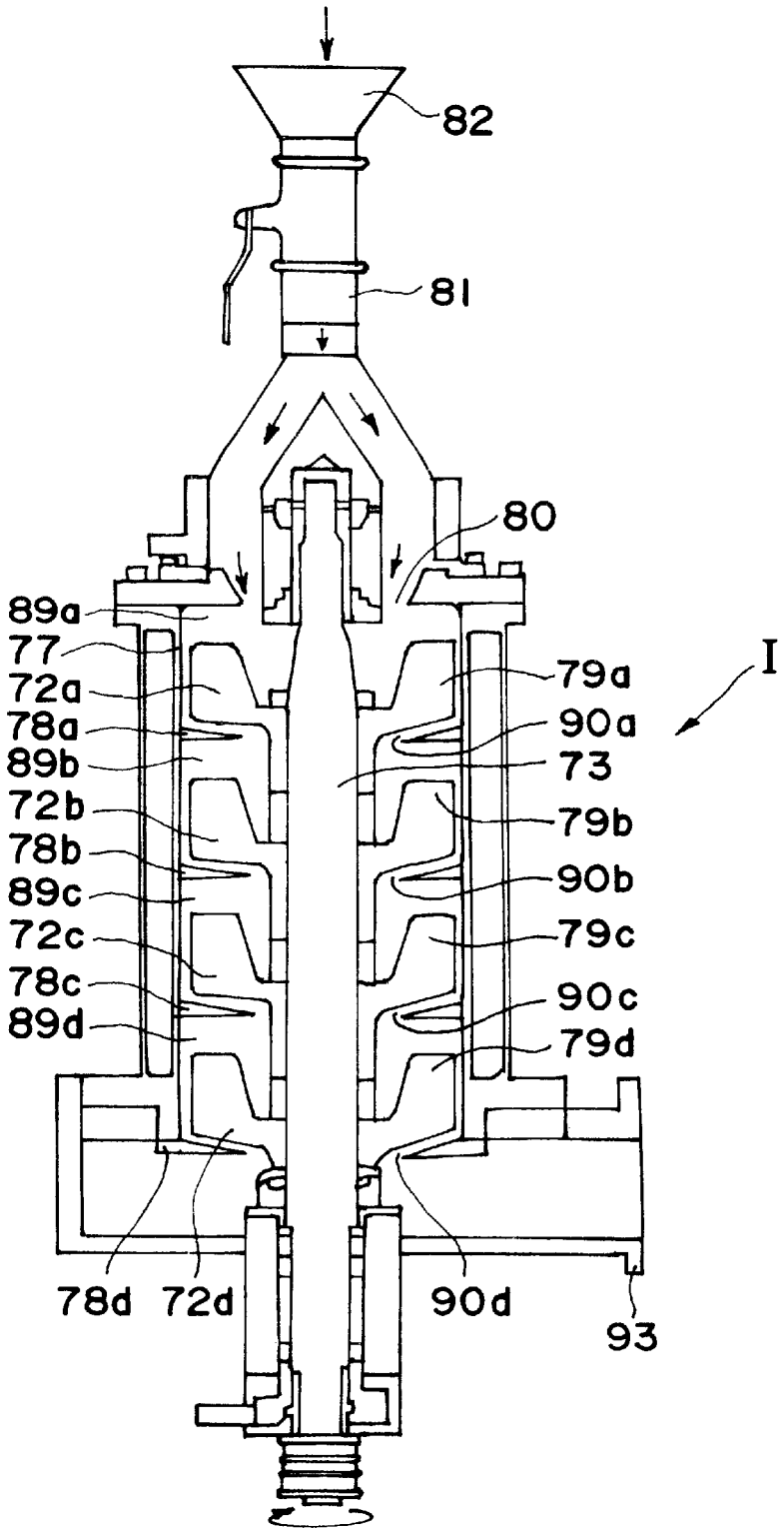
FIG. 8 is an enlarged illustration of a toner particle sphering section in the apparatus of FIG. 7.

An example of the method of repetitive thermo-mechanical impact force application for sphering toner particles is described more specifically while referring to FIGS. 7 and 8.

FIG. 7 is a schematic illustration of a toner particle sphering apparatus used in Production Examples 2–4 for toner particle production described hereinafter, and FIG. 8 is an enlarged sectional illustration of a treating section I of the apparatus of FIG. 7.

The toner particle sphering apparatus is operated on a principle of pressing toner particles against an inner wall of a casing under the action of a centrifugal force exerted by high-speed stirring blades and repetitively applying thermo-mechanical impact forces including at least a compression force and an abrasion force to the toner particles, thereby sphering the toner particles. As shown in FIG. 8, the treating section I is equipped with vertically arranged four rotors 72*a*–72*d*, which are rotated together with a rotating drive shaft 73 by an electrical motor 84 (FIG. 7) so as to provide an outermost peripheral speed of, e.g., 100 m/s and at a revolution speed of, e.g., $130s^{-1}$. Further, a suction blower 85 (FIG. 7) is operated to cause a gas flow rate which is comparable to or even larger than a gas flow rate caused by rotation of blades 79*a*–79*d* integrally formed with the rotors 72*a*–72*d*. Toner particles are supplied by sucking from a feeder 86 together with air into a hopper 82, and the thus-introduced toner particles are introduced via a powder supply pipe 81 and a powder supply port 80 to a central part of a first cylindrical processing chamber 89*a*. In the chamber 89*a*, the toner particles are subject to a sphering treatment by the blade 79*a* and a side wall 77, and then introduced via a first powder discharge port 90*a* formed at a center of a guide plate 78*a* to a central part of a second cylindrical processing chamber 89*b*, wherein the toner particles are subjected to a further sphering treatment by the blade 79*b* and the side wall 77.

The toner particles treated for sphering in the second cylindrical processing chamber 89*a* are further introduced via a second powder discharge port 90*b* formed at a center of a guide plate 78*b* to a central part of a third cylindrical processing chamber 89*c* for further sphering between the blade 79*c* and the side wall 77, and then further introduced via a third powder discharge port 90*c* formed at a center of a guide plate 78*c* to a fourth cylindrical processing chamber 89*d* for further sphering between the blade 79*d* and the side wall 77. The air conveying the toner particles is sent through the first to fourth cylindrical processing chambers 89*a* to 89*d*, via a discharge pipe 93, a cyclone 91, a bag filter 92 and a suction blower 85 to be discharged out of the apparatus system.

The toner particles introduced in the respective cylindrical processing chambers 89*a*–89*d* are supplied with instantaneous mechanical actions by the blades 79*a*–79*d* and supplied with a mechanical impact force by impingement onto the side wall 77. By the rotation of the blades 79*a*–79*d* of a prescribed size installed on the rotors 72*a*–72*d*, respectively, a convection is caused from the center to the periphery and from the periphery to the center in a space above each rotor. Along with the convection, the toner particles residing in the cylindrical processing chambers 89*a*–89*d* are repetitively subjected to the mechanical impact between the blades 79*a*–79*d* and the side wall 77. Due to heat generated by the mechanical impact force, the toner particle surfaces are heated to a temperature in the vicinity of the glass transition temperature (Tg) of the toner binder resin, the toner particle shapes are sphered also under the action of the mechanical impact force. The application of the mechanical impact forces for sphering is repeated while the toner particles are conveyed through the respective cylindrical processing chamber 89*a*–89*d*, whereby the toner particles are effectively sphered in a continuous manner.

The degree of sphering of the toner particles can be controlled by factors, such as the residence time and temperature of the sphering processing chambers. More specifically, it is controlled by conditions, such as a rotating speed and a revolution speed of the rotors, the height, width and number of the blades; a clearance between the blade periphery and the side wall, an air suction rate by the suction blower, a temperature of toner particles introduced into the sphering section, and a temperature of the air conveying the toner particles.

The use of a batch-wise sphering apparatus (commercialized as "Hybridization System" from Nara Seisakusho K.K.) is also preferred.

The toner particle shape control may be effected to some extent by selection of toner particle ingredients such as a binder resin and pulverization conditions in the pulverization process. However, the trial for increasing the toner particle circularity (or sphericity) by using a pneumatic pulverizer is liable to result in a lower productivity. Accordingly, the selection of a condition for providing a higher toner particle circularity by using a mechanical pulverizer is preferred.

In order to provide toner particles with a low variation coefficient of particle size distribution, it is preferred to use a multi-division classifier in the classification step. Further, in order to reduce the ultrafine particles of toner particles in the range of 1.00–2.00 $\mu$m, it is preferred to use a mechanical pulverizer in the pulverization step.

By blending the toner particles thus prepared with external additives inclusive of the inorganic fine powder and the electroconductive fine powder, followed optionally by sieving, the developer of the present invention may be produced.

Various machines are commercially available for toner production through the pulverization process. Several examples thereof are enumerated below together with the makers thereof. For example, the commercially available blenders may include: Henschel mixer (mfd. by Mitsui Kozan K.K.), Super Mixer (Kawata K.K.), Conical Ribbon Mixer (Ohkawara Seisakusho K.K.); Nautamixer, Turbulizer and Cyclomix (Hosokawa Micron K.K.); Spiral Pin Mixer (Taiheiyo Kiko K.K.), Lodige Mixer (Matsubo Co. Ltd.). The kneaders may include: Buss Cokneader (Buss Co.), TEM Extruder (Toshiba Kikai K.K.), TEX Twin-Screw Kneader (Nippon Seiko K.K.), PCM Kneader (Ikegai Tekko K.K.); Three Roll Mills, Mixing Roll Mill and Kneader (Inoue Seisakusho K.K.), Kneadex (Mitsui Kozan K.K.); MS-Pressure Kneader and Kneadersuder (Moriyama Seisakusho K.K.), and Bambury Mixer (Kobe Seisakusho K.K.). As the pulverizers, Cowter Jet Mill, Micron Jet and Inomizer (Hosokawa Micron K.K.); IDS Mill and PJM Jet Pulverizer (Nippon Pneumatic Kogyo K.K.); Cross Jet Mill (Kurimoto Tekko K.K.), Ulmax (Nisso Engineering K.K.), SK Jet O. Mill (Seishin Kigyo K.K.), Krypron (Kawasaki Jukogyo K.K.), and Turbo Mill (Turbo Kogyo K.K.). As the classifiers, Classiell, Micron Classifier, and Spedic Classifier (Seishin Kigyo K.K.), Turbo Classifier (Nisshin Engineering K.K.); Micron Separator and Turboplex (ATP); Micron Separator and Turboplex (ATP); TSP Separator (Hosokawa Micron K.K.); Elbow Jet (Nittetsu Kogyo K.K.), Dispersion Separator (Nippon Pneumatic Kogyo K.K.), YM Microcut (Yasukwa Shoji K.K.). As the sieving apparatus, Ultrasonic (Koei Sangyo K.K.), Rezona Sieve and Gyrosifter (Tokuju Kosaku K.K.), Ultrasonic System (Dolton K.K.), Sonicreen (Shinto Kogyo K.K.), Turboscreener (Turbo Kogyo K.K.), Microshifter (Makino Sangyo K.K.), and circular vibrating sieves.

Some examples of other additives that may be used in the present invention are enumerated below (1) Abrasives: metal oxides, such as strontium titanate, cerium oxide, aluminum oxide, magnesium oxide, and chaomium oxide; nitrides, such as silicon nitride; carbides, such as silicon carbide; and metal salts, such as calcium sulfate, barium sulfate, and calcium sulfate.

(2) Lubricants: powder of fluorine-containing resin, such as polyvinylidene fluoride and polytetrafluoroethylene; silicone resin powder; aliphatic and metal salts, such as zinc stearate, and calcium stearate.

These additives may be added in 0.05–10 wt. parts, preferably 0.1–5 wt. parts, per 100 wt. parts of the toner particles. These additives may be used singly or in combination of two or more species.

Image-forming Method, Image-forming Apparatus and Process-cartridge

Next, the image forming method and image forming apparatus capable of suitably using the developer of the present invention will now be described. The process-cartridge of the present invention will be also described.

According to a first embodiment thereof, the image forming method according to the present invention comprises a repetition of image forming cycles each including: (I) a charging step of charging in image-bearing member; (II) a latent image forming step of writing image data onto the charged surface of the image-bearing member to form an electrostatic latent image thereon; (III) a developing step of developing the electrostatic latent image with the developer of the present invention to form a toner image thereon; and (IV) a transfer step of transferring the toner image onto a transfer(-receiving) material, wherein, in the above-mentioned charging step, a charging member is caused to contact the image-bearing member at a contact position in the presence of at least the electroconductive fine powder of the developer, and in this contact state, the charging member is supplied with a voltage to charge the image-bearing member.

According a second embodiment thereof, the image forming method according to the present invention comprising a repetition of image forming cycles each including: (i) a charging step of charging an image-bearing member; (ii) a latent image-forming step of writing image data onto the charged surface of the image-bearing member to form an electrostatic latent image thereon; (iii) a developing step of developing the electrostatic latent image with the developer of the present invention to form a toner image thereon; and (iv) a transfer step of transferring the toner image onto a transfer(-receiving) material, wherein the above-mentioned developing step is a step of developing the electrostatic latent to form the toner image and also a step of recovering the developer remaining on the image-bearing member after the toner image is transferred onto the transfer material.

The second embodiment of the image forming method employs a developing-cleaning scheme wherein the developing step is also used as a step for recovering a portion of developer remaining on the image-bearing member after transfer of a toner image onto the transfer material.

A first embodiment of image forming apparatus used in the present invention includes at least: (A) an image-bearing member for bearing an electrostatic latent image, (B) a charging means for charging the image-bearing member, (C) a latent image forming means for exposing the image-bearing member charged to form an electrostatic latent image on the image-bearing member, (D) a developing means for developing the electrostatic latent image with the developer of the present invention to form a toner image, and (E) a transfer means for transferring the toner image onto a transfer material, which are operated repeatedly to form a toner image on the image-bearing member; wherein the charging means includes a charging member caused to contact the image-bearing member at a contact position via the electroconductive fine powder of the developer and supplied with a voltage to charge the image-bearing member.

A second embodiment of image forming apparatus used in the present invention includes at least: (a) an image-bearing member for bearing an electrostatic latent image, (b) a charging means for charging the image-bearing member, (c) a latent image forming means for exposing the image-bearing member charged to form an electrostatic latent image on the image-bearing member, (d) a developing means for developing the electrostatic latent image with the developer of the present invention to form a toner image, and (e) a transfer means for transferring the toner image onto a transfer material, which are operated repeatedly to form a toner image on the image-bearing member; wherein the charging means is not only a means for developing the electrostatic latent image but also a means for recovering a portion of the developer remaining on the image-bearing member after transfer of the toner image onto the transfer material.

A first embodiment of the process-cartridge of the present invention is a process-cartridge which is detachably mountable to a main assembly of an image forming apparatus for developing an electrostatic latent image formed on an image-bearing member with a developer to form a toner image, transferring the toner image onto a transfer(-receiving) material, and fixing the toner image on the transfer material, wherein the process-cartridge includes:

an image-bearing member for bearing an electrostatic latent image thereon, a charging means for charging the image-bearing member, and a developing means for developing the electrostatic latent image on the image-bearing member with the developer of the present invention to form a toner image, wherein the charging means includes a charging member disposed to contact the image-bearing member and supplied with a voltage to charge the image-bearing member at a contact position where at least the electroconductive fine powder of the developer is co-present as a portion of the developer attached to and allowed to remain on the image-bearing member after transfer of the toner image by the transfer means.

A second embodiment of the process-cartridge of the present invention is a process-cartridge which is detachably mountable to a main assembly of an image forming apparatus for developing an electrostatic latent image formed on an image-bearing member with a developer to form a toner image and transferring the toner image onto a transfer(-receiving) material, wherein the process-cartridge includes:

an image-bearing member for bearing an electrostatic latent image thereon, a charging means for charging the image-bearing member, and a developing means for developing the electrostatic latent image on the image-bearing member with the developer of the present invention to form a toner image, wherein the above-mentioned developing means is a means for developing the electrostatic latent image to form the toner image and also a means for recovering the developer remaining on the image-bearing member after the toner image is transferred onto the transfer material.

The above-mentioned charging means may preferably include a developer-carrying member disposed opposite to the image-bearing member and a developer layer-regulating member for forming a thin layer of the developer on the developer-carrying member.

Hereinbelow, the image forming method, image forming apparatus and process-cartridge of the present invention will be described in more detail.

The charging step of the image forming method of the present invention is operated by using a non-contact-type charging device, such as a corona charger, or by using a contact-type charging device including a contact charging member of roller-type (charging roller), fur brush-type, magnetic brush-type or blade-type caused to contact an image-bearing member as a member-to-be-charged and applying a prescribed charging bias voltage to charge the image-bearing member to a prescribed potential of a prescribed polarity. In the present invention, it is preferred to use a non-contact-type charging device because of advantages, such as lower ozone-generating characteristic and lower electric power, compared with a contact-type charging device, such as a corona charger.

The transfer-residual toner particles on the image-bearing member include those corresponding to an image pattern formed and those of so-called fog corresponding to non-image pattern. The transfer-residual toner particles corresponding to an image pattern to be formed are difficult to completely recover in the developing-cleaning step, thus being liable to result in a pattern ghost which appears due to unrecovered toner particles in a subsequent image forming cycle. This type of transfer-residual toner particles corresponding to an image pattern can be recovered at a remarkably increased efficiency in the developing-cleaning step if the pattern of the transfer-residual toner particles is leveled or made even. For example, in a contact developing process, if the developer-carrying member carrying the developer and the image-bearing member contacting the developer-carrying member are moved with a relative speed difference, the pattern of the transfer-residual toner particles can be leveled to recover the transfer residual toner particles at a better rate. However, in case where transfer-residual toner particles remain in a large amount on the image-bearing member as by instantaneous power failure or paper clogging, the residual toner pattern obstructs the latent image formation to cause a pattern ghost. In contrast thereto, if a contact charging device is used, the residual toner pattern can be leveled by the contact charging member, so that the transfer-residual toner particles can be effectively recovered even when the developing step is non-contactive one and the pattern ghost due to recovery failure can be obviated. Further, even in the case where the transfer-residual toner particles remain in a large amount on the image-bearing member, the contact charging member functions to once dam the toner particles, level the residual toner pattern and gradually discharge the toner particles onto the image-bearing member, thus obviating the pattern ghost due to obstruction of the latent image formation. Moreover, the lowering in chargeability of the image-bearing member due to soiling of the contact charging member as a result of damming of such a large amount of the transfer-residual toner particles can be reduced to a level of practically no problem by using the developer of the present invention. Also from this viewpoint, it is preferred to use a contact charging device.

In the present invention, it is preferred to provide a relative surface speed difference between the charging member and the image-bearing member. This can result in a remarkable increase in torque acting between the contact charging member and the image-bearing member and a remarkably increased abrasion of the contact charging member and the image-bearing member. However, if some powdery component of the developer is present at the contact part between the contact charging member and the image-bearing member, a lubricating effect (i.e., friction-reducing effect) is obtained thereby to provide such a surface speed difference without causing a remarkable torque increase or remarkable abrasion.

It is preferred that the powdery component of the developer present at the contact part between the contact charging member and the image-bearing member comprises at least the electroconductive fine powder. It is further preferred that the amount of the electroconductive fine powder in the developer at the contact part is larger than that in the original developer supplied to the image forming method of the present invention. At least the electroconductive fine powder among the developer components is present at the contact part, an electrical path between the contact charging member and the image-bearing member is ensured, thereby suppressing the lowering in uniform chargeability of the image-bearing member due to the attachment to or mixing with the contact charging member of the transfer-residual toner particles. Further, the higher content of the electroconductive fine powder at the contact part more stably suppress the lowering in chargeability of the image-bearing member.

The charging bias voltage applied to the contact charging member may comprise a DC voltage alone or a DC voltage in superposition with an alternating voltage (or AC voltage). The alternating voltage may have an any appropriate waveform of sine wave, rectangular wave, triangular wave, etc. The alternating voltage can also comprise pulse voltages formed by periodically turning on and off a DC power supply. In this way, any waveform of voltage periodically changing voltage values can be used as such an alternating voltage.

In the present invention, it is preferred that the charging bias voltage applied to the contact charging member is below a discharge initiation voltage between the contact charging member and the image-bearing member. It is preferred that the direct injection charging mechanism is predominant in the contact charging process.

In the developing-cleaning method, the chargeability of the image-bearing member is liable to be lowered due to the attachment and mixing of the insulating transfer-residual toner particles to the contact charging member, and the lowering in chargeability of the image-bearing member begins to occur when the resultant toner layer provides a resistance obstructing the discharge voltage in a charging process wherein the discharge charging mechanism is predominant. In contrast thereto, in a charging process wherein the direct injection charging mechanism is predominant, the uniform chargeability of the image-bearing member is lowered by a decrease in probability of contact between the contact charging member and the image-bearing member due to attachment or mixing of the transfer-residual toner particles to the contact charging member, thereby lowering the contrast and uniformity of the latent image and thus resulting in a lower image density or increased fog. In view of such difference in lowering of chargeability between the discharge charging mechanism and the injection charging mechanism, the effect of preventing the lowering in chargeability of the image-bearing member or charging promotion caused by the presence of the electroconductive fine powder at the contact part is more noticeable in the direct injection charging mechanism, so that it is preferred to use the developer of the present invention in the direct injection charging mechanism. In order to prevent the toner layer formed by attachment or mixing of the transfer-residual toner particles onto the contact charging member from obstructing the discharge voltage in the discharge charging mechanism by the presence of the electroconductive fine powder at the contact part between the image-bearing member and the contact charging member, it is necessary to further increase the content of the electroconductive fine powder in the developer in the charging section (at the contact part and region proximate thereto). Accordingly, in the case where the transfer-residual toner particles in a large amount are attached to or mixed with the contact charging member, it becomes necessary to discharge a larger amount of the transfer-residual toner particles onto the image-bearing member so as to reduce the amount of the transfer-residual toner particles attached to or mixed with the contact charging member thereby preventing the toner layer formed thereby from acting as a resistance obstructing the discharge voltage. This leads to promotion of obstruction of the latent image formation. In contrast thereto, in the direct injection charging mechanism, by causing the electroconductive fine powder to be present at the contact between the image-bearing member and the contact charging member, it is possible to easily ensure the contact points via the electroconductive fine powder between the contact charging member and the image-bearing member, thereby preventing the lowering in contact probability between the contact charging member and the image-bearing member due to attachment or mixing of the transfer residual toner particles to the contact charging member and thus suppressing the lowering in chargeability of the image-bearing member.

Particularly, in the case of providing a relative surface speed difference between the contact charging member and the image-bearing member, the rubbing between the contact charging member and the image-bearing member functions to reduce the amount of the entire developer at the contact part between the image-bearing member and the contact charging member, thereby more positively preventing the charging obstruction on the image-bearing member, and the opportunity of the electroconductive fine powder contacting the image-bearing member at the contact part between the contact charging member and the image-bearing member is remarkably increased, thereby further promoting the direct injection charging to the image-bearing member via the electroconductive fine powder. In contrast thereto, the discharge charging is caused not at the contact part between the image-bearing member and the contact charging member but at a non-contact region proximate thereto wherein the image-bearing member and the contact charging member is disposed with a minute gap therebetween, the suppression of charging obstruction due to the reduction in the total amount of the developer at the contact part cannot be expected. Also from this viewpoint, it is preferred that the present invention adopts a charging process wherein the direct injection charging is predominant. Furthermore, in order to realize a charging process wherein the direct injection charging mechanism is predominant without relying on the discharge charging mechanism, it is preferred that the charging bias voltage applied to the contact charging member is below the discharge initiation voltage between the contact charging member and the image-bearing member.

In order to provide a relative surface speed difference between the contact charging member and the image-bearing member, it is preferred to drive the contact charging member in rotation.

It is preferred that the surface moving directions of the charging member and the image-bearing member are opposite to each other. Thus, it is preferred that the charging member and the image-bearing member are moved in mutually opposite directions at the contact part. This is preferred in order to enhance the effect of temporarily damming and levelling the transfer-residual toner particles on the image-bearing member brought to the contact charging member. This is for example accomplished by driving the contact charging member in rotation in a direction and also driving the image-bearing member in relation so as to move the surfaces of these members in mutually opposite directions. As a result, the transfer-residual toner particles on the image-bearing member are once released from the image-bearing member to advantageously effect the direct injection charging and suppress the obstruction of the latent image formation. Further, the effect of levelling the pattern of the transfer-residual toner particles is enhanced to promote the recovery of the transfer-residual toner particles and more surely prevent the occurrence of the pattern ghost due to recovery failure.

It is possible to provide a relative surface speed difference by moving the charging member and the image-bearing member in the same direction. However, as the charging performance in the direct injection charging depends on a moving speed ratio between the image-bearing member and the contact charging member, a larger moving speed is required in the same direction movement in order to obtain an identical relative movement speed difference than in the opposite direction movement. This is disadvantageous. Further, the opposite direction movement is more advantageous also in order to attain the effect of levelling the transfer-residual toner particle pattern on the image-bearing member.

In the present invention, it is preferred to provide a relative (movement) speed ratio between the image-bearing member and the charging member of 10–500%, more preferably 20–400%. If the relative speed ratio is below the above range, it is impossible to sufficiently increase the probability of contact between the contact charging member and the image-bearing member, thus being difficult to maintain the chargeability of the image-bearing member based on the direct injection charging mechanism. It is further difficult to attain the effect of suppressing the charging obstruction on the image-bearing member by reducing the amount of the developer present at the contact part between the image-bearing member and the contact charging member by rubbing between the contact charging member and the image-bearing member and the effect of levelling the transfer-residual toner particle pattern to enhance the recovery of the toner recovery in the developing-cleaning step. On the other hand, if the relative speed ratio is larger than the above range, the charging member is moved at a high speed so that the developer components brought to the contact part between the image-bearing member and the contact charging member is liable to be scattered in the apparatus, and the image-bearing member and the contact charging member and liable to be abraded quickly or damaged to result in a short life.

Further, in the case where the moving speed of the charging member is zero (the charging member is kept sill), a particular portion of the charging member contacts the moving image-bearing member, so that the portion of the charging member is liable to be abraded or deterioration, thus reducing the effect of suppressing the charging obstruction on the image-bearing member and the effect of levelling the transfer-residual toner particle pattern, thereby enhancing the toner recovery in the developing-cleaning step.

The relative (movement) speed ratio described herein is calculated according to the following formula:

$$\text{Relative speed ratio } (\%) = |[(Vc - Vp)/Vp] \times 100|,$$

wherein Vp denotes a moving speed of the image-bearing member, Vc denotes a moving speed of the charging member of which the sign is taken positive when the charging member surface moves in the same direction as the image-bearing member surface at the contact position.

In the present invention, it is preferred that the contact charging member has an elasticity so as to temporarily recover the transfer-residual toner particles on the image-bearing member by the charging member, carry the electroconductive fine powder with the charging member and provide a contact section between the image-bearing member and the charging member, thereby advantageously affecting the direct injection charging. This is also preferred for allowing the contact charging member to level the transfer-residual toner particle pattern, thereby enhancing the recovery of the transfer-residual toner particles.

Further, in the present invention, it is preferred that the charging member is electroconductive so as to charge the image-bearing member by applying a voltage to the charging member. More specifically, the charging member may preferably be an elastic conductive roller, a magnetic brush contact charging member comprising a magnetic brush formed of magnetic particles constrained under a magnetic force and disposed in contact with the image-bearing member, or a brush comprising conductive fiber. Because of a simple organization, the charging member may more preferably be an elastic conductive roller or a conductive brush roller, and it is particularly preferred that the charging member is an elastic conductive roller so as to stably hold the developer components (such as transfer-residual toner particles and electroconductive fine powder) attached or mixed thereto.

The elastic conductive roller should have an appropriate degree of hardness because too low a hardness results in a lower contact with the image-bearing member because of an unstable shape and abrasion or damage of the surface layer due to the electroconductive fine powder present at the contact part between the charging member and the image-bearing member, thus being difficult to provide a stable chargeability of the image-bearing member. On the other hand, too high a hardness makes it difficult to ensure a contact part with the image-bearing member and results in a poor microscopic contact with the image-bearing member surface, thus making it difficult to attain a stable chargeability of the image-bearing member. This also lowers the effect of leveling the transfer-residual toner particle pattern, thus making it difficult to enhance the recovery of the transfer-residual toner particles. If the contact pressure of the elastic conductive roller against the image-bearing member is increased so as to sufficiently provide the contact charging section and the levelling effect, the abrasion or damage of the contact charging member or the image-bearing member is liable to be caused. From these viewpoints, the elastic conductive roller may preferably have an Asker C hardness of 20–50, more preferably 25–50, further preferably 25–40. The values of Asker C hardness described herein are based on values measured by using a spring-type hardness meter ("Asker C", made by Kobunshi Keiki K.K.) according to JIS K6301 under a load of 9.8N in the form of a roller.

In the present invention, the elastic conductive roller may preferably have a surface provided with minute cells or unevennesses so as to stably retain the electroconductive fine powder.

In addition to the elasticity for attaining a sufficient contact with the image-bearing member, it is important for the elastic conductive roller to function as an electrode having a sufficiently low resistance for charging the moving image-bearing member. On the other hand, in case where the image-bearing member has a surface defect, such as a pinhole, it is necessary to prevent the leakage of voltage. In the case of an image-bearing member such as an electrophotographic photosensitive member, in order to have sufficient charging performance and leakage resistance, the elastic conductive roller may preferably have a resistivity of $10^3$–$10^8$ ohm.cm, more preferably $10^4$–$10^7$ ohm.cm. The resistivity values of an elastic conductive roller described herein are based on values measured by pressing the roller against a 30 mm-dia. cylindrical aluminum drum under an abutting pressure of 49 N/m and applying 100 volts between the core metal of the roller and the aluminum drum.

Such an elastic conductive roller may be prepared by forming a medium resistivity layer of rubber or foam material on a core metal. The medium resistivity layer may be formed in a roller on the core metal from an appropriate composition comprising a resin (of, e.g., urethane), conductor particles (of, e.g., carbon black), a vulvanizer and a foaming agent. Thereafter, a post-treatment, such as cutting or surface polishing, for shape adjustment may be performed to provide an elastic conductive roller.

The elastic conductive roller may be found of other materials. A conductive elastic material may be provided by dispersing a conducive substance, such as carbon black or a metal oxide, for resistivity adjustment in an elastomer, such as ethylene-propylene-diene rubber (EPDM), urethane rubber, butadiene-acrylonitrile rubber (NBR), silicone rubber or isoprene rubber. It is also possible to use a foam product of such an elastic conductive material. It is also possible to effect a resistivity adjustment by using an ionically conductive material alone or together with a conductor substance as described above.

The elastic conductive roller is disposed under a prescribed pressure against the image-bearing member while resisting the elasticity thereof to provide a charging contact part (or portion) between the elastic conductive roller and the image-bearing member. The width of the contact part is not particularly restricted but may preferably be at least 1 mm, more preferably at least 2 mm, so as to stably provide an intimate contact between the elastic conductive roller and the image-bearing member.

The charging member used in the charging step of the present invention may also be in the form of a brush comprising conductive fiber so as to be supplied with a voltage to charge the image-bearing member. The charging brush may comprise ordinary fibrous material containing a conductor dispersed therein for resistivity adjustment. For example, it is possible to use fiber of nylon, acrylic resin, rayon, polycarbonate or polyester. Examples of the conductor may include fine powder of electroconductive metals, such as nickel, iron, aluminum, gold and silver; electroconductive metal oxides, such as iron oxide, zinc oxide, tin oxide, antimony oxide and titanium oxide; and carbon black. Such conductors can have been surface-treated for hydrophization or resistivity adjustment, as desired. These conductors may appropriately be selected in view of dispersibility with the fiber material and productivity.

The charging brush as a contact charging member may include a fixed-type one and a rotatable roll-form one. A roll-form charging brush may be formed by winding a tape to which conductive fiber pile is planted about a core metal in a spiral form. The conductive fiber may have a thickness of 1–20 denier (fiber diameter of ca. 10–500 $\mu$m) and a brush fiber length of 1–15 mm arranged in a density of $10^4$–$3\times10^5$ fibers per inch ($1.5\times10^7$–$4.5\times10^8$ fibers per $m^2$).

The charging brush may preferably have as high a density as possible. It is also preferred to use a thread or fiber composed of several to several hundred fine filaments, e.g., threads of 300 denier/50 filaments, etc., each thread composed of a bundle of 50 filaments of 300 denier. In the present invention, however, the charging points in the direct injection charging are principally determined by the density of electroconductive fine powder present at the contact part and in its vicinity between the charging member and the image-bearing member, so that the latitude of selection of charging member materials has been broadened.

Similarly as the elastic conductive roller, the charging brush may preferably have a resistivity of $10^3$–$10^8$ ohm.cm, more preferably $10^4$–$10^7$ ohm.cm so as a to provide sufficient chargeability and leakage resistance of the image-bearing member.

Commercially available examples of the charging brush materials may include: electro-conductive rayon fiber "REC-B", "REC-C", "REC-M1" and "REC-M10" (available from Unitika K.K.), "SA-7" (Toray K.K.), "THUNDERRON" (Nippon Sanmo K.K.), "BELTRON" (Kanebo K.K.), "KURACARBO" (carbon-dispersed rayon, Kuraray K.K.) and "ROABAL" (Mitsubishi Rayon K.K.), "REC-B", "REC-C", "REC-M1" and "REC-M10" are particularly preferred in view of environmental stability.

The contact charging member may preferably have a flexibility so as to increase the opportunity of the electroconductive fine powder contacting the image-bearing member at the contact part between the contact charging member and the image-bearing member, thereby improving the direct injection charging performance. By having the contact charging member intimately contact the image-bearing member via the electroconductive fine powder and having the electroconductive fine powder densely rub the image bearing member surface, the image-bearing member can be charged not based on the discharge phenomenon but predominantly based on the stable and safe direct injection charging mechanism via the electroconductive fine powder. As a result, it becomes possible to attain a high charging efficiency not achieved by the conventional roller charging based on the discharge charging mechanism, and provide a potential almost equal to the voltage applied to the contact charging member to the image-bearing member. Further, as the contact charging member is flexible, it becomes possible to enhance the effect of temporarily damming the transfer-residual toner particles and the effect of levelling the pattern of the transfer-residual toner particles, in case where the transfer-residual toner particles are supplied in a large amount to the contact charging member, thereby more reliably preventing the image defects due to the obstruction of latent image formation and recovery failure of transfer-residual toner particles.

If the amount of the electroconductive fine powder present at the contact part between the image-bearing member and the contact charging member is too small, the lubricating effect of the electroconductive-fine powder cannot be sufficiently attained but results in a large friction between the image-bearing member and the contact charging member, so that it becomes difficult to drive the contact charging member in rotation with a speed difference relative to the image-bearing member. As a result, the drive torque increases, and if the contact charging member is forcibly driven, the surfaces of the contact charging member and the image-bearing member are liable to be abraded. Further, as the effect of increasing the contact opportunity owing to the electroconductive fine powder is not attained, it becomes difficult to attain a sufficient chargeability of the image bearing member. On the other hand, if the electroconductive fine powder is present in an excessively large amount, the falling of the electroconductive fine powder from the contact charging member is increased, thus being liable to cause adverse effects such as obstruction of latent image formation as by interception of imagewise exposure light.

According to our study, the electroconductive fine powder may preferably be present at a density of at least $10^3$ particles/$mm^2$, more preferably at least $10^4$ particles/$mm^2$, at the contact part between the image-bearing member and the image-bearing member. If the electroconductive fine powder is present in at least $10^3$ particles/mm, the lubricating effect of the electroconductive fine powder is sufficiently attained, thus avoiding an excessively large drive torque. Below $10^3$ particles/$mm^2$, it becomes difficult to sufficiently attain the lubricating effect and the effect of increasing the contact opportunity, thus being liable to cause a lowering in chargeability of the image-bearing member.

Further, in the case where the direct injection charging scheme is adopted in the image forming method also including the developing-cleaning step, the lowering in chargeability of the image-bearing member due to attachment and mixing of the transfer-residual toner particles to the charging member becomes problematic. In order to well effect the direct injection charging by overcoming the charging obstruction caused by the attachment and mixing of the transfer-residual toner particles, it is preferred that the electroconductive fine powder is present in at least $10^4$ particles/$mm^2$ at the contact part between the image-bearing member and the contact charging member. Below $10^4$ particles/mm$^2$, the lowering in chargeability of the image-bearing member is liable to be caused in the case of a large amount of transfer-residual toner particles.

The appropriate range of amount of the electroconductive fine powder on the image-bearing member in the charging step, is also determined depending on a density of the electroconductive fine powder affecting the uniform charging on the image-bearing member.

Figure 4:
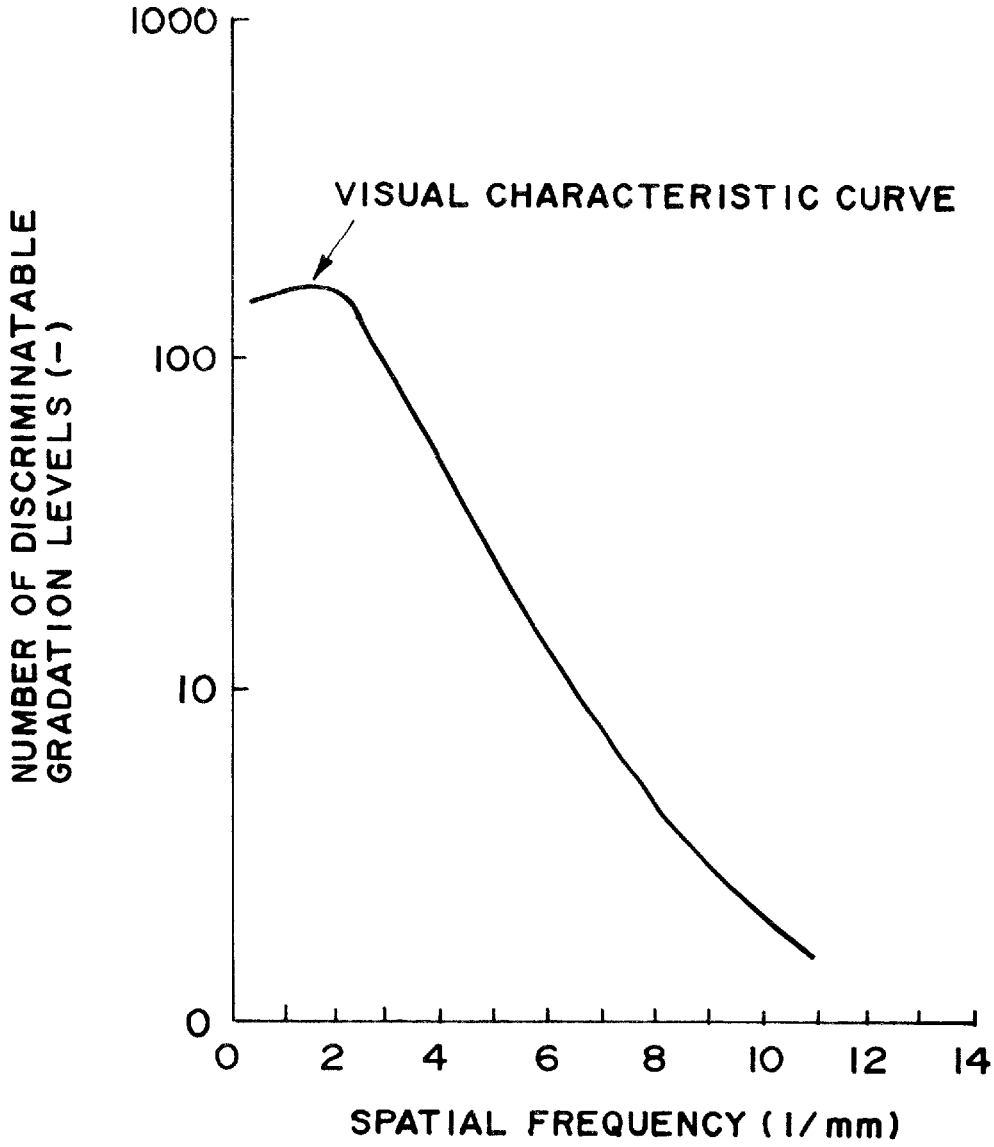
FIG. 4 shows a curve representing a change in visual characteristic of human eyes depending on spatial frequency.

It is needless to say that the image-bearing member has to be charged more uniformly than at least a recording resolution. However, in view of a human eye's visual characteristic curve shown in FIG. 4, at spatial frequencies exceeding 10 cycles/mm, the number of discriminatable gradation levels approaches infinitely to 1, that is, the discrimination of density irregularity becomes impossible. As a positive utilization of this characteristic, in the case of attachment of the electroconductive fine powder on the image-bearing member, it is effective to dispose the electroconductive fine powder at a density of at least 10 cycles/mm and effect the direct injection charging. Even if charging failure is caused at sites with no electroconductive fine powder, an image density irregularity caused thereby occurs at a spatial frequency exceeding the human visual sensitivity, so that no practical problem is encountered on the resultant images.

As to whether a charging failure is recognized as density irregularity in the resultant images, when the application density of the electroconductive fine powder is changed, only a small amount (e.g., 10 particles/mm$^2$) of electroconductive fine powder can exhibit a recognized effect of suppressing density irregularity, but this is insufficient from a viewpoint whether the density irregularity is tolerable to human eyes. However, an application amount of $10^2$ particles/mm$^2$ results in a remarkably preferable effect by objective evaluation of the image. Further, an application density of $10^3$ particles/mm$^2$ or higher results in no image problem at all attributable to the charging failure.

In the charging step based on the direct injection charging mechanism as basically different from the one based on the discharge charging mechanism, the charging is effected through a positive contact between the contact charging member and the image-bearing member, but even if the electro-conductive fine powder is applied in an excessively large density, there always remain sites of no contact. This however results in practically no problem by applying the electroconductive fine powder while positively utilizing the above-mentioned visual characteristic of human eyes.

The upper limit of the amount of the electroconductive fine powder present on the image-bearing member is determined by the formation of a densest mono-particle layer of the electroconductive fine powder. In excess of the amount, the effect of the electroconductive fine powder is not increased, but an excessive amount of the electroconductive fine powder is liable to be discharged onto the image-bearing member after the charging step, thus being liable to cause difficulties, such as interruption or scattering of imagewise. Thus, a preferable upper amount of the electroconductive fine powder may be determined as an amount giving a densest mono-particle layer of the electroconductive fine powder on the image-bearing member while it may depend on the particle size of the electroconductive fine powder and the retentivity of the electroconductive fine powder by the contact charging member.

More specifically, if the electroconductive fine powder is present on the image-bearing member at a density in excess of $5\times10^5$ particles/mm$^2$ while it depends on the particle size of the electroconductive fine powder, the amount of the electroconductive fine powder falling off the image-bearing member is increased to soil the interior of the image forming apparatus, and the exposure light quantity is liable to be insufficient regardless of the light transmissivity of the electroconductive fine powder. The amount is suppressed to be $5\times10^5$ particles/mm$^2$ or below, the amount of falling particles soiling the apparatus is suppressed and the exposure light obstruction can be alleviated.

Further, as a result of experiment for confirming the effect of enhancing the recovery of the transfer-residual toner particles in the developing cleaning step depending on the amount of the electroconductive fine powder on the image-bearing member, an amount in excess of $10^2$ particles/mm$^2$ on the image-bearing member after the charging step and before the developing step exhibited a clearly improved performance of recovery of transfer-residual toner particles compared with the case where the electroconductive fine powder was not present on the image-bearing member. This effect was recognized without causing image defects due to toner recovery failure in the developing-cleaning step up to an amount giving a densest mono-particle layer of the electroconductive fine powder. Similarly as the amount of the electroconductive fine powder on the image-bearing member after the transfer step and before the charging step, from an amount of the electroconductive fine powder exceeding about $5\times10^5$ particles/mm$^2$, the falling of the electroconductive fine powder from the image-bearing member became gradually noticeable, and the latent image formation was affected to cause increased fog.

Thus, it is preferred that the amount of the electroconductive fine powder at the contact part between the image-bearing member and the contact charging member is set to be at least $10^3$ particles/mm$^2$, and the amount of the electroconductive fine powder on the image-bearing member is set to be at least $10^2$ particles/mm$^2$ and not to substantially exceed $5\times10^5$ particles/mm$^2$, so that the chargeability of the image-bearing member is kept good, the transfer-residual toner particles are well recovered and images free from image defects due to exposure light obstruction can be formed without soiling the interior of the image forming apparatus.

The relationship between the amount of the electroconductive fine powder at the contact part between the image-bearing member and the contact charging member and the amount of the electroconductive fine powder on the image-bearing member in the latent image forming step is not simply determined because of factors, such as (1) the amount of supply of the electroconductive fine powder to the contact part between the image-bearing member and the contact charging member, (2) the attachability of the electroconductive fine powder to the image-bearing member and the contact charging member, (3) the retentivity of the electroconductive fine powder by the contact charging member, and (4) the retensitivity of the electroconductive fine powder by the image-bearing member. As an experimental result, the amount of the electroconductive fine powder in the range of $10^3$–$10^6$ particles/mm at the contact part between the image-bearing member and the contact charging member resulted in amounts of electroconductive fine powder falling on the image-bearing member (i.e., the amount of electroconductive fine powder on the image-bearing member in the latent image forming step) in the range of $10^2$–$10^5$ particles/mm$^2$.

The amounts of the electroconductive fine powder at the charging contact part and on the image-bearing member in the latent image forming step described herein are based on values measured in the following manner. Regarding the amount of the electroconductive fine powder at the contact part, it is desirable to directly measure the value at the contacting surfaces on the contact charging member and the image-bearing member. However, in the case of opposite surface moving directions of the contact charging member and the image-bearing member, most particles present on the image-bearing member prior to the contact with the contact charging member are peeled off by the charging member contacting the image-bearing member while moving in the reverse direction, so that the amount of the electroconductive fine powder present on the contact charging member just before reaching the contact part is taken herein as the amount of electroconductive fine powder at the contact part. More specifically, in the state of no charging bias voltage application, the rotation of the image-bearing member and the elastic conductive roller is stopped, and the surfaces of the image-bearing member and the elastic conductive roller are photographed by a video microscope ("OVM 1000N", made by Olympus K.K.) and a digital still recorder ("SR-310", made by Deltis K.K.). For the photographing, the elastic conductive roller is abutted against a slide glass under an identical condition as against the image-bearing member, and the contact surface is photographed at 10 parts or more through the slide glass and an objective lens having a magnification of 1000 of the video microscope. The digital images thus obtained are processed into binary data with a certain threshold for regional separation of individual particles, and the number of regions retaining particle factions are counted by an appropriate image processing software. Also the electroconductive fine powder on the image-bearing member is similarly photographed through the video microscope and the amount thereof is counted through similar processing.

The amounts of electroconductive fine powder on the image-bearing member at a point of after transfer and before charging and a point of after charging and before developing are counted in similar manners as above through photographing and image processing.

In the present invention, the image-bearing member may preferably have a surfacemost layer exhibiting a volume resistivity of $1\times10^{9}$–$1\times10^{14}$ ohm.cm, more preferably $1\times10^{10}$–$1\times10^{14}$ ohm.cm so as to provide a good chargeability of the image-bearing member. In the charging scheme based on direct charge injection, better charge transfer can be effected by lowering the resistivity of the member-to-be-charged. For this purpose, it is preferred that the surfacemost layer has a volume-resistivity of at most $1\times10^{14}$ ohm.cm. On the other hand, for the image-bearing member to retain an electrostatic image for a certain period, it is preferred that the surfacemost layer has a volume resistivity of at least $1\times10^{9}$ ohm.cm. In order to retain the electrostatic latent image including minute latent images even in a high humidity environment, the resistivity may preferably be $1\times10^{10}$ ohm.cm or higher.

It is further preferred that the image-bearing member is an electrophotographic photosensitive member and the photosensitive member has a surfacemost layer exhibiting a volume resistivity of $1\times10^{9}$–$1\times10^{14}$ ohm.cm so the image-bearing member can be provided with a sufficient chargeability even in an apparatus operated at a high process speed.

It is also preferred that the image-bearing member is a photosensitive drum or a photosensitive belt comprising a layer of photoconductive insulating material, such as amorphous selenium, CdS, $Zn_2O$, amorphous silicon or an organic photoconductor. It is particularly preferred to use a photosensitive member having an amorphous silicon photosensitive layer or an organic photosensitive layer.

The organic photosensitive layer may be a single photosensitive layer containing a charge-generating substance and a charge-transporting substance, or a function separation-type laminate photosensitive layer including a charge transport layer and a charge generation layer. A laminate photosensitive layer comprising a charge generation layer and a charge transport layer laminated in this order on an electroconductive support is a preferred example.

By a surface resistivity adjustment of the image-bearing member, it is possible to further stably effect the uniform charging of the image-bearing member.

In order to effect a surface resistivity adjustment of the image-bearing member so as to promote the charging injection at a better efficiency, it is also preferred to dispose a charge injection layer on the surface of an electrophotographic photosensitive member. The charge injection layer may preferably comprise a resin with electroconductive fine particles dispersed therein.

Such a charge injection layer may for example be provided in any of the following forms.

(i) A charge injection layer is disposed on an inorganic photosensitive layer of, e.g., selenium or amorphous silicon, or a single organic photosensitive layer.

(ii) A charge transport layer as a surface by comprising a charge-transporting substance and a resin in the function-separation-type organic photosensitive member is also caused to have the function of a charge injection layer. For example, a charge transport layer is formed from a resin, a charge-transporting substance and electroconductive particles dispersed therein, or a charge transport layer is also provided with a function of a charge injection layer by selection of the charge-transporting substance or the state of presence of the charge-transporting substance.

(iii) A function separation-type organic photosensitive member is provided with a charge injection layer as a surfacemost layer.

In any of the above forms, it is important that the surfacemost layer has a volume-resistivity in the above-mentioned preferred range.

The charge injection layer may for example be formed as an inorganic material layer, such as a metal deposition film, or an electroconductive powder-disposed resin layer comprising electroconductive fine particles dispersed in a binder resin. The deposition film is formed by vapor deposition. The electroconductive powder-dispersed resin layer may be formed by appropriate coating methods, such as dipping, spray coating, roller coating or beam coating. Such a charge injection layer may also be formed from a mixture or a copolymer of an insulating binder resin and a phototransmissive resin having an ionic conductivity, or a photoconductive resin having a medium resistivity as mentioned above.

It is particularly preferred to provide the image-bearing member with a resin layer containing at least electroconductive fine particles of metal oxide (metal oxide conductor particles) dispersed therein as a surfacemost charge injection layer. By disposing such a charge injection layer as a surfacemost layer on an electrophotographic photosensitive member, the photosensitive member is caused to have a lower surface resistivity allowing charge transfer at a better efficiency, and function as a result of lower surface resistivity, it is possible to suppress the blurring or flowing of a latent image caused by diffusion of latent image charge while the image-bearing member retains a latent image thereon.

In the oxide conductor particle-dispersed resin layer, it is necessary that the oxide conductor particles have a particle size smaller than the exposure light wavelength incident thereto so as to avoid the scattering of incident light by the dispersed particles. Accordingly, the oxide conductor particles may preferably have a particle size of at most 0.5 μm. The oxide conductor particles may preferably be contained in 2–90 wt. %, more preferably 5–70 wt. %, of the total weight of the surfacemost layer. Below the above range, it becomes difficult to obtain a desired resistivity. In excess of the above range, the charge injection layer is caused to have a lower film strength and thus is liable to be easily abraded to provide a shorter life. Further, the resistivity is liable to be excessively low, so that image defect is liable to occur due to flow of latent image potential.

The charge injection layer may preferably have a thickness of 0.1–10 μm, more preferably at most 5 μm so as to retain a sharpness of latent image contour. In view of the durability, a thickness of at least 1 μm is preferred.

The charge injection layer can comprise a binder resin identical to that of a lower layer (e.g., charge transport layer). In this case, however, the lower layer can be disturbed during the formation by application of the charge injection layer, so that the application method should be selected so as not to cause the difficulty.

The volume resistivity value of the surfacemost layer described herein are based on values measured in the following manner. A layer of a composition identical to that of the surfacemost layer is formed on a gold layer vapor-deposited on a polyethylene terephthalate (PET) film, and the volume resistivity of the layer is measured by a volume resistivity meter ("4140B pA", available from Hewlett-Packard Co.) by applying 100 volts across the film in an environment of 23° C. and 65% RH.

In the present invention, the image-bearing member surface may preferably have a releasability as represented by a contact angle with water of at least 85 deg., more preferably at least 90 deg.

Such an image-bearing member surface showing a high contact angle exhibits a high releasability with respect to toner particles. As a result, the rate of toner recovery in the developing-cleaning step is increased. Further, as the amount of transfer-residual toner particles can be reduced, it becomes possible to suppress the lowering in chargeability of the image-bearing member due to the transfer-residual toner particles.

The image-bearing member surface may be provided with an increased releasability, e.g., in the following manner:

(1) The surfacemost layer is formed from a resin having a low surface energy.

(2) An additive showing water-repellency or lipophilicity is added to the surfacemost layer.

(3) A material having high releasability in a powdery form is dispersed in the surfacemost layer. For (1), a resin having a fluorine-containing resin or a silicone group may be used. For (2), a surfactant may be used as the additive. For (3), it may be possible to use a material, a fluorine-containing compound inclusive of polytetrafluoroethylene, polyvinylidene fluoride or fluorinated carbon, silicone resin or polyolefin resin.

According to these measures, it is possible to provide an image-bearing member surface exhibiting a contact angle with water of at least 85 deg.

Among the above, it is preferred to use a surfacemost layer containing lubricating or releasing fine particles comprising at least one material selected from fluorine-containing resins, silicone resins and polyolefin resins, dispersed therein. It is particularly preferred to use a fluorine-containing resin, such as polytetrafluoroethylene or polyvinylidene fluoride, particularly as a material dispersed in the surfacemost layer according to the above-mentioned measure (3).

Such a surfacemost layer containing lubricating or releasing powder may be provided as an additional layer on the surface of a photosensitive member or by incorporating such lubricant powder into a surfacemost resinous layer of an organic photosensitive member.

The above-mentioned releasing or lubricating powder may be added to a surfacemost layer of the image-bearing member in a proportion of 1–60 wt. %, more preferably 2–50 wt. %. Below the above range, the effect of reducing the transfer-residual toner particles is scarce so that the recovery of transfer-residual toner particles in the developing-cleaning means may be insufficient. In excess of the above range, the surfacemost layer may have a lower film strength, the incident light quantity to the photosensitive member can be lowered, and the chargeability of the photosensitive member can be impaired. The powder may preferably have a particle size of at most 1 μm, more preferably at most 0.5 μm, in view of the image quality. If the particle size exceeds the above range, the resolution of images, particularly line images can be lowered due to scattering of the incident light.

The contact angle values described herein are based on values measured by using pure water and a contact angle meter ("Model CA-DS", available from Kyowa Kaimen Kagaku K.K.).

A preferred organization of photosensitive member as an image-bearing member is described below. The electroconductive substrate may comprise: a metal, such as aluminum or stainless steel; a plastic material coated with a layer of aluminum alloy or indium tin oxide; paper or plastic material impregnated with electroconductive particles; or a plastic material comprising an electroconductive polymer, in the form of a cylinder, a film or a sheet.

Such an electroconductive support may be coated with an undercoating layer for the purpose of, e.g., improved adhesion of a photosensitive layer thereon, improved coatability, protection of the substrate, coating of defects of the substrate, improved charge injection from the substrate, or protection of the photosensitive layer from electrical breakage.

The undercoating layer may be formed of a material such as polyvinyl alcohol, poly-N-vinylimidazole, polyethylene oxide, ethyl cellulose, methyl cellulose, nitro cellulose, ethylene-acrylic acid copolymer, polyvinyl butyral, phanolic resin, casein, polyamide, copolymer nylon, glue, gelatin, polyurethane or aluminum oxide. The undercoating layer may have a thickness of ordinarily 0.1–10 μm, more preferably 0.1–3 μm.

A charge generation layer may be formed by applying a paint formed by dispersing a charge-generating substance, such as azo pigment, phthalocyanine pigment, indigo pigment, perylene pigment, polycyclic quinone, squalylium dye, pyrylium salt, thiopyrylium salt, triphenylmethane dye, or an inorganic substance such as selenium or amorphous silicon, or by vapor deposition of such a charge-generating substance. Among these, a phthalocyanine pigment is particularly preferred in order to provide a photosensitive member with a photosensitivity adapted to the present invention. Examples of the binder resin may include: polycarbonate resin, polyester resin, polyvinyl butyral resin, polystyrene resin, acrylic resin, methacrylic resin, phenolic resin, silicone resin, epoxy resin or vinyl acetate resin. The binder resin may occupy at most 80 wt. %, preferably 0–40 wt. %, of the charge generation layer. The charge generation layer may preferably have a thickness of at most 5 μm, particularly 0.05–2 μm.

The charge transport layer has a function of receiving charge carriers from the charge generation layer and transporting the carriers under an electric field. The charge transport layer may be formed by dissolving or dispersing a charge-transporting substance in a solvent, optionally together with a binder resin, and applying the resulting coating liquid. The thickness may generally be in the range of 5–40 μm. Examples of the charge-transporting substance may include: polycyclic aromatic compounds including structures of biphenylene, anthracene, pyrene and anthracene; nitrogen-containing cyclic compounds, such as indole, carbazole, oxadiazole and pyrazolile; hydrazone compounds; styryl compounds; polymers having a group derived from the foregoing aromatic compounds in their main chains or side chains; selenium; selenium-tellurium; amorphous silicon.

Examples of the binder dispersing or dissolved together with such charge-transporting substances may include: polycarbonate resin, polyester resin, polymethacrylate resin, polystyrene resin, acrylic resin, polyamide resin; and organic photoconductive polymers, such as poly-N-vinylcarbazole and polyvinylanthracene.

It is possible to dispose a surface layer for promoting the charge injection formed by dispersing electroconductive fine particles in a binder resin, examples of which may include: polyester, polycarbonate, acrylic resin, epoxy resin, phenolic resin These resins may be used singly or in combination of two or more species, optionally together with a hardner of such a resin. The electroconductive fine particles may comprise a metal or a metal oxide. Preferred examples thereof may include: fine particles of zinc oxide, titanium oxide, tin oxide, antimony oxide, indium oxide, bismuth oxide, tin oxide-coated titanium oxide, tin-coated indium oxide, and antimony-coated tin oxide or zirconium oxide. These materials may be used singly or in combination of two or more species.

Figure 6:
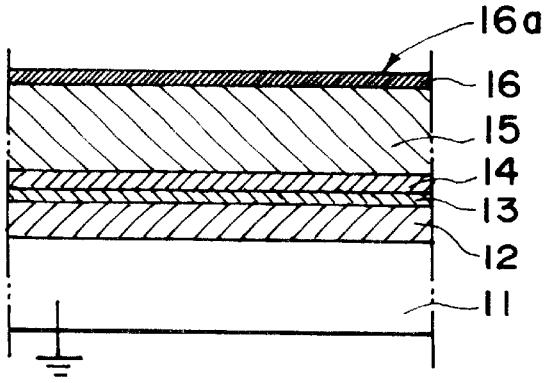
FIG. 6 is a schematic sectional view for illustrating a layer structure of a photosensitive member used as an image-bearing member in the invention.

FIG. 6 is a schematic sectional view of a photosensitive member provided with a charge injection layer. More specifically, the photosensitive member includes an ordinary organic photosensitive drum structure comprising an electroconductive substrate (aluminum drum substrate) 11, and an electroconductive layer 12, a positive charge injection prevention layer 13, a charge generation 14 and a charge transport layer 15 disposed successively by coating on the electroconductive substrate 1, and further includes a charge generation layer 16 formed by coating thereon for improving the chargeability by charge injection.

It is important for the charge injection layer 16 formed as the surfacemost layer of the image-bearing member to have a volume resistivity in the range of $1\times10^{9}$–$1\times10^{14}$ ohm.cm. A similar effect can be obtained without such a charge injection layer 16 if the charge transport layer 15 forming the surfacemost layer has a volume resistivity in the above-described range. For example, an amorphous silicon photosensitive member having a surface layer volume resistivity of ca. $10^{13}$ ohm.cm exhibits good chargeability by charge injection.

In the present invention, it is preferred that the latent image forming step of writing image data onto a charged surface of an image-bearing member is a step of subjecting the charged surface of the image-bearing member to imagewise exposure for writing the image data, and the latent image-forming means is an imagewise exposure means. The imagewise exposure means for electrostatic latent image formation is not restricted to a laser scanning exposure means for forming digital latent image formation, but may also be an ordinary analog imagewise exposure means or those using other types of light emission devices, such as LED, or a combination of a light emission device such as a fluorescent lamp and a liquid crystal shutter, etc. Thus, any imagewise exposure means capable of forming electrostatic latent images corresponding to image data can be used.

The image-bearing member can also be an electrostatic recording dielectric member. In this case, the dielectric surface as an image-bearing surface may be primarily uniformly charged to a prescribed potential of a prescribed polarity and then subjected to selective charge removed by charge removal means, such as a charge-removal stylus head or an electron gun, to write in objective electrostatic latent image.

The developer-carrying member (developing sleeve) used as a part of developing means in the present invention may preferably comprise an electroconductive cylinder (developing roller) formed of a metal or alloy, such as aluminum or stainless steel. Such an electroconductive cylinder can also be formed of a resinous composition having sufficient strength and electroconductivity. It is also possible to use an electroconductive rubber roller. Instead of a cylindrical form, it is also possible to use a form of an endless belt driven in rotation.

The developer-carrying member used in the present invention may preferably have a surface roughness (in terms of JIS central line-average roughness (Ra)) in the range of 0.2–3.5 μm. If Ra is below the above range, the amount of the developer carried on the developer-carrying member is reduced or the triboelectric charge of the developer on the developer-carrying member becomes higher, so that the developing performance is lowered. On the other hand, if Ra exceeds the above range, the developer layer on the developer-carrying member is accompanied with irregularities to result in images with density irregularity. Ra is further preferably 0.5–3.0 μm.

It is further preferred that the developer-carrying-member has a surface coating layer formed of a resin composition containing electroconductive fine particles and/or lubricant particles dispersed therein so as to control the triboelectric charge of the developer on the developer-carrying member.

The electroconductive fine particles may preferably be those exhibiting a resistivity of at most 0.5 Ω.cm under a pressure of $1.2\times10^{7}$ Pa.

The electroconductive fine particles may preferably comprise carbon fine particles, crystalline graphite particles or a mixture of these, and may preferably have a particle size of 0.005–10 μm.

Examples of the resin constituting the surface layer of the developer-carrying member may include: thermoplastic resin, such as styrene resin, vinyl resin polyethersulfone resin, polycarbonate resin, polyphenylene oxide resin, polyamide resin, fluorine-containing resin, cellulose resin, and acrylic resin; thermosetting resins, such as epoxy resin, polyester resin, alkyd resin, phenolic resin, urea resin, silicone resin and polyimide resin; an thermosetting resins.

Among the above, it is preferred to use a resin showing a releasability, such as silicone resin or fluorine-containing resin; or a resin having excellent mechanical properties, such as polyethersulfone, polycarbonate, polyphenylene oxide, polyamide, phenolic resin, polyester, polyurethane resin or styrene resin. Phenolic resin is particularly preferred.

The electroconductive fine particles may preferably be used in 3–20 wt. parts per 10 wt. parts of the resin. In the case of using a mixture of carbon particles and graphite particles, the carbon particles may preferably be used in 1 to 50 wt. parts per 10 wt. parts of the graphite particles.

The coating layer containing the electroconductive fine particles of the developer-carrying member may preferably have a volume resistivity of $10^{6}$ to $10^{6}$ ohm.cm.

In the present invention, it is preferred to form a developer layer at a coating rate of 3–30 g/m$^2$. The developer layer is a toner layer in the case where the developer is a monocomponent developer. By forming a developer layer at a coating rate of 3–30 g/m$^2$ on the developer-carrying member, it is possible to form a uniform developer coating layer, thereby uniformly supplying the electroconductive fine powder to the image-bearing member, so that the uniform charging of the image-bearing member may easily be accomplished. If the developer coating rate is below the above range, it is difficult to obtain a sufficient image density, and a minor irregularity in the developer layer on the developer-carrying member is liable to result in image density irregularity and a charge irregularity on the image-bearing member due to irregularity in supply of the electroconductive fine powder. If the developer coating rate exceeds the above range, the triboelectric charge of the toner particles is liable to be insufficient, thus being liable to result in toner scattering, increased fog and the charging obstruction on the image-bearing member due to a lowering in toner transferability.

It is further preferred to form a developer layer at a coating rate of 5–25 m$^2$/g on the developer-carrying member. As a result, the developer on the developer-carrying member is provided with a more uniform triboelectric charge, so that the influence of the recovered transfer-residual toner particles on the triboelectric charge of the toner particles in proximity to the developer-carrying member can be alleviated, thereby stably effecting the developing and cleaning operations in parallel in the developing-cleaning step. Below the above range, the recovered transfer-residual toner particles are liable to affect the triboelectric charge of the toner particles in proximity to the developer-carrying member, whereby a developer layer irregularity is caused due to excessive triboelectric charge of a part of the toner particles, and the recover of the transfer-residual toner particles can be ununiform. If the developer coating rate exceeds the above range, the recovered transfer-residual toner particles are again supplied to the developing section to be used for development without being supplied with a sufficient triboelectric charge, thus being liable to result in fog.

Further, in the present invention, it is particularly preferred that the developer layer coating rate is controlled by a regulating member which is disposed above the developer-carrying member and abutted against the developer-carrying member via the developer carried thereon, so as to suppress the change in developing performance caused by the recovery of the transfer-residual toner particles and provide the developer with a uniform triboelectric charge which is less liable to be affected in changes in environmental conditions and provides a good transferability.

In the present invention, the developer-carrying member surface may move in a direction which is identical to or opposite to the moving direction of the image-bearing member surface at the developing section. In the case of movement in the identical direction, the developer-carrying member may preferably be moved at a surface velocity which is at least 100% of that of the image-bearing member. Below 100%, the image quality can be lowered in some cases.

If the ratio is 100% or higher (i.e., the developer-carrying member is moved at a surface speed which is equal to or larger than that of the image-bearing member), the developer is supplied in a sufficient quantity from the developer-carrying member to the image-bearing member, and the electroconductive fine powder is also supplied sufficiently so that good chargeability of the image-bearing member is ensured.

It is further preferred that the developer-carrying member is moved at a surface velocity which is 1.05–3 times that of the image-bearing member. At a higher ratio (of the movement speed), the amount of the toner supplied to the developing section becomes larger, so that the frequency of attachment to and return from the latent image of the toner is increased to cause a frequent repetition of removal of the toner from unnecessary parts and attachment of the toner to a necessary parts, whereby the recovery rate of the transfer-residual toner particles is increased to more reliably suppress the occurrence of pattern ghost due to the recovery failure. Further, it is possible to provide a toner image faithful to the latent image. Further, in a contact developing mode, at a higher movement ratio, the recovery of the transfer-residual toner particles is improved due to rubbing between the image-bearing member and the developer-carrying member. However, if the movement speed substantially exceeds the above range, fog and image soiling are liable to occur due to scattering of the developer from the developer-carrying member, and the life of the image-bearing member or the developer-carrying member is liable to be shortened due to wearing or abrasion by rubbing in the contact developing mode. Moreover, in the case where the developer layer thickness regulating member is abutted against the developer-carrying member via the developer layer. The life of the developer-layer thickness regulating member or the developer-carrying member is liable to be shortened due to wearing and abrasion by rubbing. From the above points, it is further preferred that the surface movement speed ratio of the developer-carrying member to the image-bearing member is in the range of 1.1 to 2.5 times.

In order to apply a non-contact developing mode in the present invention, it is preferred to form a thin developer layer, which is smaller in thickness than a prescribed gap between the developer-carrying member and the image-bearing member, on the developer-carrying member. According to the present invention, it has become possible to effect image formation at a high image quality by using a developing-cleaning step according to a non-contact developing mode which has been difficult heretofore. In the developing step, by applying a non-contact developing mode wherein a developer layer is disposed in no contact with the image-bearing member to develop an electrostatic latent image on the image-bearing member to form a toner image, a development fog caused by injection of a developing bias electric field to the image-bearing member can be prevented even when electroconductive fine powder having a low electrical resistivity is added in a substantial amount in the developer, whereby good images can be obtained.

It is preferred that the developer-carrying member is disposed with a spacing of 100–1000 $\mu$m from the image-bearing member. If the spacing is below the charge range, the developing performance with the developer is liable to be fluctuated depending on a fluctuation of the spacing, so that it becomes difficult to mass-produce image-forming apparatus satisfying stable image qualities. If the spacing exceeds the above, the followability of toner particles onto the latent image on the image-bearing member is lowered, thus being liable to cause image quality lowering, such as lower resolution and lower image density. Further, the supply of the electroconductive fine powder onto the image-bearing member is liable to be insufficient, so that the chargeability of the image-bearing member is liable to be lowered. It is further preferred to dispose the developer-carrying member with a spacing of 100–600 $\mu$m from the image-bearing member. As a result, the recovery of the transfer-residual toner particles is more advantageously performed in the developing-cleaning step. If the spacing exceeds the above range, the recovery rate of the transfer-residual toner particles to the developing device is liable to be lowered to result in fog due to recovery failure.

In the present invention, it is preferred to operate the developing step under application of an alternating electric field (AC electric field) between the developer-carrying member and the image-bearing member which is formed by applying an alternating voltage between the developer-carrying member and the image-bearing member. The alternating developing bias voltage may be a superposition of a DC voltage with an alternating voltage (AC voltage).

The alternating bias voltage may have a waveform which may be a sine wave, a rectangular wave, a triangular wave, etc., as appropriately be selected. It is also possible to use pulse voltages formed by periodically turning on and off a DC power supply. Thus, it is possible to use an alternating voltage waveform.

It is preferred to form an AC electric field at a peak-to-peak intensity of $3\times10^6$–$10\times10^6$ V/m and a frequency of 100 to 5000 Hz between the developer-carrying member and the image-bearing member by applying a developing bias voltage. As a result, the electroconductive fine powder added to the developer can be readily and uniformly transferred to the image-bearing member, thereby achieving a uniform and intimate contact between the contact charging member and the image-bearing member via the electroconductive fine powder to remarkably promote the uniform charging, particularly direct injection charging, of the image-bearing member. Further, owing to the AC electric field, the charge injection to the image-bearing member at the developing section is not caused even when a high potential difference exists between the developer-carrying member and the image-bearing member, so that development fog caused by such charge injection to the image-bearing member is prevented even when a substantial amount of the electroconductive fine powder is added to the developer, thus providing good images. If the AC electric field strength is below the above range, the amount of the electroconductive fine powder supplied to the image-bearing member is liable to be insufficient, the uniform chargeability of the image-bearing member is liable to be lowered, and the resultant images are liable to exhibit a lower image density because of a smaller developing ability. On the other hand, if the AC electric field exceeds the above range, too large a developing ability is liable to result in a lower resolution because of collapsion of thin lines and image quality deterioration due to increased fog, a lowering in chargeability of the image-bearing member and image defects due to leakage of the developer bias voltage to the image-bearing member. If the frequency of the AC electric field is below the above range, it becomes difficult to uniformly supply the electroconductive fine powder to the image-bearing member, thus being liable to cause an irregularity in uniform charge on the image-bearing member. If the frequency exceeds the above range, the amount of the electroconductive fine powder supplied to the image-bearing member is liable to be insufficient, thus resulting in a lowering in uniform chargeability of the image-bearing member.

The AC electric field formed between the developer-carrying member and the image-bearing member may further preferably have a peak-to-peak intensity of $4\times10^6$–$10\times10^6$ V/m and a frequency of 500–4000 Hz. As a result, the electroconductive fine powder in the developer can be readily uniformly transferred to the image-bearing member, so that the electroconductive fine powder is uniformly applied onto the image-bearing member after the transfer step, thereby allowing a higher rate of recovery of the transfer-residual toner particles even in the non-contact developing mode. If the AC electric field strength between the developer-carrying member and the image-bearing member is below the above range, the rate of recovery of the transfer-residual toner particles to the developing device is liable to be lowered, thus resulting in fog due to the recovery failure. If the frequency is below the above range, the frequency of attachment to and release from the latent image of the toner is lowered and the rate of recovery of the transfer-residual toner particles to the developer is liable to be lowered, thus being liable to result in lower image qualities. If the AC electric field frequency exceeds the above range, the amount of toner particles capable of following the electric field change becomes smaller, so that the recovery rate of the transfer-residual toner particles is lowered, thus being liable to result in positive ghost due to the recovery failure.

The transfer step of the present invention can be a step of once transferring the toner image formed in the developing step to an intermediate transfer member and then re-transferring the toner image onto a recording medium, such as paper. Thus, the transfer(-receiving) material receiving the transfer of the toner image from the image-bearing member can be an intermediate transfer member, such as a transfer drum. In this case, the toner image on the intermediate transfer member is re-transferred to a recording medium, such as paper, to form a toner image thereon. By using such an intermediate transfer member, the amount of transfer-residual toner particles remaining on the image-bearing member can be reduced even when various types of recording media, inclusive of thick paper, are used.

In the present invention, it is preferred to use a transfer (-promoting) member is abutted against the image-bearing member (or an intermediate transfer member) via the transfer material (recording medium) in the transfer step.

In such a contact transfer step wherein a toner image on the image-bearing member (or intermediate transfer member) is transferred onto a transfer(-receiving) material while abutting a transfer member against the image-bearing member (or intermediate transfer member) via the transfer material, the abutting pressure of the transfer member may preferably be a linear pressure of 2.94–980 N/m, more preferably 19.6–490 N/m. If the abutting pressure is below the above range, difficulties, such as deviation in conveyance of the transfer material and transfer failure, are liable to occur. If the abutting pressure exceeds the above range, the deterioration of and toner attachment onto the photosensitive member surface are liable to occur, thus promoting toner melt-sticking onto the photosensitive member surface.

The transfer member used in the contact transfer step may preferably be a transfer roller or a transfer belt. The transfer roller may comprise a core metal and a conductive elastic layer coating the core metal. The conductive elastic roller may comprise an elastic material, such as polyurethane rubber or ethylene-propylenediene rubber (EPDM), and an electroconductivity-imparting agent, such as carbon black, zinc oxide, tin oxide or silicon carbide dispersed in the elastic material so as to provide a medium level of electrical resistivity (volume resistivity) of $10^6$–$10^{10}$ ohm.cm. The conductive elastic layer may be formed as a solid or foam layer.

Further preferred transfer conditions using such a transfer roller may include an abutting pressure of 2.4–490 N/m, more preferably 19.6–294 N/m. If the abutting pressure is below the above range, the amount of the transfer-residual toner particles is liable to increase, thus obstructing the chargeability of the image-bearing member. If the abutting pressure exceeds the above range, the electroconductive fine powder is liable to be transferred onto the transfer material because of an increased pressing force, so that the supplying of the electroconductive fine powder to the image-bearing member and the contact charging member is liable to be insufficient, thus lowering the effect of charge promotion on the image-bearing member and the rate o recovery of the transfer-residual toner particles in the developing-cleaning step. Further, the toner scattering on the resultant image is liable to be increased.

In the contact transfer step wherein the toner image is transferred onto the transfer material while abutting the transfer member against the image-bearing member, it is preferred to apply a DC voltage of ±0.2–±10 kV.

The present invention is particularly advantageously applicable to an image forming apparatus including a small-dia. photosensitive member having a diameter of at most 30 mm as an electrostatic latent image-bearing member. More specifically, as no independent cleaning step is included after the transfer step and before the charging step, the latitude of arrangement of the charging, exposure, developing and transfer means is increased and is combined with use of such a small dia.-photosensitive member to realize a reduction in entire size and space for installment of an image forming apparatus. This is also effective for an image forming apparatus including a belt-form photosensitive member having a curvature radius at an abutting position of at most 25 mm.

The image-forming apparatus may be of a type including a process-cartridge which includes at least the above-mentioned image-bearing member and the developing means and is detachably mountable to a main assembly of the apparatus. The process-cartridge can further include the above-mentioned charging means.

Hereinbelow, the present invention will be described more specifically based on Examples, to which however the present invention should not be construed to be restricted to.

First of all, some examples of production of photosensitive members as image-bearing members used in Examples are described below.

Production Example 1 for Photosensitive Member

A negatively chargeable photosensitive member (Photosensitive member 1) using an organic photoconductor ("OPC photosensitive member") having a sectional structure as shown in FIG. 6 was prepared in the following manner.

A 24 mm-dia. aluminum cylinder was used as a substrate 11 on which the following first to fifth functional layers 12–16 were successively formed in this order respectively by dipping (except for the charge injection layer 16).

First layer 12 was an electroconductive layer, a ca. 20 μm-thick conductor particle-dispersed resin layer (formed of phenolic resin with tin oxide and titanium oxide powder dispersed therein), for smoothening defects, etc., on the aluminum drum and for preventing the occurrence of moire due to reflection of exposure laser beam.

Second layer 13 was a positive charge injection-preventing layer for preventing a positive charge injected from the Al substrate 11 from dissipating the negative charge imparted by charging the photosensitive member surface and was formed as a ca. 1 μm-thick medium resistivity layer of ca. $10^6$ ohm.cm formed of methoxymethylated nylon.

Third layer 14 was a charge generation layer, a ca. 0.3 μm-thick resinous layer containing a disazo pigment dispersed in butyral resin, for generating positive and negative charge pairs on receiving exposure laser light.

Fourth layer 14 was a ca. 25 μm-thick charge transport layer formed by dispersing a hydrazbne compound in a polycarbonate resin. This is a p-type semiconductor layer, so that the negative charge imparted to the surface of the photosensitive member cannot be moved through the layer but only the positive charge generated in the charge generation layer is transported to the photosensitive member surface.

Fifth layer 16 was a charge injection layer containing electroconductive tin oxide ultrafine powder and ca. 0.25 μm-dia. tetrafluoroethylene resin particles dispersed in a photocurable acrylic resin. More specifically, a liquid composition containing low-resistivity antimony-doped tin oxide particles of ca. 0.3 μm in diameter in 100 wt. %, tetrafluoroethylene resin particles in 20 wt. % and a dispersing agent in 1.2 wt. %, respectively based on the resin dispersed in the resin, was applied by spray coating, followed by drying and photocuring, to form a ca. 2.5 μm-thick charge injection layer 16.

The surfacemost layer of the thus-prepared photosensitive member exhibited a volume resistivity of $5\times10^{12}$ ohm.cm and a contact angle with water of 102 deg.

Production Example 2 for Photosensitive Member

Photosensitive member 2 was prepared in the same manner as in Production Example 1 except for omitting the tetrafluoroethylene resin particle and the dispersing agent for production of the fifth layer (charge injection layer 16). The surfacemost layer of the thus-prepared photosensitive member exhibited a volume resistivity of $2\times10^{12}$ ohm.cm and a contact angle with water of 78 deg.

Production Example 3 for Photosensitive Member

Photosensitive member 3 was prepared in the same manner as in Production Example 1 except that the fifth layer (charge injection layer 16) was prepared from a composition containing 300 wt. parts of the low-resistivity antimony-doped tin oxide particles per 100 wt. parts of the photocurable acrylic resin. The surfacemost layer of the thus-prepared photosensitive member exhibited a volume resistivity of $2\times10^7$ ohm.cm and a contact angle with water of 88 deg.

Production Example 4 for Photosensitive Member

Photosensitive member 4 having a four layer structure including the charge transport layer 15 as the surfacemost layer was prepared in the same manner as in Production Example 1 except for omitting the fifth layer (charge injection layer 16). The surfacemost layer of the thus-prepared photosensitive member exhibited a volume resistivity of $1\times10^{15}$ ohm.cm and a contact angle with water of 73 deg.

Next, some examples of production of charging members used in Examples are described below.

Production Example 1 for Charging Member

Charging member 1 (charging roller) was prepared in the following manner.

A SUS (stainless steel)-made roller of 6 mm in diameter and 264 mm in length was used as a core metal and coated with a medium resistivity roller-form foam urethane layer formed from a composition of urethane resin, carbon black (as electroconductive particles), a vulcanizing agent and a foaming agent, followed by cutting and polishing for shape and surface adjustment to obtain a charging roller having a flexible foam urethane coating layer of 12 mm in outer diameter and 234 mm in length.

The thus-obtained charging roller exhibited a resistivity of $10^5$ ohm.cm and an Asker C hardness of 30 deg. with respect to the foam urethane layer.

Production Example 2 for charging member

A SUS (stainless steel)-made roller of 6 mm in diameter and 264 mm in length was used as a core metal and coated with a medium resistivity roller-form foam EPDM layer formed from a composition of EPDM rubber, carbon black (as electroconductive particles), a vulcanizing agent and a foaming agent, followed by cutting and polishing for shape and surface adjustment to obtain a charging roller having a flexible foam urethane coating layer of 12 mm in outer diameter and 234 mm in length.

The thus-obtained charging roller (Charging member 2) exhibited a resistivity of $10^6$ ohm.cm and an Asker C hardness of 45 deg. with respect to the foam EPDM layer.

Production Example 3 for Charging Member

A charging roller (Charging member 3) was prepared in the same manner as in Production Example 2 except that the foam EPDM layer was replaced by a non-foam EPDM layer so as to provide an outer diameter of 12 mm and a length of 234 mm.

The thus-obtained charging roller exhibited a resistivity of $10^5$ ohm.cm and an Asker C hardness of 60 deg.

Production Example 4 for Charging Roller

About a SUS roller of 6 mm in diameter and 264 mm in length as a core metal, a tape of piled electroconductive nylon fiber was spirally wound to prepare a charging brush roller (Charging member 4). The electroconductive nylon fiber was formed from nylon in which carbon black was dispersed for resistivity adjustment and comprised yarns of 6 denier (composed of 50 filament of 30 denier). The nylon yarns in a length of 3 mm were planted at a density of $10^5$ yarns/in$^2$ to provide a brush roller exhibiting a resistivity of $1\times10^7$ ohm.cm.

Then, some examples of production or provision of toner particles, inorganic fine powder and electroconductive fine powder constituting developers are described, and further examples of production of developers from these components will be described.

Production Example 1 for Toner Particles 100 wt. parts of styrene-butyl acrylate-monobutyl maleate copolymer (peak molecular weight (Mp)=$3.5\times10^4$) (as a binder resin), 80 wt. parts of magnetite powder (or (saturation magnetization at a magnetic field of 795.8 kA/m)=85 Am$^2$/kg, or (residual magnetization)=6 Am$^2$/kg, Hc (coercive force)=5 kA/m) (magnetic powder), 2 wt. parts of monoazo iron complex (negative charge control agent) and 4 wt. parts of polypropylene (release agent) were blended by a blender, and the blend was melt-kneaded by an extruder heated at 130 deg. The kneaded product after cooling, was coarsely crushed and finely pulverized by a pulverizer using a jet air stream. The resultant pulverizate was strictly classified by a multi-division classifier utilizing the Coanda effect to obtain Magnetic toner particles 1 having a weight-average particle size (D4) of 7.9 $\mu$m as determined from a volume-basis distribution in the particle size range of 0.60–159.21 $\mu$m. Magnetic toner particles 1 exhibited a resistivity of $10^{14}$ ohm.cm or higher.

Production Examples 2–4 for Toner Particles 100 wt. parts of styrene-butyl acrylate-monobutyl maleate copolymer (Mp=$3.5\times10^4$, glass transition point (Tg)=65° C.) (binder resin), 90 wt. parts of magnetite powder ($\sigma$s=85 Am$^2$/kg, $\sigma$r=6 Am$^2$/kg, Hc=5 kA/m) (magnetic powder), 2 wt. parts of 3,5-di-t-butylsalicylic acid iron complex (negative charge control agent) and 3 wt. parts of maleic anhydride-modified polypropylene (release agent) were blended by a blender, and the blend was melt-kneaded by an extruder heated at 130° C. The kneaded product after cooling, was coarsely crushed, finely pulverized and classified by a multi-division classifier. A part of thus-prepared magnetic toner particles was taken as Magnetic toner particles 2, and the remainder thereof was subjected to sphering treatments by using an apparatus system shown in FIGS. 7 and 8 under different conditions shown in Table 2 described hereinafter to obtain Magnetic toner particles 3 and 4. Magnetic toner particles 2–4 thus-obtained exhibited D4=6.5–6.8 $\mu$m and a resistivity of $10^{14}$ ohm.cm or higher.

Production Examples 5 and 6 for Toner Particles

Non-magnetic toner particles 5 of D4=6.0 $\mu$m were prepared in the same manner as in Production Example 1 except for using 5 wt. parts of carbon black instead of the magnetic powder.

Further, Non-magnetic toner particles 6 of D4=5.9 $\mu$m were prepared in the same manner as in Production Example 5 except that a-mechanical pulverizer was used under pulverization conditions set to provide an increased circularity.

Non-magnetic toner particles 5 and 6 both exhibited resistivities of $10^{14}$ ohm.cm or higher.

Production Example 7 for Toner Particles

Non-magnetic toner particles 7 of D4=10 $\mu$m were prepared in the same manner as in Production Example 5 except for changing the pulverization and classification conditions. Non-magnetic toner particles exhibited a resistivity of $10^{14}$ ohm.cm.

Production Example 2 for Toner Particles

An aqueous dispersion medium was prepared by using materials at the following ratios. Thus, 451 wt. parts of 0.1M-$Na_3PO_4$ aqueous solution was added to 709 wt. parts of deionized water, the system was heated to 60° C., and 67.7 wt. parts of 1.0M-$CaCl_2$ aqueous solution was gradually added to the system under stirring to obtain an aqueous dispersion medium containing $Ca_3(PO_4)_2$.

| | |
|---|---|
| Styrene | 76 wt. part(s) |
| n-Butyl acrylate | 24 " |
| Divinylbenzene | 0.2 " |
| Unsaturated polyester resin (condensation product between biphenol A E.O. and P.O.-adduct and fumaric acid) | 3 " |
| Unsaturated polyester resin (condensation product between biphenol A E.O. and P.O. adduct and terephthalic acid) | 2 " |
| Negative charge control agent (monoazodye Fe compound) | 1 " |
| Surface-treated magenta material 1 ($\sigma$s = 82 Am$^2$/kg, or 7 Am$^2$/kg, Hc = 8 kA/m) | 80 " |

The above ingredients were uniformly mixed and dispersed to form a monomer composition. To the composition, 6 wt. parts of an ester wax principally comprising behenyl behenate ($T_{abs}$. (heat-absorption peaktop temperature on a DSC curve)=72° C.) was added to be dissolved therein, and further 5 wt. parts of 2,2'-azobis(2,4-dimethylvaleronitrile ($t_{1/2}$ (60° C.)=140 min) was added and dissolved therein.

The thus-formed polymerizable monomer composition was charged into the above-prepared aqueous dispersion medium, and the system was stirred by a TK-type homomixer (made by Tokushu Kika Kogyo K.K.) at 10,000 rpm for 15 min. at 60° C. in a nitrogen atmosphere, to form droplets of the monomer composition in the system. Then, the system was further stirred by a paddle stirrer, and under the stirring, the system was reacted at 60° C. for 6 hours. Then, the temperature was raised to 80 deg., and the system was further stirred for 4 hours. After the reaction, the system was further subjected to distillation at 80° C. for 2 hours, followed by cooling, addition of hydrochloric acid to dissolve the $Ca_3(PO_4)_2$, filtration, washing with water and drying to obtain Magnetic toner particles 8 of D4=6.5 $\mu$m, which exhibited a resistivity of $10^{14}$ ohm.cm.

Incidentally, Surface-treated magnetic material 1 contained in the above polymerizable monomer composition was prepared in the following manner.

Into a ferrous sulfate aqueous solution, a caustic soda solution in an amount of 1.0–1.1 equivalent of the iron ion was mixed to form an aqueous solution containing ferrous hydroxide. Then, while maintaining the aqueous solution at pH around 9, air was blown thereinto to cause an oxidation reaction at 80–90° C., to form a slurry liquid containing seed crystals.

Then, into the slurry liquid, a ferrous sulfate aqueous solution was added in an amount of 0.9–1.2 equivalent with respect to the initially added alkali (sodium in the caustic soda), and air was blown thereinto to proceed with the oxidation while maintaining the slurry at pH 8. Magnetic iron oxide particles thus formed after the oxidation were washed and filtrated to be once recovered. A small amount of water-containing sample thus-recovered was subjected to measurement of moisture content. Then, the water-containing sample, without drying, was again dispersed in another aqueous medium, and the pH thereof was adjusted to ca. 6. Under sufficient stirring, a silane coupling agent ($n\text{-}C_{10}H_{21}Si(OCH_3)_3$) in an amount of 1.0 wt. % of the magnetic iron oxide (obtained by subtracting the moisture content from the water-containing sample) was added to the dispersion to effect a coupling treatment. The thus-hydrophobized magnetic iron oxide particles were washed, filtrated and dried in ordinary manners, and the slightly agglomerated particles were disintegrated to obtain Surface-treated magnetic material 1.

The representative properties of the above-prepared Toner particles 1–8 are shown in Table 2 below.

TABLE 2

| | Toner particles | | | | | | |
|---|---|---|---|---|---|---|---|
| | Particle size distribution | | Circularity (a) distribution | | | | |
| | | N %* of | N % of | | Surface treatment condition | | |
| No. | D4 (μm) | 1–2 μm | a ≧ 0.90 | SD | Vs* (m/s) | Time | Tmax* (° C.) |
| 1 | 7.9 | 8.6 | 88.6 | 0.043 | | None | |
| 2 | 6.8 | 16.3 | 86.5 | 0.046 | | None | |
| 3 | 6.6 | 5.1 | 92.6 | 0.044 | 70 | 2 | 55 |
| 4 | 6.5 | 2.8 | 94.1 | 0.043 | 80 | 3 | 62 |
| 5 | 6.0 | 4.7 | 90.7 | 0.034 | | None | |
| 6 | 5.9 | 1.9 | 93.6 | 0.032 | | None | |
| 7 | 10.8 | 4.3 | 84.8 | 0.047 | | None | |
| 8 | 6.9 | 3.2 | 98.1 | 0.031 | | None | |

*N % represents % by number
Vs: Blade peripheral speed
Tmax: Maximum temperature in the apparatus.

Example 1 for Inorganic Fine Powder

Dry-process silica fine powder first treated with hexamethyldisilazane and then treated with dimethylsilicone oil was represented as Inorganic powder A-1, which exhibited a number-average primary particle size (Dp1)=12 nm an a BET specific surface area ($S_{BET}$)=300 $m^2/g$.

Example 2 for Inorganic Fine Powder

Dry process silica fine powder not subjected to hydrophobization was represented as Inorganic powder A-2, which exhibited Dp1=10 nm and $S_{BET}$=300 $m^2/g$.

Example 3 for Inorganic Fine Powder

Dry-process silica fine powder treated with hexamethyldisilazane was represented as Inorganic powder A-3, which exhibited Dp1=16 nm, and $S_{BET}$=170 $m^2/g$.

Example 4 for Inorganic Fine Powder

Titanium dioxide fine powder treated with hexamethyldisilazane was represented as Inorganic powder A-4, which exhibited Dp1=30 nm and $S_{BET}$=60 $m^2/g$.

Representative properties of Inorganic powders A-1 to A-4 are summarized in Table 3.

TABLE 3

| | Inorganic fine powder | | | |
|---|---|---|---|---|
| No. | Material | Dpl (nm) | $S_{BET}$ ($m^2/g$) | Treatment* |
| A-1 | silica | 12 | 120 | HDMS + silicone oil |
| A-2 | silica | 10 | 300 | none |
| A-3 | silica | 16 | 170 | HDMS |
| A-4 | titania | 30 | 60 | HDMS |

*HDMS = hexamethyldisilazane

Example 1 for Electroconductive Fine Powder

Barium sulfate powder of ca. 0.1 μm in particle size coated with 50 wt. % thereof of tin oxide was represented as Conductive powder B-1, which was white in color and exhibited a resistivity of $2.7\times10^4$ ohm.cm according to the tablet method. Further, the powder B-1 exhibited a transmittance at 740 nm ($T_{740}$) of ca. 35% as measured by using a light source of 740 nm and a transmission densitometer ("310T", made by X-Rite K.K.). The wavelength of 740 nm was identical to the wavelength of laser beam emitted by a laser beam scanner for imagewise exposure in an image forming apparatus used in Examples described hereinafter. The powder B-1 also exhibited a particle size distribution as measured by a laser diffraction-type particle size distribution meter ("LS-230", available from Coulter Electronics Inc.) including 10%-diameter (D10)=0.18 μm, 50%-diameter (D50)=0.50 μm and 90%-diameter (D90)=1.66 μm based on volume-basis distribution.

Examples 2–4 for Electroconductive Fine Powder

Barium sulfate powders having different particle sizes of 0.3 μm, 0.5 μm and 1.2 μm, respectively, coated with corresponding amounts of tin oxide (of which the amount was changed so as to provide an identical coating rate per unit area of barium sulfate particles) were represented as Conductive powders B-2 to B-4, respectively. The resistivities, D10, D50 and D90 values of the powders B-2 to B-4 are inclusively shown in Table 4 together with those of Example 1 and the following Examples for electroconductive fine powders.

Example 5 for Electroconductive Fine Powder

Barium sulfate powder of ca. 0.1 μm in particle size coated with 50 wt. % thereof of antimony-doped tin oxide instead of tin oxide (of Example 1) was represented as Conductive powder B-5, which was gray in color and a transmittance ($T_{740}$)=20% or below.

Example 6 for Electroconductive Fine Powder

Barium sulfate powder of ca. 1.2 μm in particle size coated with antimony-doped tin oxide instead of tin oxide (of Example 4) was represented as Conductive powder B-6, which was gray in color and a transmittance ($T_{740}$)=20% or below.

Examples 7 and 8 for Electroconductive Fine Powder

Aluminum borate powder of ca. 2 μm in particle size coated with tin oxide was subjected to pneumatic classification for removal of coarse particles, and dispersed in aqueous dispersion medium for repetitive filtration for removal of fine particles to obtain Conductive powder B-7 which was grayish white in color and exhibited a volume resistivity of $4.3\times10^4$ ohm.cm.

Conductive powder B-8 was obtained in a similar manner as B-7 except for using aluminum borate powder coated with antimony-doped tin oxide instead of tin oxide (B-7). The powder B-8 exhibited a transmittance ($T_{740}$) of 20% or below.

Some representative characteristics of the above-prepared Conductive powders B-1 to B-8 are inclusively shown in Table 4 below.

TABLE 4

| | Electroconductive fine powder | | | | | |
|---|---|---|---|---|---|---|
| | Base | Volume-basis distribution | | | Resistivity | $T_{740}$ |
| | material | D10 (μm) | D50 (μm) | D90 (μm) | (ohm·cm) | (%) |
| B-1 | Ba sulfate | 0.18 | 0.50 | 1.66 | $2.7\times10^4$ | 35 |
| B-2 | Ba sulfate | 0.20 | 0.56 | 1.26 | $1.5\times10^5$ | 35 |
| B-3 | Ba sulfate | 0.45 | 1.15 | 2.67 | $3.5\times10^4$ | 30 |
| B-4 | Ba sulfate | 0.52 | 1.33 | 2.73 | $7.5\times10^4$ | 30 |
| B-5 | Ba sulfate | 0.12 | 0.35 | 0.97 | 130 | — |
| B-6 | Ba sulfate | 0.54 | 1.38 | 2.68 | 230 | — |
| B-7 | Al borate | 0.91 | 2.43 | 3.55 | $4.3\times10^4$ | 25 |
| B-8 | Al borate | 0.90 | 2.68 | 4.58 | 510 | — |

EXAMPLE 1

Production Example 1 for Developer 100 wt. parts of Magnetic toner particles 1 (obtained in Production Example 1 for toner particles) was uniformly blended with 1.23 wt. parts of Inorganic powder A-1 and 1.03 wt. parts of Conductive powder B-4 by means of a Henschel mixer to obtain Developer 1. As shown in Table 5 described hereinafter, Developer 1 thus obtained was a magnetic developer (magnetic toner) containing 1.2 wt. % of inorganic fine powder and 1.0 wt. % of electroconductive fine powder.

Developer 1 (magnetic toner) was subjected to measurement of number-basis particle size distribution and circularity distribution in the particle size range of 0.60–159.21 μm by using a flow-type particle image analyzer ("FPIA-1000", made by Toa Iyou Denshi K.K.) in a manner as described hereinbelow. More specifically, into a hard glass-made threaded mouth-bottle of 30 mm in inner diameter and 65 mm in height (e.g., a 30 ml-threaded mouth-bottle "SV-30", available from Nichiden Rika Garasu K.K.), 10 ml of water from which minute dirt had been removed by filtering (preferably down to a level of at most 20 particles/μl in a $D_{CE}$ range of 0.60–159.21 μm) and several drops of a dilute surfactant solution (preferably one obtained by diluting alkylbenzene-sulfonic acid salt with minute dirt-removed water into ca. 10 times) were placed. Into the bottom, an appropriate amount (e.g., 0.5–20 mg) of a sample providing a concentration of 7000–10000 particles/10 μl with respect to particles in the measured $D_{CE}$ range was added, and the mixture was subjected to 3 min. of dispersion treatment by means of an ultrasonic homogenizer (e.g., "ULTRASONIC HOMOGENIZER UH-50" equipped with a 6 mm-dia. step-shaped chip (available from K.K. SMT) at a power control volume scale of 7 giving nearly a half of the maximum power given by the chip). The resultant dispersion liquid was subjected to measurement of particle size distribution and circularity distribution in the $D_{CE}$ range of 0.60–159.21 μm.

From the obtained particle size distribution, the contents (% by number, expressed as N %) of particles in the ranges of 1.00–2.00 μm, 2.00–3.00 μm, 3.00–8.96 μm and 8.96 μm or larger, and a variation coefficient (Kn) of number-basis distribution were obtained. Further, from the obtained circularity (a) distribution, the content (N %) of particles of $a\geqq0.90$ and a standard deviation (SDa) of circularity were obtained.

Further, the number ($N_{EP}$) of electroconductive fine powder particles of 0.6–3 μm per 100 toner particles in Developer 1 was measured from SEM pictures in the manner described hereinbefore. As a result, Developer 1 was found to contain 15 particles of such electroconductive fine powder attached to or isolated from the toner particle ($N_{EP}$=15).

Developer 1 further exhibited a triboelectric chargeability (TC, or Charge) of −39.6 mC/kg with respect to spherical iron powder of 100 mesh-pass and 200 mesh-on.

These properties of Developer 1 are inclusively shown in Table 5 appearing hereinafter together with those of Developers prepared in the following Examples.

Developer 1 further exhibited a magnetization of 25 $Am^2/kg$ measured at 25° C. and an external magnetic field of 79.6 kA/m.

EXAMPLE 2

Production Example 2 for Developer

Figure 9A:
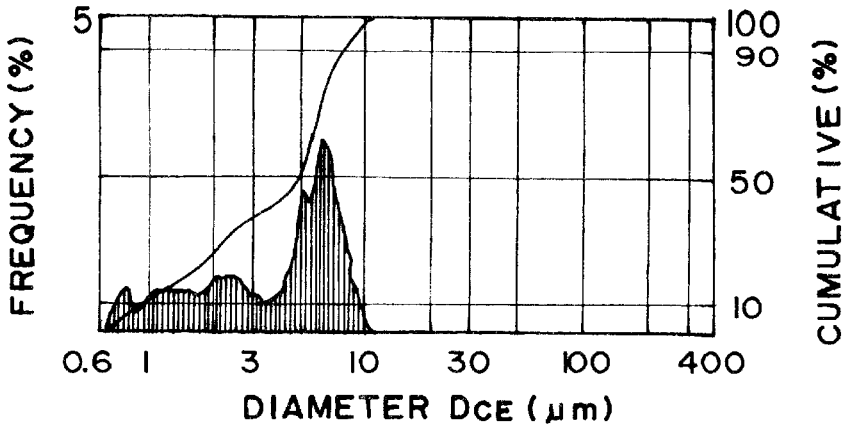
FIGS. 9A–9F are graphs each showing a number-basis particle size distribution of a developer of an Example or a Comparative Example in a range of 0.60–159.21 μm measured according to a flow-type particle image analyzer.
Figure 9B:
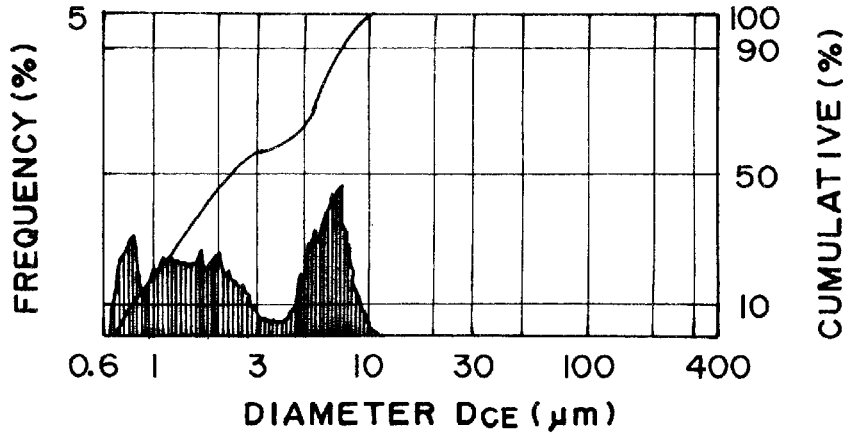

Developer 2 (magnetic toner) was prepared in the same manner as in Example 1 except that the content of Conductive powder B-4 was changed to 2.0 wt. %. Developer 2 exhibited a number-basis particle size distribution as shown in FIG. 9B in the range of 0.60–159.21 μm.

EXAMPLE 3 AND 4

Production Examples 3 and 4 for Developer

Developers 3 and 4 (magnetic toners) were prepared in the same manner as in Example 1 except that the contents of Conductive powder B-4 were changed to 5.0 wt. % and 9.0 wt. %, respectively.

Comparative Example 1

Production Example 5 for Developer

Developer 5 (magnetic toner) was prepared in the same manner as in Example 1 except that the content of Conductive powder B-4 was changed to 15.0 wt. %.

EXAMPLE 5

Production Example 6 for Developer

Figure 9C:
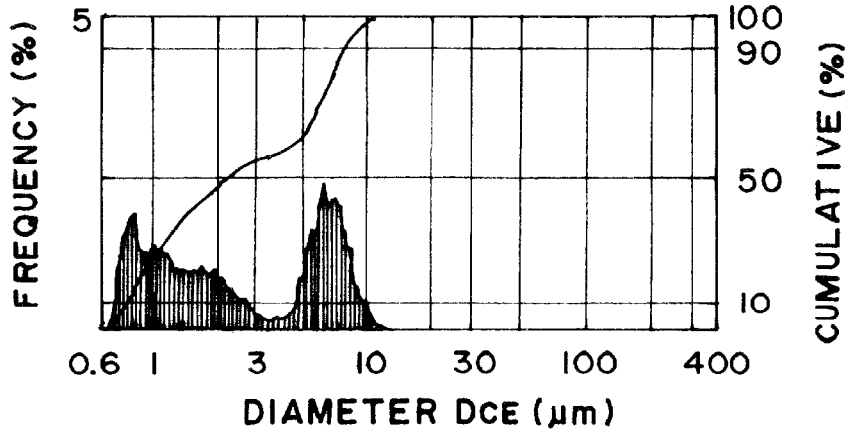

Developer 6 (magnetic toner) was prepared in the same manner as in Example 1 except that 2.0 wt. % of Conductive powder B-3 was used instead of Conductive powder B-4. Developer 6 exhibited a number-basis particle size distribution as shown in FIG. 9C in the range of 0.60–159.21 μm.

COMPARATIVE EXAMPLE 2

Production Example 7 for Developer

Developer 7 (magnetic toner) was prepared in the same manner as in Example 1 except that 1.0 wt. % of Conductive powder B-2 was used instead of Conductive powder B-4.

EXAMPLES 6 AND 7

Production Examples 8 and 9 for Developer

Figure 9D:
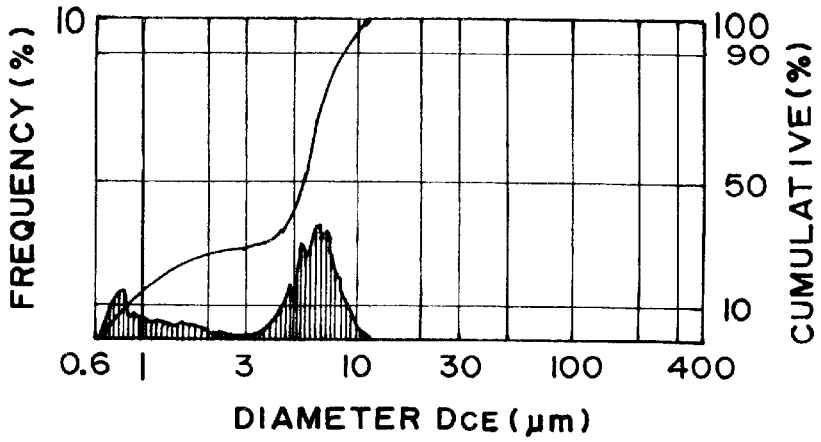

Developers 8 and 9 (magnetic toners) were prepared in the same manner as in Comparative Example 2 except that the contents of Conductive powder B-2 were changed to 2.0 wt. % and 5.0 wt. %, respectively. Developer 8 exhibited a number-basis particle size distribution as shown in FIG. 9D in the range of 0.60–159.21 μm.

Comparative Examples 3 and 4

Production Examples 10 and 11 for Developer

Figure 9E:
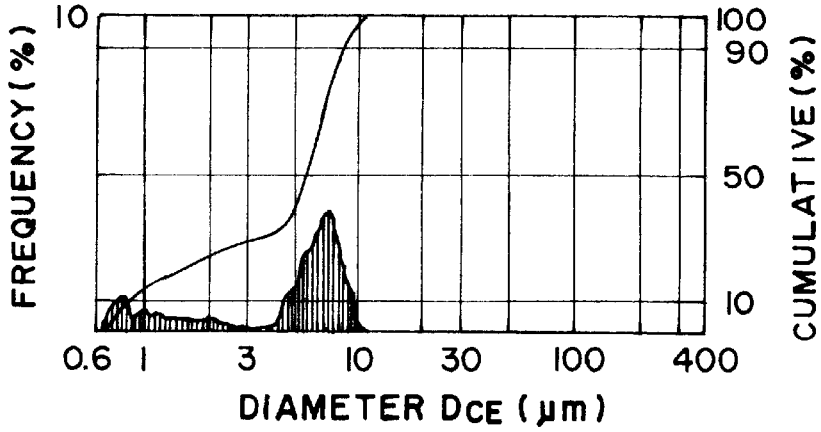

Developers 10 and 11 (magnetic toners) were prepared in the same manner as in Example 1 except for using 2.0 wt. % and 5.0 wt. %, respectively, of Conductive powder B-1 instead of Conductive powder B-4. Developer 10 exhibited a number-basis particle size distribution as shown in FIG. 9E in the range of 0.60–159.21 μm.

Comparative Example 5

Production Example 12 for Developer

Developer 12 (magnetic toner) was prepared in the same manner as in Example 1 except that 2.0 wt. % of Conductive powder B-5 was used instead of Conductive powder B-4.

EXAMPLE 8

Production Example 13 for Developer

Developer 13 (magnetic toner) was prepared in the same manner as in Example 1 except that 5.0 wt. % of Conductive powder B-6 was used instead of Conductive powder B-4.

EXAMPLES 9 TO 11

Production Examples 14–16 for Developer

Developers 14–16 (magnetic toners) were prepared in the same manner as in Example 1 except that 1.0 wt. %, 2.0 wt. % and 5.0 wt. %, respectively, of Conductive powder B-7 was used instead of Conductive powder B-4. Developer 15 exhibited a number-basis particle size distribution as shown in FIG. 9A in the range of 0.60–159.21 μm.

EXAMPLE 12

Production Example 17 for Developer

Developer 17 (magnetic toner) was prepared in the same manner as in Example 1 except that 2.0 wt. % of Conductive powder B-8 was used instead of Conductive powder B-4.

Comparative Example 6

Production Example 18 for Developer

Figure 9F:
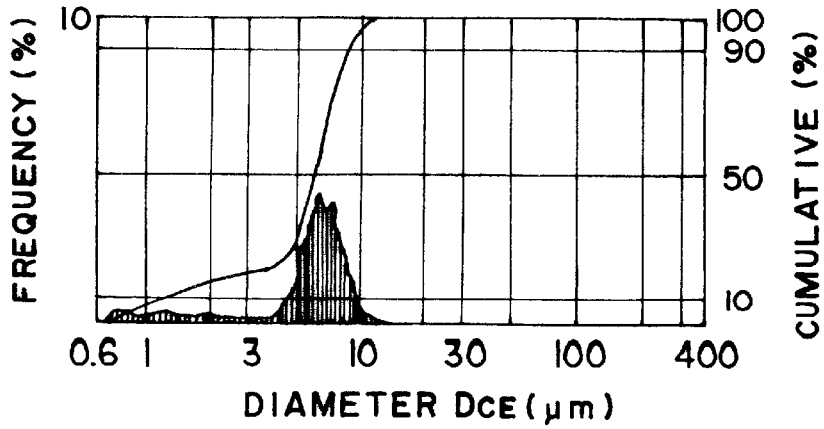

Developer 18 (magnetic toner was prepared in the same manner as in Example 1 except that Conductive powder B-4 was omitted. Developer 18 exhibited a number-basis particle size distribution as shown in FIG. 9F in the range of 0.60–159.21 μm.

EXAMPLES 16 AND 18

Production Examples 22–24 for Developer

Developers 22–24 (magnetic toners) were prepared in the same manner as in Example 1 except that Toner particles 2–4, respectively, were used instead of Toner particles 1. Developers 22–24 all exhibited magnetizations in the range of 26–28 $Am^2/kg$ at a magnetic field of 79.6 kA/m.

EXAMPLES 19 AND 20

Production Examples 25 and 26 for Developer

Developers 25 and 26 (non-magnetic toners) were prepared in the same manner as in Example 1 except that 1.0 wt. % of Inorganic powder A-4 was used instead of Inorganic powder A-1, the content of Conductive powder B-4 was changed to 3.0 wt. %, and Toner particles 5 and 6 (non-magnetic), respectively, were used instead of Toner particles 1 (magnetic).

EXAMPLE 21

Production Example 27 for Developer

Developer 27 (non-magnetic toner) was prepared in the same manner as in Example 1 except that 1.0 wt. % of Inorganic powder A-4 was used instead of Inorganic powder A-1, the content of Conductive powder was changed to 3.0 wt. %, and Toner particles 7 (non-magnetic) was used instead of Toner particles (magnetic).

EXAMPLE 22

Production Example 28 for Developer

Developer 28 (magnetic toner) was prepared in the same manner as in Example 1 except that the content of Inorganic powder A-1 was changed to 0.9 wt. %, the content of Conductive powder B-4 was changed to 3.0 wt. %, and Toner particles 8 (magnetic) were used instead of Toner particles 1.

Representative organizations and properties of Developers 1–28 are inclusively shown in Table 5 below.

TABLE 5

| | Developers | | | | | | | | | | | | | | | |
|---|---|---|---|---|---|---|---|---|---|---|---|---|---|---|---|---|
| | Production Example | | Inorganic powder | | Conductive powder | | Number-basis particle size distribution | | | | | Circularity (a) | | Conductive | Charge |
| Example | Developer | toner | | wt. % | | wt. % | N % of 1–2 μm | N % of 2–3 μm | N % of 3–8.96 μm | N % of ≧8.96 μm | Kn | N % of a ≧ 0.90 | SD | powder* | μC/g |
| Ex. 1 | 1 | 1 | A-1 | 1.2 | B-4 | 1 | 19.8 | 7.2 | 54.5 | 4.4 | 22.2 | 91.9 | 0.042 | 15 | −39.6 |
| Ex. 2 | 2 | 1 | A-1 | 1.2 | B-4 | 2 | 28.0 | 11.6 | 40.8 | 3.0 | 21.4 | 91.7 | 0.043 | 32 | −34.9 |
| Ex. 3 | 3 | 1 | A-1 | 1.2 | B-4 | 5 | 36.5 | 14.2 | 23.1 | 1.6 | 22.3 | 91.3 | 0.045 | 68 | −27.4 |
| Ex. 4 | 4 | 1 | A-1 | 1.2 | B-4 | 9 | 42.2 | 15.5 | 15.5 | 0.8 | 23.0 | 90.6 | 0.045 | 98 | −20.3 |
| Comp. 1 | 5 | 1 | A-1 | 1.2 | B-4 | 15 | 44.1 | 15.5 | 12.8 | 0.5 | 22.7 | 89.4 | 0.048 | 112 | −14.1 |
| Ex. 5 | 6 | 1 | A-1 | 1.2 | B-3 | 2 | 25.6 | 8.8 | 40.6 | 4.2 | 22.5 | 92.0 | 0.043 | 30 | −32.6 |
| Comp. 2 | 7 | 1 | A-1 | 1.2 | B-2 | 1 | 7.8 | 2.1 | 72.6 | 5.9 | 22.0 | 92.1 | 0.041 | 2 | −35.1 |
| Ex. 6 | 8 | 1 | A-1 | 1.2 | B-2 | 2 | 15.2 | 3.6 | 58.6 | 5.2 | 22.4 | 92.2 | 0.042 | 12 | −29.6 |
| Ex. 7 | 9 | 1 | A-1 | 1.2 | B-2 | 5 | 15.7 | 2.7 | 48.3 | 4.2 | 21.8 | 91.8 | 0.042 | 21 | −11.1 |
| Comp. 3 | 10 | 1 | A-1 | 1.2 | B-1 | 2 | 12.2 | 3.8 | 65.8 | 5.9 | 21.8 | 92.0 | 0.041 | 6 | −26.6 |
| Comp. 4 | 11 | 1 | A-1 | 1.2 | B-1 | 5 | 13.8 | 3.4 | 65.0 | 5.3 | 22.0 | 92.2 | 0.041 | 6 | −3.5 |
| Comp. 5 | 12 | 1 | A-1 | 1.2 | B-5 | 2 | 9.2 | 2.8 | 71.0 | 5.8 | 21.9 | 92.2 | 0.042 | 3 | −25.2 |
| Ex. 8 | 13 | 1 | A-1 | 1.2 | B-6 | 5 | 37.3 | 14.9 | 22.9 | 1.4 | 22.1 | 91.2 | 0.043 | 70 | −26.5 |
| Ex. 9 | 14 | 1 | A-1 | 1.2 | B-7 | 1 | 15.2 | 11.3 | 62.4 | 5.1 | 21.9 | 91.5 | 0.042 | 9 | −40.4 |
| Ex. 10 | 15 | 1 | A-1 | 1.2 | B-7 | 2 | 15.9 | 12.1 | 59.3 | 4.6 | 22.7 | 90.9 | 0.044 | 11 | −39.8 |
| Ex. 11 | 16 | 1 | A-1 | 1.2 | B-7 | 5 | 22.8 | 17.3 | 47.2 | 3.4 | 22.9 | 90.3 | 0.045 | 23 | −35.5 |
| Ex. 12 | 17 | 1 | A-1 | 1.2 | B-8 | 2 | 15.4 | 16.1 | 58.7 | 5.5 | 22.5 | 90.7 | 0.043 | 11 | −38.7 |
| Comp. 6 | 18 | 1 | A-1 | 1.2 | — | — | 8.6 | 2.9 | 74.7 | 7.8 | 22.0 | 92.2 | 0.041 | 0 | −45.7 |
| Ex. 13 | 19 | 1 | A-2 | 1.2 | B-4 | 2 | 27.3 | 12.0 | 41.5 | 2.8 | 22.0 | 92.0 | 0.041 | 31 | −35.9 |
| Ex. 14 | 20 | 1 | A-3 | 1.2 | B-4 | 2 | 27.8 | 11.9 | 40.5 | 3.3 | 21.8 | 92.0 | 0.040 | 32 | −33.3 |
| Ex. 15 | 21 | 1 | A-4 | 1.2 | B-4 | 2 | 30.7 | 11.0 | 39.2 | 3.4 | 22.4 | 91.5 | 0.043 | 33 | −24.6 |
| Ex. 16 | 22 | 2 | A-1 | 1.2 | B-4 | 2 | 27.1 | 6.8 | 48.6 | 1.9 | 25.7 | 94.6 | 0.034 | 8 | −41.8 |
| Ex. 17 | 23 | 3 | A-1 | 1.2 | B-4 | 2 | 19.5 | 6.2 | 51.6 | 3.0 | 26.2 | 96.5 | 0.031 | 24 | −44.6 |
| Ex. 18 | 24 | 4 | A-1 | 1.0 | B-4 | 2 | 18.6 | 5.9 | 52.3 | 3.2 | 26.4 | 97.3 | 0.028 | 30 | −45.0 |
| Ex. 19 | 25 | 5 | A-4 | 1.0 | B-4 | 3 | 20.4 | 5.4 | 54.9 | 2.7 | 23.5 | 96.0 | 0.038 | 23 | −55.1 |
| Ex. 20 | 26 | 6 | A-4 | 1.0 | B-4 | 3 | 18.1 | 5.1 | 56.4 | 1.3 | 22.8 | 96.9 | 0.030 | 30 | −58.5 |
| Ex. 21 | 27 | 7 | A-4 | 1.0 | B-4 | 3 | 32.3 | 12.7 | 21.8 | 23.5 | 38.1 | 87.1 | 0.053 | 41 | −27.2 |
| Ex. 22 | 28 | 8 | A-1 | 0.9 | B-4 | 3 | 33.0 | 7.5 | 43.5 | 0.2 | 38.1 | 87.1 | 0.053 | 41 | −38.7 |

*Number of conductive powder particles of 0.5–3 μm/100 toner particles

EXAMPLE 23A

Image Formation by Using Developer 1 and Charging Member 1

FIG. 1 illustrates an organization of an example of image forming apparatus suitable for practicing the image forming method of the present invention. The image forming apparatus is a laser beam printer (recording apparatus) according to a transfer-type electrophotographic process and including a developing-cleaning system (cleanerless system). The apparatus includes a process-cartridge from which a cleaning unit having a cleaning member, such as a cleaning blade, has been removed. The apparatus uses a magnetic mono-component type developer (magnetic toner) and a non-contact developing system wherein a developer-carrying member is disposed so that a developer layer carried thereon is in no contact with an image-bearing member for development.

(1) Overall Organization of an Image Forming Apparatus

Referring to FIG. 1, the image forming apparatus includes a rotating drum-type OPC photosensitive member 1 (Photosensitive member 1 produced in Production Example 1) (as an image-bearing member), which is driven for rotation in an indicated arrow direction (clockwise) at a peripheral speed (process speed) of 94 mm/sec.

A charging roller 2 (Charging member 1 produced in Production Example 1) (as a contact charging member) is abutted against the photosensitive member 1 at a prescribed pressing force in resistance to its elasticity. Between the photosensitive member 1 and the charging roller 2, a contact nip n is formed as a charging section. In this example, the charging roller 2 is rotated to exhibit a peripheral speed of 141 mm/sec (corr. to a relative movement speed ratio of 250%) in an opposite direction (with respect to the surface movement direction of the photosensitive member 1) at the charging section n. Prior to the actual operation, Conductive powder B-4 (produced in Production Example 4) is applied on the charging roller 2 surface at a rate of forming nearly densest mono-particle layer.

The charging roller 2 has a core metal to which a DC voltage of −700 volts is applied from a charging bias voltage supply S1. As a result, the photosensitive member 1 surface is uniformly charged at a potential (−680 volts) almost equal to the voltage applied to the charging roller 2 in this Example. This is described later again.

The apparatus also includes a laser beam scanner 3 (exposure means) including a laser diode, a polygonal mirror, etc. The laser beam scanner outputs laser light (wavelength=740 nm) with intensity modified corresponding to a time-serial electrical digital image signal, so as to scanningly expose the uniform charged surface of the photosensitive member 1. By the scanning exposure, an electrostatic latent image corresponding to the objective image data is formed on the rotating photosensitive member 1.

The apparatus further includes a developing device 4, by which the electrostatic latent image on the photosensitive member 1 surface is developed to form a toner image thereon. The developing device 4 is a non-contact-type reversal development apparatus including a negatively chargeable mono-component insulating developer (Developer 1 of Production Example 1). As mentioned above, Developer 1 includes Toner particles 1 (magnetic) and Conductive powder B-4 externally added thereto.

The developing device 4 further includes a 16 mm-dia. non-magnetic developing sleeve 4*a* (as a developer-carrying member) enclosing a magnet roller 4*b*. The developing sleeve 4*a* is disposed oppositely to and with a spacing of 300 μm from the photosensitive member 1 to form a developing region a where the developing sleeve is rotated to show a peripheral speed of 113 mm/sec which is 120% of the surface moving speed of the photosensitive member 1 moving in an identical direction.

Developer 1 is applied as a thin coating layer on the developing sleeve 4*a* by means of an elastic blade 4*c* while also be charged thereby. In the actual operation, Developer 1 was applied at a rate of 18 g/m$^2$ on the develop sleeve 4*a*.

Developer 1 applied as a coating on the developing sleeve 4*a* is conveyed along with the rotation of the sleeve 4*a* to the developing section a where the photosensitive member 1 and the sleeve 4*a* are opposite to each other. The sleeve 4*a* is further supplied with a developing bias voltage from a developing bias voltage supply. In operation, the developing bias voltage was a superposition of DC voltage of −420 volts and a rectangular AC voltage of a frequency of 1600 Hz and a peak-to-peak voltage of 1500 volts (providing an electric field strength of $5\times10^6$ volts/m) to effect mono-component jumping development between the developing sleeve 4*a* and the photosensitive member 1.

The apparatus further includes a medium-resistivity transfer roller 5 (as a contact transfer means), which is abutted at a linear pressure of 98 N/m against the photosensitive member 1 to form a transfer nip b. To the transfer nip b, a transfer material P as a recording medium is supplied from a paper supply section (not shown), and a prescribed transfer bias voltage is applied to the transfer roller 5 from a voltage supply S3, whereby toner images on the photosensitive member 1 are successively transferred onto the surface of the transfer material P supplied to the transfer nip b.

In this Example, the transfer roller 5 had a resistivity of $5\times10^8$ ohm.cm and supplied with a DC voltage of +300 volts to perform the transfer. Thus, the transfer material P introduced to the transfer nip b is nipped and conveyed through the transfer P, and on its surface, the toner images on the photosensitive member 1 surface are successively transferred under the action of an electrostatic force and a pressing force.

A fixing device 5 of, e.g., the heat fixing type is also included. The transfer material P having received a toner image from the photosensitive member 1 at the transfer nip b is separated from the photosensitive member 1 surface and introduced into the fixing device 6, where the toner image is fixed to provide an image product (print or copy) to be discharged out of the apparatus.

In the image forming apparatus used in this Example, the cleaning unit has been removed, transfer-residual toner particles remaining on the photosensitive member 1 surface after the transfer of the toner image onto the transfer material P are not removed by such a cleaning means but, along with the rotation of the photosensitive member 1, sent via the charging section n to reach the developing section a, where they are subjected to a developing-cleaning operation to be recovered.

In the image forming apparatus of this Example, three process units, i.e., the photosensitive member 1, the charging roller 2 and the developing device 4 are inclusively supported to form a process-cartridge 7, which is detachably mountable to a main assembly of the image forming apparatus via a guide and support member 8. A process-cartridge may be composed of other combinations of devices.

(2) Behavior of Electroconductive Fine Powder

Electroconductive fine powder m (Conductive powder B-4 in this Example) mixed in the developer 4*d* (Developer 1 in this Example) is moved together with toner particles t also in the developer 4*d* and transferred in an appropriate amount to the photosensitive member 1 at the time of developing operation of the developing device 4.

The toner image (composed of toner particles) on the photosensitive member 1 is positively transferred onto the transfer material P (recording medium) under an influence of a transfer bias voltage at the transfer section b. However, because of its electroconductivity, the electroconductive fine powder m on the photosensitive member 1 is not positively transferred to the transfer material P but substantially remains in attachment onto the photosensitive member 1.

As no cleaning unit is involved in the image forming apparatus of this Example, the transfer-residual toner particles and the electroconductive fine powder remaining on the photosensitive member 1 after the transfer step are, along with the rotation of the photosensitive member 1, brought to the charging section n formed at the contact part between the photosensitive member 1 and the charging roller 2 (contact charging member) to be attached to and mixed with the charging roller 2. As a result, the photosensitive member is charged by direct charge injection in the presence of the electroconductive fine powder m at the contact part n between the photosensitive member 1 and the charging roller 2.

By the presence of the electroconductive fine powder m, the intimate contact and low contact resistivity between the charging roller 2 and the photosensitive member 1 can be maintained even when the transfer-residual toner particles are attached to the charging roller 2, thereby allowing the direct injection charging of the photosensitive member 1 by the charging roller 2.

More specifically, the charging roller 2 intimately contacts the photosensitive member 1 via the electroconductive fine powder m, and the electroconductive fine powder m rubbs the photosensitive member 1 surface without discontinuity. As a result, the charging of the photosensitive member 1 by the charging roller 2 is performed not relying on the discharge charging mechanism but predominantly relying on the stable and safe direct injection charging mechanism, to realize a high charging efficiency that has not been realized by conventional roller charging. As a result, a potential almost identical to the voltage applied to the charging roller 2 can be imparted to the photosensitive member 1.

The transfer-residual toner attached to the charging roller 2 is gradually discharged or released from the charging roller 2 to the photosensitive member 1, and along with the movement of the photosensitive member 1, reaches the developing section a where the toner particles are recovered to the developing device 4 in the developing-cleaning operation.

The developing-cleaning step is a step of recovering the toner particles remaining on the photosensitive member 1 remaining on the photosensitive member 1 after the transfer step at the time of developing operation in a subsequent cycle of image formation (developing of a latent image formed by re-charging and exposure after a previous image forming cycle operation having resulted in the transfer-residual toner particles) under the action of a fog-removing bias voltage of the developing device (Vback, i.e., a difference between a DC voltage applied to the developing device and a surface potential on the photosensitive member). In an image forming apparatus adopting a reversal development scheme adopted in this Example, the developing-cleaning operation is effected under the action of an electric field of recovering toner particles from a dark-potential part on the photosensitive member and an electric field of attaching toner particles from the developing sleeve and a light-potential part on the photosensitive member, respectively, exerted by the developing bias voltage.

As the image-forming apparatus is operated, the electroconductive fine powder m contained in the developer in the developing device 4 is transferred to the photosensitive member surface 1 at the developing section a, and moved via the transfer section to the charging section n along with the movement of the photosensitive member 1 surface, whereby the charging section n is successively supplied with fresh electroconductive fine powder. As a result, even when the electroconductive fine powder m is reduced by falling, etc., or the electroconductive fine powder m at the charging section is deteriorated, the chargeability of the photosensitive member 1 at the charging section is prevented from being lowered and good chargeability of the photosensitive member 1 is stably retained.

In this way, in the image forming apparatus including a contact charging scheme, a transfer scheme and a toner recycle scheme, the photosensitive member 1 (as an image-bearing member) can be uniformly charged at a low application voltage by using a simple charging roller 2. Further, the direct injection charging of the ozonless-type can be stably retained to exhibit uniform charging performance even though the charging roller 2 is soiled with transfer-residual toner particles. As a result, it is possible to provide an inexpensive image forming apparatus of a sample structure free from difficulties, such as generation of ozone products and charging failure.

As mentioned above, it is necessary for the electroconductive fine powder to have a resistivity of at most $1\times10^9$ ohm.cm. At a higher resistivity, the charge injection cannot be sufficiently effected even when the charging roller 2 intimately contacts the photosensitive member 1 via the electroconductive fine powder, and the electroconductive fine powder rubs the photosensitive member 1 surface, so that it becomes difficult to charge the photosensitive member 1 to a desired potential.

In a developing device wherein a developer directly contacts a photosensitive member, charges are injected to the photosensitive member via the electroconductive fine powder in the developer at the developing section a under the application of a developing bias voltage. However, a non-contact developing device is used in this embodiment, so that good images can be formed without causing charge injection to the photosensitive member by the developing bias voltage. Further, as the charge injection to the photosensitive member is not caused at the developing section, it is possible to provide a high potential difference between the sleeve 4*a* and the photosensitive member 1 as by application of an AC bias voltage. As a result, it becomes possible to uniformly apply the electroconductive fine powder onto the photosensitive member 1 surface to achieve uniform contact at the charging section to effect the uniform charging, thereby obtaining good image.

Owing to the lubricating effect (friction-reducing effect) of the electroconductive fine powder present at the contact part between the charging roller 2 and the photosensitive member 1, it becomes possible to easily and effectively provides a speed difference between the charging roller 2 and the photosensitive member 1. Owing to the lubricating effect, the friction between the charging roller 2 and the photosensitive member 1 is reduced, the drive torque is reduced, and the surface abrasion or damage of the charging roller 2 and the photosensitive member 1 can be reduced. As a result of the speed difference, it becomes possible to remarkably increase the opportunity of the electroconductive fine powder contacting the photosensitive member 1 at the contact part (charging section) n between the charging roller 2 and the photosensitive member 1, thereby allowing good direct injection charging.

In this embodiment, the charging roller 2 is driven in rotation to provide a surface moving direction which is opposite to that of the photosensitive member 1 surface at the charging section n, whereby the transfer-residual toner particles on the photosensitive member 1 brought to the charging section n are once recovered by the charging roller 2 to level the density of the transfer-residual toner particles present at the charging section n. As a result, it becomes possible to prevent charging failure due to localization of the transfer-residual toner particles at the charging section n, thereby achieving stabler charging performance.

Further, by rotating the charging roller 2 in a reverse direction, the charging is performed in a state where the transfer-residual toner particles are once released from the photosensitive member 1 thus allowing direct injection charging in an advantageous manner. Further, the lowering in charging performance due to excessive falling of the electroconductive fine powder from the charging roller 2 is prevented.

(3) Evaluation

In this Example, Developer 1 containing 19.6% by number of particles of 1.00–2.00 $\mu$m based on a number-basis distribution in the particle size range of 0.60–159.21 $\mu$m was used. More specifically, 120 g of Developer 1 was placed in a toner cartridge and used for a continuous print of 5%-coverage images on 3500 sheets of A4-copying paper of 90 g/m$^2$ until the developer was reduced to a small amount. As a result, it was possible to attain images with a high image density and free from fog both at the initial stage and after the continuous printing on 3500 sheets. During the continuous printing, the lowering in developing performance was not observed.

After the continuous printing on 3500 sheets, the portion of the charging roller 2 corresponding to the contact part n with the photosensitive member 1 was inspected, whereby the charging roller was almost uniformly coated with white powder of Conductor powder B-4 while a slight amount of transfer residual toner particles were recognized.

Further, presumably because Conductive powder B-4 having a sufficiently low resistivity was continually present at the contact part n between the photosensitive member 1 and the charging roller 2, image defects attributable to charging failure was not observed from the initial stage until after the continuous printing on 3500 sheets, thus showing good direct injection charging performance.

Further, Photosensitive member 1 (produced in Production Example 1) having the surfacemost layer exhibiting a volume resistivity of $5\times10^{12}$ ohm.cm, character images were formed with a sharp contour exhibiting the maintenance of an electrostatic latent image and a sufficient chargeability even after the continuous printing on 3500 sheets. The photosensitive member exhibited a potential of −690 volts in response to direct charging at an applied voltage of −700 volts after the continuous printing on 3500 sheets, thus showing no lowering in chargeability and no lowering in image quality due to lower chargeability.

Further, presumably partly owing to the use of Photosensitive member 1 (of Production Example 1) having a surface showing a contact angle with water of 102 deg., the transfer efficiency was very excellent at both the initial stage and after the continuous printing on 3500 sheets. However, even after taking such a smaller amount of transfer-residual toner particles remaining on the photosensitive member after the transfer step into consideration, it is understandable that the recovery of the transfer-residual toner particles in the developing step was well effected judging from the fact that only a slight amount of transfer-residual toner particles was recognized on the charging roller 2 after the continuous printing on 3500 sheets and the resultant images were accompanied with little fog at the non-image portion.

EXAMPLE 23

The evaluation of the above Example 23A was repeated by replenishing Developer 1 to the toner cartridge of the apparatus of Example 23A except that the superficial speed of the photosensitive member 1 (process speed) was increased from 94 mm/sec to 120 mm/sec and the peripheral speed of the charging roller 2 was changed to 120 mm in a direction opposite to the photosensitive member 1, thus changing the relative movement speed ratio from 250% to 200%.

(The results are summarized in Table 6 appearing hereinafter together with those of Examples described hereinafter.)

As a result, pattern charge failure and image soiling (details of which will be described later) not observed in Example 23A (using a process speed of 94 mm/sec and a relative movement speed ratio of 250%) were slightly recognized, and the charged potential was decreased from −680 volts at the initial stage to −650 volts after the continuous image formation (i.e., the lowering in chargeability after the continuous image formation on 3500 sheets was increased to −30 volts). Thus, the chargeability of the photosensitive member 1 and the performance of transfer-residual toner particles were slightly lowered as a result of the increase of process speed to 120 mm/sec and the lowering of the relative speed ratio to 200%.

Incidentally, there is an increasing demand for an image forming apparatus operated at a higher process speed and at a lower cost. For example, as for a laser beam printer according to electrophotography for personal users, a speed of 6–8 sheets/min was satisfactory but now a speed of 10–15 sheets/min is realized at a lower cost. This corresponds to an increase in process speed (surface speed of image-bearing member) of from 50 mm/sec to nearly 100 mm/sec, and a still higher speed will be expected.

A higher process speed is generally liable to result in a lower performance in recovery of transfer-residual toner particles in the developing-cleaning step. As factors for causing this difficulty, it is considered that at a higher process speed, it becomes difficult to effect sufficient charge control of transfer-residual toner particles in the charging section so that the transfer-residual toner particles discharged out of the charging section and moving to the developing section are liable to form ununiform charges, and it becomes also difficult to suppress the influence on the developer triboelectric chargeability by the increased transfer-residual toner particles recovered in the developing section. This tendency is particularly noticeable in the non-contact developing system. This is presumably because for the recovery of the transfer-residual toner particles in the contact developing system, an electrostatic force is more effectively caused and a physical rubbing force acts due to contact between the developer-carrying member and the image-bearing member, so that the performance lowering in recovery of transfer-residual toner particles accompanying a process speed increase can be more easily compensated for.

The charging performance in direct injection charging is also liable to be lowered at a higher process speed. This is presumably because of a lowering in probability of contact between the image-bearing member and the contact charging member via the electroconductive fine powder or a decrease in charging time for charging the image-bearing member by charge injection. Further, if the relative movement speed of the charging member is retained or increased in response to an increased process speed so as to maintain the probability of contact, a remarkable torque increase caused thereby results in an increase in operation cost and other difficulties, such as damages on the image-bearing member and the charging member, and soiling of the apparatus interior due to scattering of transfer-residual toner particles attached to or mixed in the charging member. Accordingly, it is desired to provide a developer and an image forming method which do not cause pattern change (or recovery) failure or image soiling but can suppress a lowering in chargeability of the image-bearing member after a repetitive use even at a higher process speed and a relatively low speed of the charging member.

Hereinbelow, the methods of performance evaluation and evaluation standards are described with respect to items listed in Table 6.

(a) Image Density.

Measured at the initial stage and after continuous printing on 3500 sheets. At each time, the apparatus was left standing for 2 days and then turned on to measure an image density with respect to an image formed on a first sheet of printing. The image density was measured by using a Macbeth reflection densitometer (made of Macbeth Co.) as a relative image density against a white ground portion corresponding to an image density of 0.00 on the original. The results are recorded according to the following standard.

A: ≧1.40 (Very good. Sufficient for expressing up to a graphic image at a high quality.)

B: 1.35 to below 1.40 (Good. Sufficient for expressing a non-graphic image at a high quality.)

C: 1.20 to below 1.35 (Fair. Image density which is sufficiently acceptable for recognition of character images.)

D: Below 1.20 (Image density generally not acceptable as a low density.)

(b) Fog

Measured at the initial stage and after continuous printing on 3500 sheets. The whiteness of a white ground portion of a printed image on a transfer paper and the whiteness of the transfer paper before printing were measured by a reflectometer (made by Tokyo Denshoku K.K.), and the difference between the two whiteness values were taken as fog (%) and recorded according to the following standard.

A: Below 1.5% (Very good. Fog, if any, at a level generally not recognizable with naked eyes.)

B: 1.5% to below 2.5% (Good. Fog at a level not recognized unless carefully observed.)

C: 2.5% to below 4.0% (Fair. Fog easily recognizable but generally acceptable.)

D: ≧4% (Poor. Fog generally recognized as image soil and not acceptable.)

(c) Transferability

Measured at the initial stage and after continuous printing on 3500 sheets. Transfer-residual toner particles on the photosensitive member were peeled off the photosensitive member by a polyester adhesive tape, and the tape was applied on a white paper. A polyester adhesive tape before use was applied in parallel on the white paper as a control. The transferability was evaluated based on the difference in Macbeth reflection density of the two adhesive tapes according to the following standard.

A: Below 0.05 (Very good)

B: 0.05 to below 0.1 (Good)

C: 0.1 to below 0.2 (Fair)

D: ≧0.2 (Poor)

(d) Chargeability of Photosensitive Member

Charged potentials on the photosensitive member were measured at the initial stage ($V_I$ (volts) and after continuous printing on 3500 sheets $F_F$ (volts). A sensor was disposed at a position of development to measure a surface potential on the photosensitive member after uniform charging. The difference ($\Delta V$) in a surface potential calculated by $\Delta V=|V_F|-|V_I|$ (volts). The values of $V_I$ and $\Delta V$ are listed in Table 6. A larger negative value represents a larger lowering in chargeability during the continual printing on 3500 sheets.

(e) Pattern Change Followability (Pattern Recovery Failure)

A lattice pattern (formed with a repetition two dot-wide longitudinal lines with spacing of 98 dots between lines and a repetition of two dot-wide lateral lines and a repetition of two dot-wide lateral lines with a spacing of 98 dots between lines) was continually printed or 3500 sheets and then a halftone image (a repetition of two dot-wide lateral lines with a spacing of 3 dots between each line) was printed or one sheet. Thereafter, whether the halftone image was accompanied with a density trace of the preceding longitudinal lines (of the lattice pattern), was checked, and the results are shown in Table 6 according to the following standard.

A: Not recognized at all (Very good).

B: Slight density trace recognized but substantially not affecting the halftone image (Good).

C: Density trace recognized but at a practically acceptable level (Fair).

D: Conspicuous density trace at a non-acceptable level (Poor).

(f) Image Soiling

Fixed images were observed with eyes and evaluated according to the following standard.

A: Not recognizable.

B: Slightly recognized but the influence thereof on the image is very slight.

C: Recognized to some extent but at a practically acceptable level.

D: Conspicuous image soil, not acceptable.

The results of evaluation of the above items are inclusively shown in Table 6 along with those of the following Examples.

EXAMPLES 24–26

Evaluation of Photosensitive Member

The image formation and evaluation were performed in the same manner as in Example 23 except that Photosensitive members 2–4 (produced in Production Examples 2–4), respectively, were used instead of Photosensitive member 1. Thus, the process speed was 120 mm/sec, and the relative speed ratio between the charging roller 2 and the photosensitive member was 200%. The results are shown in Table 6.

Compared with Example 23, Example 24 using Photosensitive member 2 exhibited some inferior results regarding the tranferability and puttern recovery. Along with this, spotty image soils appeared at a part of the image. These defects were however recognized to be within an acceptable range.

Compared with Example 23, Example 25 using Photosensitive member 2 resulted in images with somewhat inferior sharpness of contour and slight fog. The other performances were good.

Compared with Example 23, Example 26 using Photosensitive member 4 exhibited an inferior chargeability from the initial stage as represented by a surface potential on the photosensitive member of −650 volts at the initial stage in response to a charging bias voltage of −700 volts. The developing-cleaning performance was relatively low, and pattern recovery failure and fog were recognized, but these were all recognized to be within a practically acceptable level.

EXAMPLES 27 AND 28

Evaluation of Charging Member

Image formation and evaluation were performed in the same manner as in Example 23 except that charging member 1 was replaced by charging member 2 (Example 27) and 3 (Example 28), respectively.

Compared with Example 23, Example 27 using Charging roller 2 (of Production Example 2) exhibited slightly inferior contact between the photosensitive member and the contact charging member, and the amount of the electroconductive fine powder on the contact charging member was somewhat smaller to exhibit a somewhat inferior chargeability of the image-bearing member and some fog from the initial stage. These were however recognized to be within a practically acceptable range. The cleaning performance in the developing step was good.

Examples 28 using Charging roller 3 (prepared in Production Example 3) exhibited pattern recovery failure from the initial stage presumably because of a smaller rubbing force against the transfer-residual toner particles on the photosensitive member exerted from the contact charging member. The amount of the electroconductive fine powder at the contact part between the photosensitive member and the contact charging member, and fog was observed after the continuous printing due to a lowering in chargeability of the image-bearing member. Further, when the charging bias voltage was changed from the DC voltage of −700 volts to a superposition of DC voltage of −700 volts and a sinewave AC voltage of peak-to-peak voltage of 1600 volts and a frequency of 700 Hz so as to cause discharge charging, the fog caused due to a lower chargeability tended to be alleviated, but the pattern recovery failure was not improved. Further, at the last stage of the continuous printing test, image soiling became noticeable due to damages on the photosensitive member.

EXAMPLES 29–31

Evaluation of Developers 2–4

Image formation and evaluation were performed in the same manner as in Example 23 except that Developers 2–4, respectively, shown in Table 5 were used instead of Developer 1.

Compared with Example 23, Examples 29 and 30 using Developers 2 and 3 exhibited further excellent uniform chargeability of the image-bearing member and developing-cleaning characteristic and resulted in no lowering in image density, fog or pattern recovery failure.

Compared with Example 29, Example 31 using Developer 4 exhibited lower image density and increased fog at the initial stage. However, the lowering in chargeability of the image-bearing member after the continuous printing was slight, the developing-cleaning performance was good, and no pattern recovery failure was observed.

Comparative Example 7

Evaluation of Developer 5

Image formation and evaluation were performed in the same manner as in Example 23 except for using Developer 5 instead of Developer 1.

As a result, compared with Example 23, the resultant images exhibited a remarkably low image densities at the initial stage and lower images even after the continuous printing on 3500 sheets. Further, the transferability was low and the resultant images were accompanied with increased fog and noticeable image soils, thus being at a non-acceptable level.

EXAMPLE 3

Evaluation of Developer 6

Image formation and evaluation were performed in the same manner as in Example 23 except for using Developer 6 instead of Developer 1. The chargeability of the image-bearing member was good and the developing-cleaning performance was excellent.

Comparative Example 8

Evaluation of Developer 7

Image formation and evaluation were performed in the same manner as in Example 23 except for using Developer 7 instead of Developer 1.

As a result, at the initial stage, the image-bearing member exhibited good chargeability, but the pattern recovery failure was recognized. After the continuous printing on 3500 sheets, much transfer-residual toner particles were formed to be attached onto the charging member surface, and as a result, the chargeability of the image-bearing member was remarkably lowered. Further, other difficulties, such as noticeable fog, image soil due to charging failure, lowering in transferability and pattern recovery failure, were observed to result in unacceptable images.

EXAMPLES 33 AND 34

Evaluation of Developers 8 and 9

Image formation and evaluation were performed in the same manner as in Example 23 except for using Developers 8 and 9, respectively, instead of Developer 1.

Compared with Example 23, in Example 33 using Developer 8, the resultant images exhibited somewhat lower image densities and pattern recovery failure from the initial stage, which were however recognized to be within a practically acceptable range.

Compared with Example 23, Example 34 using Developer 9 provided images which showed lower image densities and the pattern recovery failure from the initial stage which were however within a practically acceptable level.

Comparative Examples 9–11

Evaluation of Developers 10–12

Image formation and evaluation were performed in the same manner as in Example 23 except for using Developers 10–12, respectively, instead of Developer 1.

Compared with Example 23, all Examples resulted in images which were low in image density and accompanied with much fog. After the continuous image formation on 3500 sheets, much transfer-residual toner particles were attached to the charging member surface, and remarkable pattern recovery failure and image soil were observed. Further, Comparative Example 10 resulted in soiling within the apparatus duue to developer scattering.

EXAMPLES 35–37

Evaluation of Developers 13–17

Image formation and evaluation were performed in the same manner as in Example 23 except for using Developers 13–17, respectively, instead of Developer 1.

Example 35 using Developer 13, compared with Example 23, resulted in images accompanied with fog from the initial stage, but exhibited good chargeability of the image-bearing member and developing-cleaning performance.

Examples 36 and 37 using Developers 14 and 15, respectively, compared with Example 23, resulted in somewhat lower pattern recovery performance from the initial stage, and somewhat larger lowering in chargeability of the image-bearing member after the continuous printing on 3500 sheets, but they were recognized to be within an acceptable range.

Example 38 using Developer 16 resulted in images which showed slightly lower image densities and were accompanied with fog. After the continuous printing on 3500 sheets, a slight degree of image soil presumably caused by interruption of exposure light with electroconductive fine powder not fully retainable by the charging member was recognized within a practically acceptable range.

Example 39 using Developer 17 resulted in somewhat much fog and somewhat inferior pattern recovery from the initial stage. The lowering in chargeability of the image-bearing member after the continuous image formation on 3500 sheets was noticeable but was however within a practically acceptable range.

Comparative Example 12

Evaluation of Developer 18

Image formation and evaluation were performed in the same manner as in Example 23 except for using Developer 18 instead of Developer 1.

As a result, Comparative Example 12 resulted in images accompanied with image soil due to charging failure and noticeable pattern recovery failure at the time of continuous printing on 300 sheets. At this time, the lowering in charged potential amount to 140 volts, and conspicuous transfer-residual toner particles were attached to the charging member, so that the image formation was discontinued.

EXAMPLES 40–42

Evaluation of Developers 19–21

Image formation and evaluation were performed in the same manner as in Example 23 except for using Developers 19–21, respectively, instead of Developer 1.

Example 40 using Developer 19 exhibited inferior transferability, and a somewhat large degree of lowering in chargeability of the image-bearing member and pattern recovery failure after continuous printing on 3500 sheets, which were however within an acceptable range.

Example 41 using Developer exhibited slightly inferior transferability but generally good chargeability of the image-bearing member and developing-cleaning performance.

Example 42 using Developer 21, compared with Example 23, resulted in somewhat lower image densities and somewhat lower transferability, but exhibited generally good chargeability and developing-cleaning performance.

EXAMPLES 43–45

Evaluation of Developers 22–24

Image formation and evaluation were performed in the same manner as in Example 23 except for using Developers 22–24, respectively, instead of Developer 1.

Example 43 using Developer 21 resulted in good images from the initial stages, and a sufficiently small degree of lowering in chargeability of the image-bearing member and good developing-cleaning performance after the continuous printing on 3500 sheets.

Examples 44 and 45 using Developers 23 and 24, respectively, compared with Example 23, exhibited better transferability from the initial stage, and yet smaller degree of lowering in chargeability of the image-bearing member after the continuous printing on 3500 sheets. The images were free from pattern recovery failure and image soil, and the chargeability of the image-bearing member and the toner recovery performance were excellent.

EXAMPLE 46

Image Formation and Evaluation by Using Developer 25 and Charging Member 4 (Charging Brush) Prepared in Production Example 4)

Figure 2:
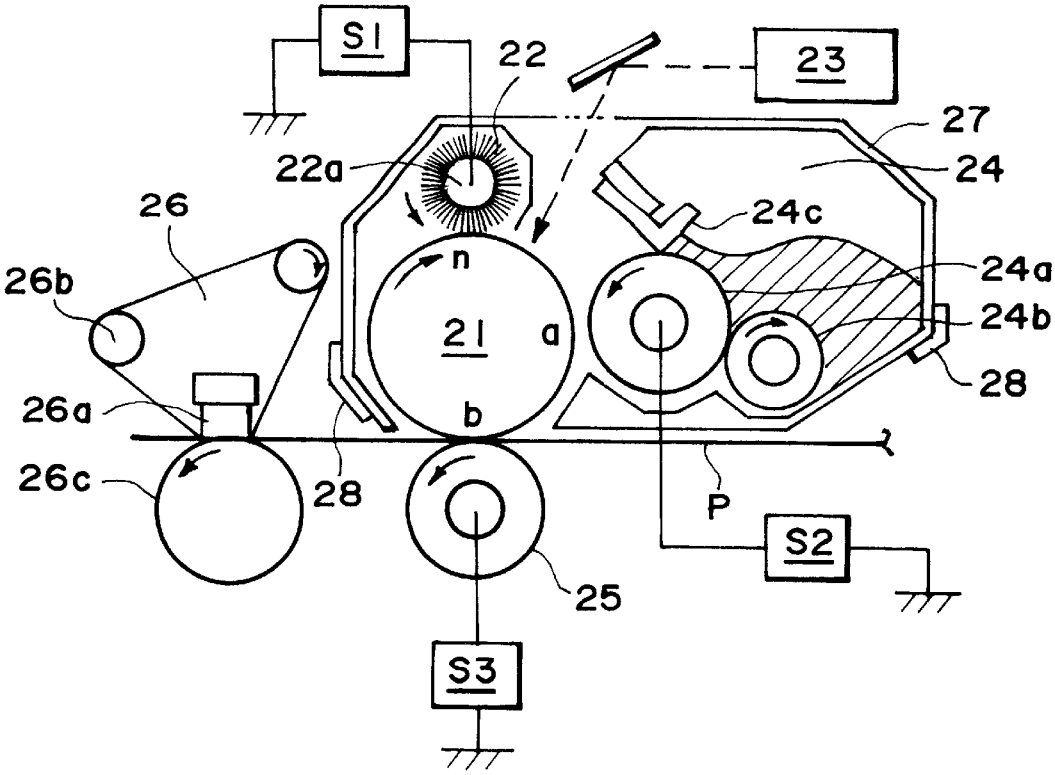
Figure 3:
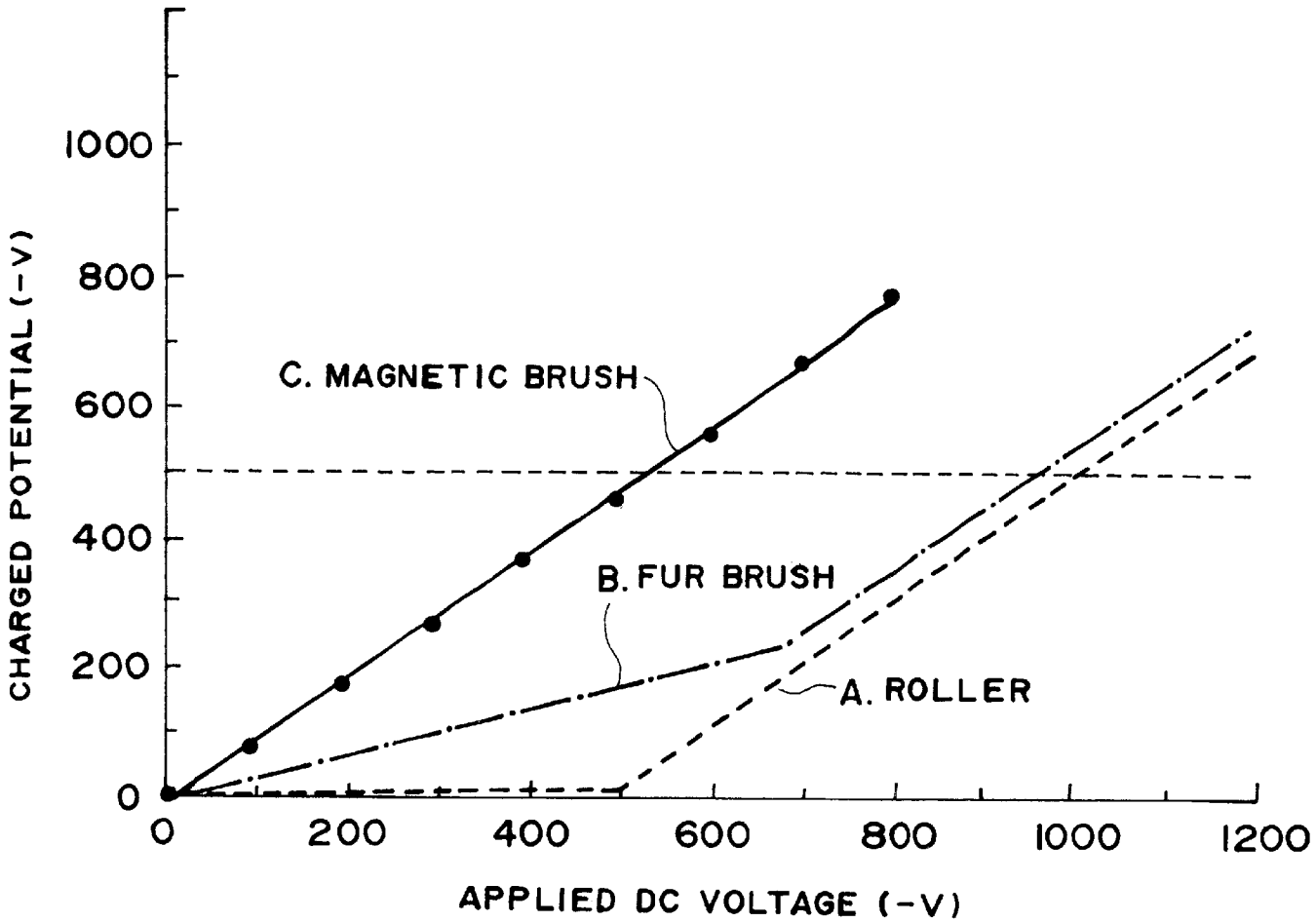
FIG. 3 is a graph showing charging performances according to several contact charging means.

FIG. 2 illustrates an organization of another examples of image forming apparatus suitable for practicing the image forming method of the present invention. The image forming apparatus is a laser beam printer (recording apparatus) according to a transfer-type electrophotographic process and including a developing-cleaning system (cleanerless system). The apparatus includes a process-cartridge detachably mountable to a main assembly of the apparatus. The process-cartridge has been reduced in size by omitting a cleaning unit and adopting a small-dia. dram photosensitive member. The apparatus uses a magnetic mono-component type developer (Developer 25) and a non-contact developing system wherein a developer-carrying member is disposed so that a developer layer carried thereon is in no contact with an image-bearing member for development.

(1) Overall Organization of an Image Forming Apparatus

Referring to FIG. 2, the image forming apparatus includes a rotating drum-type OPC photosensitive member 21 (Photosensitive member 1 of 24 mm in diameter produced in Production Example 1) (as an image-bearing member), which is driven for rotation in an indicated arrow direction (clockwise) at a peripheral speed (process speed) of 90 mm/sec.

A charging brush roller 22 (Charging member 4 produced in Production Example 4) (as a contact charging member) is rotated in an opposite direction with respect to the photosensitive member 21 to provide a relative movement speed ratio of 200% at the charging section n. In a state where electroconductive fine powder (Conductive powder B-4 contained in Developer 25 is present between the charging brush 22 and the photosensitive member 21, the core metal 22*a* of the charging brush 21 is supplied with a DC voltage of −700 volts from a charging bias voltage supply S1. As a result, the photosensitive member 21 surface is uniformly charged at a potential (−680 volts) in this Example.

The apparatus also includes a laser beam scanner 23. The laser beam scanner outputs laser light (wavelength=740 nm) with intensity modified corresponding to a time-serial electrical digital image signal, so as to scanningly expose the uniform charged surface of the photosensitive member 21. By the scanning exposure, an electrostatic latent image corresponding to the objective image data is formed on the rotating photosensitive member 21.

The apparatus further includes a developing device 24, by which the electrostatic latent image on the photosensitive member 21 surface is developed to form a toner image thereon. The developing device 24 is a non-contact-type reversal development apparatus including a negatively chargeable mono-component insulating developer (Developer 25 of Production Example 25 formed by externally adding Inorganic powder A-4 and Conductive powder B-4 to Toner particles 5 of Production Example 5).

The developing device 24 further includes a 16 mm-dia. medium-resistivity developing roller 24*a* (as a developer-carrying member) formed of silicone rubber with carbon black dispersed therein for resistivity adjustment. The developing roller 24*a* is disposed oppositely to and with a spacing of 280 $\mu$m from the photosensitive member 21 to form a developing section a where the developing roller 24*a* is rotated to show a peripheral speed of 120 mm/sec which is 134% of the surface moving speed of the photosensitive member 21 moving in an identical direction, thus providing a relative speed of 30 mm/sec relative to the photosensitive member 21.

As a means for applying a developer onto the developer-carrying member 24, an application roller 24*b* is disposed with a developer reservoir in the developing device in a form of being abutted against the developer-carrying member 24*a*. The application roller 24*b* is rotated in an identical rotation direction as the developer-carrying member 24*a* so as to exhibit a surface moving direction which is opposite to that of the developer-carrying member 24*a* at the contact position between the developer-carrying member 24*a* and the application roller 24*b*, thereby supplying and applying the developer onto the developer-carrying member. The application roller may comprise a core metal supplied with a bias voltage and a medium-resistivity elastic layer of $10^3$–$10^8$ ohm.cm. (The resistivity may be measured in the same manner as the charging roller as a charging member.) By adopting the organization of the application roller 24*b* being supplied with a bias voltage, the surface potential of the application roller is controlled at −500 volts, thereby controlling the supply and peeling of the developer. The application roller 24*b* can also be formed of a metal or a resin as well as a high-resistivity layer or a medium-resistivity layer on a core metal supplied with a bias voltage. The organization of the application roller 24*b* being supplied with a bias voltage so as to control the surface potential of the application roller 24*b* is preferred in control of the supply and peeling of the developer. It is also possible to form an elastic layer on a core metal.

In the image forming apparatus, an L-shaped non-magnetic blade of SUS316 is abutted against the developer-carrying member 24*a* as a developer-regulating member 24*c* for regulating the developer coating layer thickness on the developer-carrying member.

The developer stored in the developing device 24 is applied on the developing roller 24*a* (developer carrying member) in a charged form by means of the developer application roller 24*b* and the developer-regulation member 24*c*. In this specific Example, the developer was applied at a rate of 10 g/m$^2$ on the developing roller 24*a*.

The developer applied as a coating on the developing roller 24*a* is conveyed along with the rotation of the roller

24*a* to the developing section a where the photosensitive member 21 and the roller 24*a* are opposite to each other. The sleeve 4*a* is further supplied with a developing bias voltage from a developing bias voltage supply. In operation, the developing bias voltage was a superposition of DC voltage of −400 volts and a rectangular AC voltage of a frequency of 1800 Hz and a peak-to-peak voltage of 1800 volts (moving an electric field strength of $6.4\times10^6$ volts/m) to effect mono-component jumping development between the developing roller 24*a* and the photosensitive member 21.

The apparatus further includes a medium-resistivity transfer roller 25 (as a contact transfer means), which is abutted at a linear pressure of 98 N/m against the photosensitive member 21 to form a transfer nip b. To the transfer nip b, a transfer material P as a recording medium is supplied from a paper supply section (not shown), and a transfer bias voltage of +2800 volts is applied to the transfer roller 25 from a voltage supply S3, whereby toner images on the photosensitive member 21 are successively transferred onto the surface of the transfer material P supplied to the transfer nip b.

The apparatus further includes a fixing device 26 of, e.g., the heat-fixing type, wherein a toner image on the transfer material P is heated from a planar heat-generating member 26*a* via a heat-resistant endless belt 26*b* and also supplied with a pressure from a pressure roller 26*c* to be fixed under heat and pressure. The transfer material P having received a toner image from the photosensitive member 21 at the transfer nip b is separated from the photosensitive member 21 surface and introduced into the fixing device 26, where the toner image is fixed to provide an image product (print or copy) to be discharged out of the apparatus.

In the image forming apparatus used in this Example, transfer-residual toner particles remaining on the photosensitive member 21 surface after the transfer of the toner image onto the transfer material P are not removed by such a cleaning means but, along with the rotation of the photosensitive member 21, sent via the charging section n to reach the developing section a, where they are subjected to a developing-cleaning operation to be recovered.

In the image forming apparatus of this Example, three process units, i.e., the photosensitive member 21, the charging brush 22 and the developing device 241 are inclusively supported to form a process-cartridge 27, which is detachably mountable to a main assembly of the image forming apparatus via a guide and support member 28. A process-cartridge may be composed of other combinations of devices.

(2) Evaluation

In this Example, Developer 25 containing 20.4% by number of particles of 1.00–2.00 μm based on a number-basis distribution in the particle size range of 0.60–159.21 μm was used. More specifically, similarly as in Example 23A, 80 g of Developer 25 was placed in a toner cartridge and used for a continuous print of 5%-coverage images on 3500 sheets of A4-copying paper of 90 g/m$^2$ until the developer was used up. As a result, it was possible to attain images without a using image density lowering throughout the continuous printing on 3500 sheets. The same performance was observed in a printing operation resumed after 2 days of standing.

After the continuous printing on 3500 sheets, the portion of the charging brush 22 corresponding to the contact part n with the photosensitive member 21, the charging brush was almost uniformly coated with white powder of Conductor powder B-4 while a slight amount of transfer residual toner particles were recognized.

Further, presumably because Conductive powder B-4 having a sufficiently low resistivity of $4.8\times10^4$ ohm.cm was continually present at the contact part n between the photosensitive member 1 and the charging roller 2, image defects attributable to charging failure was not observed from the initial stage until after the continuous printing on 3500 sheets, thus showing good direct injection charging performance.

Further, presumably partly owing to the use of Photosensitive member 1 (of Production Example 1) having a surface showing a large contact angle with water, the transfer efficiency was very excellent at both the initial stage and after the continuous printing on 3500 sheets. However, even after taking such a smaller amount of transfer-residual toner particles remaining on the photosensitive member after the transfer step into consideration, it is understandable that the recovery of the transfer-residual toner particles in the developing step was well effected judging from the fact that only a slight amount of transfer-residual toner particles was recognized on the charging roller 2 after the continuous printing on 3500 sheets and the resultant images were accompanied with little fog at the non-image portion.

EXAMPLE 47

Evaluation of Developer 26

Image formation and evaluation were performed in the same manner as in Example 46 except for using Developer 26 shown in Table 5 instead of Developer 25.

As a result, good images free from image defects were obtained with excellent chargeability of the image-bearing member and toner recovery performance. The amount of the transfer-residual toner particles was less than in Example 46, and the amount of transfer-residual toner particles on the charging brush 22 after the continuous printing on 3500 sheets were also less.

EXAMPLE 48

Evaluation of Developer 27

Image formation and evaluation were performed in the same manner as in Example 46 except for using Developer 27 in Table 5 instead of Developer 25.

As a result, compared with Example 46, from the initial stage, the resultant images exhibited somewhat lower image densities, somewhat more fog and somewhat lower resolution. After the continuous printing on 3500 sheets, image soil due to charging failure on the image-bearing member or noticeable image defects due to recovery failure of transfer-residual toner particles were not observed. However, compared with Example 46, the chargeability of the image-bearing member and the toner recovery performance were generally inferior.

EXAMPLE 49

Evaluation of Developer 28

Image formation and evaluation were performed in the same manner as in Example 23 except for using Developer 28 in Table 5 instead of Developer 1. The results are also shown in Table 6.

TABLE 6

| | Image-forming performances | | | | | | | | | | | | |
|---|---|---|---|---|---|---|---|---|---|---|---|---|---|
| | Production Example | | | Image density | | Fog | | Transferability | | | | | |
| | | | | | | | | | | Chargeability | | After 3500 sheets | |
| Example | Photo-sensitive member | Charger | Developer | Initial | After 3500 sheets | Initial | After 3500 sheets | Initial | After 3500 sheets | Initial VI (volts) | ΔV after 3500 sheets volts | Pattern recovery | Image soil |
| Ex. 23 | 1 | 1 | 1 | A | A | A | A | B | B | −680 | −30 | B | B |
| Ex. 24 | 2 | 1 | 1 | A | A | A | B | C | C | −680 | −40 | C | C |
| Ex. 25 | 3 | 1 | 1 | A | A | B | B | B | B | −670 | −30 | B | B |
| Ex. 26 | 4 | 1 | 1 | A | A | B | C | C | C | −650 | −50 | C | C |
| Ex. 27 | 1 | 2 | 1 | A | A | A | B | B | B | −660 | −40 | B | B |
| Ex. 28 | 1 | 3 | 1 | A | A | B | C | B | B | −650 | −50 | C | C |
| Ex. 29 | 1 | 1 | 2 | A | A | A | A | B | B | −680 | −20 | A | A |
| Ex. 30 | 1 | 1 | 3 | A | A | A | A | B | B | −680 | −20 | A | A |
| Ex. 31 | 1 | 1 | 4 | B | A | B | B | B | B | −680 | −20 | A | A |
| Ex. 32 | 1 | 1 | 6 | B | A | A | A | B | B | −680 | −30 | A | A |
| Ex. 33 | 1 | 1 | 8 | B | B | B | B | B | B | −680 | −40 | C | B |
| Ex. 34 | 1 | 1 | 9 | C | C | C | C | B | B | −680 | −30 | C | B |
| Ex. 35 | 1 | 1 | 13 | B | A | C | C | B | B | −680 | −30 | B | A |
| Ex. 36 | 1 | 1 | 14 | B | A | B | C | B | B | −680 | −50 | C | B |
| Ex. 37 | 1 | 1 | 15 | B | A | B | B | B | B | −680 | −40 | C | B |
| Ex. 38 | 1 | 1 | 16 | B | B | C | B | B | B | −680 | −30 | B | C |
| Ex. 39 | 1 | 1 | 17 | B | B | C | C | B | B | −680 | −50 | C | B |
| Ex. 40 | 1 | 1 | 19 | B | A | A | C | C | C | −680 | −50 | C | B |
| Ex. 41 | 1 | 1 | 20 | A | A | A | A | C | C | −680 | −30 | B | A |
| Ex. 42 | 1 | 1 | 21 | B | B | B | A | C | C | −680 | −40 | B | B |
| Ex. 43 | 1 | 1 | 22 | A | A | B | C | B | B | −680 | −40 | B | B |
| Ex. 44 | 1 | 1 | 23 | A | A | A | A | A | A | −680 | −10 | A | A |
| Ex. 45 | 1 | 1 | 24 | A | A | B | A | A | A | −680 | 0 | A | A |
| Ex. 46 | 1 | 4 | 25 | A | A | A | A | B | B | −680 | −30 | B | A |
| Ex. 47 | 1 | 4 | 26 | A | A | A | A | A | A | −680 | −10 | A | A |
| Comp. 7 | 1 | 1 | 5 | D | C | C | D | C | D | −680 | −40 | B | D |
| Comp. 8 | 1 | 1 | 7 | A | B | A | D | C | D | −680 | −90 | D | D |
| Comp. 9 | 1 | 1 | 10 | C | B | B | C | C | C | −680 | −50 | D | D |
| Comp. 10 | 1 | 1 | 11 | D | D | B | B | D | D | −680 | −40 | D | D |
| Comp. 11 | 1 | 1 | 12 | C | C | C | C | C | C | −680 | −50 | D | D |
| Comp. 12 | 1 | 1 | 18 | B | C | A | D | B | D | −680 | −140 | D | D |
| Ex. 48 | 1 | 4 | 27 | C | C | C | B | C | C | −680 | −60 | C | C |
| Ex. 49 | 1 | 1 | 28 | A | A | A | A | A | A | −680 | −10 | A | A |

As described above, according to the present invention, it has become possible to provide an image forming method including a developing-cleaning step excellent in recovery of transfer-residual toner particles. Particularly, there is provided a developer allowing excellent developing-cleaning performance even when applied to a non-contact developing method which has been difficult heretofore.

Further, in an image-forming apparatus based on a contact charging scheme, a transfer scheme and a toner recycle process, it has become possible to achieve a developing-cleaning step which obviates obstruction to latent image formation and exhibits excellent performance of recovery of transfer-residual toner particles to sufficiently suppress the occurrence of pattern ghost.

Further, such a developer has been obtained as to control the supply of electroconductive fine powder to a contact charging member, thereby overcoming the charging obstruction due to attachment and mixing of transfer residual toner particles to allow good chargeability of the image-bearing member. Further, it has become possible to provide a process-cartridge which exhibits good developing-cleaning performance to remarkably reduce the waste toner amount and is thus advantageous for providing an inexpensive and small-sized image forming apparatus.

Further, the developer of the present invention allows a contact charging member of a simple structure, stably allows contact charging according to the direct injection charging mechanism which is advantageous as an ozonless charging scheme of low voltage-type, and still provides a uniform chargeability of the image-bearing member. Accordingly, it is possible to provide a process-cartridge which is free from difficulties, such as ozone product and charging failure, has a simple structure and is also inexpensive.

Further, the developer of the present invention allows stable presence of electroconductive fine powder at the contact part between the charging member and the image-bearing member, thereby remarkably reducing the damages on the image-bearing member leading to defects in the resultant images.

What is claimed is:

1. A developer for developing an electrostatic latent image, including:

toner particles each comprising a binder resin and a colorant, inorganic fine powder having a number-average particle size of 4–80 nm based on primary particles; and electroconductive fine powder;

wherein the developer (i) has a number-basis particle size distribution in the range of 0.60–159.21 μm including 15–60% by number of particles in the range of 1.00–2.00 μm, and 15–70% by number of particles in the range of 3.00–8.96 μm, each particle size range including its lower limit and excluding its upper limit and the electroconductive fine powder (i) is non-magnetic, (ii) has a resistivity of at most $10^9$ ohm.cm, (iii) is present in amounts from 1 to 10 wt. % of the developer and (iv) contain 5–300 particles having a particle size in the range from 0.6–3 μm per 100 toner particles.

2. The developer according to claim 1, wherein the developer contains 30–50% by number of particles in the range of 1.00–2.00 μm.

3. The developer according to claim 1, wherein the developer contains 0–20% by number of particles in the range of at least 8.96 μm.

4. The developer according to claim 1, wherein the developer contains A % by number of particles in the range of 1.00–2.00 μm and B % by number of particles in the range of 2.00–3.00 μm, satisfying a relationship of A>2B.

5. The developer according to claim 1, wherein the developer has a variation coefficient of number-basis distribution Kn as defined below of 5–40 in the particle size range of 3.00–15.04 μm:

$$Kn=(Sn/D1)\times 100,$$

wherein Sn represents a standard deviation of number basis distribution and D1 represents a number-average circle-equivalent diameter (μm), respectively, in the range of 3.00–15.04 μm.

6. The method according to claim 1, wherein the developer has a standard deviation of circularity distribution SD of at most 0.045 as determined according to the following formula:

$$SD=[\Sigma(a_i-a_m)^2/n]^{1/2},$$

wherein $a_i$ represents a circularity of each particle, $a_m$ represents an average circularity and n represents a number of total particles, respectively in the particle size range of 3.00–15.04 μm.

7. The developer according to claim 1, wherein electroconductive fine powder has a resistivity of at most $10^6$ ohm.cm.

8. The developer according to claim 1, wherein the electroconductive fine powder comprises at least one species of oxide selected from the group consisting of zinc oxide, tin oxide and titanium oxide.

9. The developer according to claim 1, wherein the developer contains 0.1–3.0 wt. % thereof of the inorganic fine powder.

10. The developer according to claim 1, wherein the inorganic fine powder has been treated wit at least silicone oil.

11. The developer according to claim 1, wherein the inorganic fine powder has been treated with a silane compound simultaneously with or followed by treatment with silicone oil.

12. The developer according to claim 1, wherein the inorganic fine powder comprises at least one species of inorganic oxides selected from the group consisting of silica, titania and alumina.

13. The developer according to claim 1, wherein the developer is a magnetic developer having a magnetization of 10–40 $Am^2$/kg at a magnetic field of 79.6 kA./m.

14. The developer according to claim 1, wherein the inorganic fine powder is hydrophobic inorganic fine powder selected from the group consisting of silica treated with silicone oil, silica treated wit a silane compound, titania treated wit silicone oil, titania treated with a silane compound, alumina treated with silicone oil, and alumina treated with a silane compound, and the inorganic fine powder is contained in 0.1–30 wt. % of the developer.

15. The developer according to claim 14, wherein the developer has a volume-average particle size of 4–10 μm, and the electroconductive fine powder has a resistivity of $10^1$ to $10^6$ ohm.cm.

16. The developer according to claim 1, wherein the developer contains 90–100% by number of particles having a circularity a of at least 0.90 as determined by the following formula in the particle size range of 3.00–15.04 μm:

$$\text{Circularity } a=L_0/L,$$

wherein L denotes a circumferential length of a particle projection image, and $L_0$ denotes a circumferential length of a circle having an area identical to that of the particle projection image.

17. The developer according to claim 16, wherein the developer contains 93–100% by number of particles having a circularity a of at least 0.90.

18. An image forming method comprising a repetition of image forming cycles each including:

a charging step of charging an image-bearing member a latent image forming step of writing image data onto the charged surface of the image-bearing member to form an electrostatic latent image thereon;

a developing step of developing the electrostatic latent image with a developer to form a toner image thereon; and a transfer step of transferring the toner image onto a transfer(-receiving) material, wherein said developer includes toner particles each comprising a binder resin and a colorant, inorganic fine powder having a minter-average particle size of 4–80 nm based on primary particles, and electroconductive fine powder, said developer having a number-basis particle size distribution in the range of 0.60–159.21 μm including 15–60% by number of particles in the range of 1.00–2.00 μm, and 15–70% by number of particles in the range of 3.00–8.96 μm, each particle size range including its lower limit and excluding its upper limit, the electroconductive fine powder (i) contains 5–300 particles of the electroconductive fine powder having a particle size in the range of 0.6–3 μm per 100 toner articles, (ii) is present in amounts from 1–10 wt. % of the developer, (iii) has a resistivity of at most $10^9$ ohm.cm, and (iv) is non-magnetic, and in the above-mentioned charging step, a charging member is caused to contact the image-bearing member at a contact position in the presence of at least the electroconductive fine powder of the developer, and in this contact state, the charging member is supplied with a voltage to charge the image-bearing member.

19. The method according to claim 18, wherein the developer contains 20–50% by number of particles in the range of 1.00–2.00 μm.

20. The method according to claim 18, wherein the developer contains 0–20% by number of particles in the range of at least 8.96 μm.

21. The method according to claim 18, wherein the developer contains A % by number of particles in the range of 1.00–2.00 μm and B % by number of particles in the range of 2.00–3.00 μm, satisfying a relationship of A>2B.

22. The method according to claim 18, wherein the developer has a variation coefficient of number-basis distribution Kn as defined below of 5–40 in the particle size range of 3.00–15.04 μm:

$$Kn=(SD/D1)\times 100,$$

wherein Sn represents a standard deviation of number basis distribution and D1 represents a number-average circle-equivalent diameter ($\mu$m), respectively, in the range of 3.00–15.04 $\mu$m.

23. The method according to claim 18, wherein the developer contains 90–100% by number of particles having a circularity a of at least 0.90 as determined by the following formula in the particle size range of 3.00–15.04 $\mu$m:

$$\text{Circularity } \underline{a}=L_0/L,$$

wherein L denotes a circumferential length of a particle projection image, and $L_o$, denotes a circumferential length of a circle having an area identical to that of the particle projection image.

24. The method according to claim 23, wherein the developer contains 93–100% by number of particles having a circularity a of at least 0.90.

25. The method according to claim 18, wherein the developer has a standard deviation of circularity distribution SD of at most 0.045 as determined according to the following formula:

$$SD=[\Sigma(a_i-a_m)^2/n]^{1/2},$$

wherein $a_i$ represents a circularity of each particle, $a_m$ represents an average circularity and n represents a number of total particles, respectively in the particle size range of 3.00–15.04 $\mu$m.

26. The method according to claim 18, wherein the electroconductive fine powder has a resistivity of at most $10^6$ ohm.cm.

27. The method according to claim 18, wherein the electroconductive fine powder comprises at least one species of oxide selected from the group consisting of zinc oxide, tin oxide and titanium oxide.

28. The method according to claim 18, wherein the developer contains 0.1–3.0 wt. % thereof of the inorganic fine powder.

29. The method according to claim 18, wherein the inorganic fine powder has been treated with at least silicone oil.

30. The method according to claim 18, wherein the inorganic fine powder has been treated with a silane compound simultaneously with or followed by treatment with silicone oil.

31. The method according to claim 18, wherein the inorganic fine powder comprises at least one species of inorganic oxides selected from the group consisting of silica, titania and alumina.

32. The method according to claim 18, wherein the developer is a magnetic developer having a magnetization of 10–40 $Am^2$/kg at a magnetic field of 79.6 kA/m.

33. The method according to claim 18, wherein the inorganic fine powder is hydrophobic inorganic fine powder selected from the group consisting of silica treated with silicone oil, silica treated with a silane compound, titania treated with silicone oil, titania treated with a silane compound, alumina treated with silicone oil, and alumina treated with a silane compound, and the inorganic fine powder is contained in 0.1–30 wt. % of the developer.

34. The method according to claim 33, wherein the developer has a volume-average particle size of 4–10 $\mu$m, and the electroconductive fine powder has a resistivity of $10^0$ to $10^5$ ohm.cm.

35. The method according to claim 18, wherein the electroconductive fine powder is present at the contact position between the charging member and the image-bearing member at a proportion higher than the content thereof in the developer initially supplied to the developing step.

36. The method according to claim 18, wherein the developing step of developing or visualizing the electrostatic latent image is also operated as a step of recovering the developer remaining on the image-bearing member surface after the toner image is transferred to the transfer material.

37. The method according to claim 18, wherein the relative speed difference is provided between the surface moving speed of the charging member and the surface-moving speed of the image-bearing member at the contact position.

38. The method according to claim 18, wherein the charging member is moved in a surface moving direction opposite to that of the image bearing member.

39. The method according to claim 18, wherein in the charging step, the image-bearing member is charged by means of a roller charging member having at least a surface layer of a foam material.

40. The method according to claim 18, wherein in the charging step, the image-bearing member is charged by a roller charging member having an Asker C hardness of 25–50 supplied with a voltage.

41. The method according to claim 18, wherein the image-bearing member is charged by a roller charging member has a voltage resistivity of $10^3$–$10^8$ ohm.cm.

42. The method according to claim 18, wherein the image-bearing member is charged by means of a brush member having electroconductivity and supplied with a voltage.

43. The method according to claim 18, wherein the image-bearing member has a volume resistivity of $1\times10^9$–$1\times10^{14}$ ohm.cm at its surfacemost layer.

44. The method according to claim 18, wherein the image-bearing member has a surfacemost layer comprising a resin with metal oxide conductor particles dispersed therein.

45. The method according to claim 18, wherein the image-bearing member hat a surface exhibiting a contact angle with water of at least 85 deg.

46. The method according to claim 18, wherein the image-bearing member has a surfacemost layer containing fine particles of a lubricant selected from the fluorine-containing resin, silicone resin and polyolefin resin.

47. The method according to claim 18, wherein in the developing step, a developer-carrying member carrying the developer is disposed opposite to and with a spacing of 100–1000 $\mu$m from the image-bearing member.

48. The method according to claim 18, wherein in the developing step, the developer is varied in a density of 5–30 g/$m^2$ on a developer-carrying member to form a developer layer, from which the developer is transferred to the image-bearing member.

49. The method according to claim 18, wherein in the developing step, the developer-carrying member is disposed wit a prescribed spacing from the image-bearing member, the developer layer is formed in a thickness smaller than the spacing, and the developer is electrically transferred from the developer layer to the image-bearing member.

50. The method according to claim 18, wherein in the developing step, a developing bias voltage is applied so as to form an AC electric field having a peak-to-peak field strength of $3\times10^6$–$10\times10^6$ volts/m and a frequency of 100–5000 Hz between the developer-carrying member and the image-bearing member.

51. The method according to claim 18, wherein in the transfer step, the toner image Conned in the developing step is first transferred onto an intermediate transfer member and then unto the transfer material.

52. The method according to claim 18, wherein in the transfer step, the transfer of the toner image is effected while abutting a transfer member against the image-bearing member or the intermediate transfer member via the transfer material.

53. An image forming method comprising a repetition of image forming cycles each including:

a charging step of charging an image-bearing member;

a latent image-forming step of writing image data onto the charged surface of the image-bearing member to form an electrostatic latent image thereon;

a developing step of developing the electrostatic latent image with a developer to form a toner image thereon; and a transfer step of transferring the toner image onto a transfer(-receiving) material, wherein the developing step is a step of developing the electrostatic latent image to form the toner image and also a step of recovering the developer remaining on the image-bearing member after the toner image is transferred onto the transfer material; and said developer includes toner particles each comprising a binder resin and a colorant, inorganic fine powder having a number-average particle size of 4–80 nm based on primary particles, and electroconductive fine powder, wherein the developer has a number-basis particle size distribution in the range of 0.60–159.21 $\mu$m including 15–60% by number of particles in the range of 1.00–2.00 $\mu$m, and 15–70% by number of particles in the range of 3.00–8.96 $\mu$m, each particle size range including its lower limit and excluding its upper limit and the electroconductive fine powder (i) contains 5–300 particles of the electroconductive fine powder having a particle size in the range of 0.6–3 $\mu$m per 100 toner particles, (ii) is present in amounts from 1–10 wt. % of the developer, (iii) has a resistivity of at most $10^9$ ohm.cm, and (iv) is non-magnetic.

54. The method according to claim 53, wherein the developer contains 20–50% by number of particles in the range of 1.00–2.00 $\mu$m.

55. The method according to claim 53, wherein the developer contains 0–20% by number of particles in the range of at least 8.96 $\mu$m.

56. The method according to claim 53, wherein the developer contains A % by number of particles in the range of 1.00–2.00 $\mu$m and B % by number of particles in the range of 2.00–3.00 $\mu$m, satisfying a relationship of A>2B.

57. The method according to claim 53, wherein the developer has a variation coefficient of number-basis distribution Kn as defined below of 5–40 in the particle size range of 3.00–15.04 $\mu$m:

$$Kn=(Sn/D1)\times 100,$$

wherein Sn represents a standard deviation of number basis distribution and D1 represents a number-average circle-equivalent diameter ($\mu$m), respectively, in the range of 3.00–15.04 $\mu$m.

58. The method according to claim 53, wherein the developer contains 90–100% by number of particles having a circularity a of at least 0.90 as determined by the following formula in the particle size range of 3.00–15.04 $\mu$m:

$$\text{Circularity } a=L_0/L,$$

wherein L denotes a circumferential length of a particle projection image, and $L_0$ denotes a circumferential length of a circle having an area identical to that of the particle projection image.

59. The method according to claim 58, wherein the developer contains 93–100% by number of particles having a circularity a of at least 090.

60. The method according to claim 53, wherein the developer has a standard deviation of circularity distribution SD of at most 0.045 as determined according to the following formula:

$$SD=[\Sigma(a_i-a_m)^2/n]^{1/2},$$

wherein $a_i$ represents a circularity of each particle, $a_m$ represents an average circularity and n represents a number of total particles, respectively in the particle range of 3.00–15.04 $\mu$m.

61. The method according to claim 53, wherein the electroconductive fine powder has a resistivity of at most $10^6$ ohm.cm.

62. The method according to claim 53, wherein the electroconductive fine powder comprises at least one species of oxide selected from the group consisting of zinc oxide, tin oxide and titanium oxide.

63. The method according to claim 53, wherein the developer contain. 0.1–3.0 wt. % thereof of the inorganic fine powder.

64. The method according to claim 53, wherein the inorganic fine powder has been treated with at least silicone oil.

65. The method according to claim 53, wherein the inorganic fine powder has been treated with a silane compound simultaneously with or followed by treatment with silicone soil.

66. The method according to claim 53, wherein the inorganic fine powder comprises at least one species of inorganic oxides selected from the group consisting of silica, titania and alumina.

67. The method according to claim 53, wherein the developer is a magnetic developer having a magnetization of 10–40 $Am^2$/kg at a magnetic field of 79.6 kA/m.

68. The method according to claim 53, wherein the inorganic fine powder is hydrophobic inorganic fine powder selected from the group consisting of silica treated with silicone oil, silica treated with a silane compound, titania treated with silicone oil, titania treated with a silane compound, alumina treated with silicone oil, and alumina treated with a silane compound, and the inorganic fine powder is contained in 0.1–30 wt. % of the developer.

69. The method according to claim 68, wherein the developer has a volume-average particle size of 4–10 $\mu$m, and the electroconductive fine powder has a resistivity of $10^0$ to $10^5$ ohm.cm.

70. The method according to claim 53, wherein in the charging step, the image-bearing member is charged by means of a charging member contacting the image-bearing member.

* * * * *

UNITED STATES PATENT AND TRADEMARK OFFICE

CERTIFICATE OF CORRECTION

PATENT NO. : 6,696,211 B2
APPLICATION NO. : 09/788397
DATED : February 24, 2004
INVENTOR(S) : Satoshi Yoshida et al.

It is certified that error appears in the above-identified patent and that said Letters Patent is hereby corrected as shown below:

ON COVER PAGE AT (56) FOREIGN PATENT DOCUMENTS

"KP 02-302772 12/1990" should read --JP 02-302772 12/1990--.

COLUMN 4

Line 55, "to caused," should read --to be caused--.

COLUMN 14

Line 64, "a" should read --to a--.

COLUMN 23

Line 57, "other" should read --other than--.

COLUMN 24

Line 1, "process." should read --process).--.

COLUMN 30

Line 4, "is" should read --are--; and
Tab 1, "2Z.51" should read --22.51--.

COLUMN 39

Line 31, "sholly" should read --wholly--; and
Line 43, "methylenebisstearmide)," should read --methylenebisstearmide,--.

COLUMN 42

Line 5, "of" should be deleted.

COLUMN 47

Line24, "Micron Separator and Turboplex (ATP);" (first occurrence) should be deleted--.

UNITED STATES PATENT AND TRADEMARK OFFICE

CERTIFICATE OF CORRECTION

PATENT NO. : 6,696,211 B2
APPLICATION NO. : 09/788397
DATED : February 24, 2004
INVENTOR(S) : Satoshi Yoshida et al.

It is certified that error appears in the above-identified patent and that said Letters Patent is hereby corrected as shown below:

COLUMN 50

Line 67, “an amy” should read --any--.

COLUMN 53

Line 30, “deterioration,” should read --deteriorated--.

COLUMN 56

Line 98, “image-bearing member” should read --contact charging member--.

COLUMN 57

Line 11, “eye’s” should read --eyes--.

COLUMN 63

Line 25, “resin” should read --resin.--.

COLUMN 72

Line 11, “a-mechanical” should read --a mechanical--.

COLUMN 74

Tab 2, “Circularity (a)” should read --Circularity (a)--.

COLUMN 76

Line 25, “(a)” should read --(a)--; and
Line 26, “a≥0.90” should read --a≥0.90--.

COLUMN 78

Line 6, “toner” should read --toner)--.

UNITED STATES PATENT AND TRADEMARK OFFICE

CERTIFICATE OF CORRECTION

PATENT NO. : 6,696,211 B2
APPLICATION NO. : 09/788397
DATED : February 24, 2004
INVENTOR(S) : Satoshi Yoshida et al.

It is certified that error appears in the above-identified patent and that said Letters Patent is hereby corrected as shown below:

COLUMN 81

Line 4, “region a” should read --region a--; and
Line 14, “section a” should read --section a--.

COLUMN 82

Line 49, “section a” should read --section a--.

COLUMN 83

Line 7, “section a,” should read --section a,--; and
Line 42, “section a” should read --section a--.

COLUMN 87

Line 22, “or” should read --on--.

COLUMN 92

Line 22, “section a” should read --section a--.

COLUMN 93

Line 1, “section a” should read --section a--;
Line 39, “section a,” should read --section a,--; and
Line 43, “device 241” should read --device 24--.

COLUMN 96

Line 54, “colorant,” should read --colorant;--; and
Line 57, “powder;” should read --powder,--.

COLUMN 97

Line 4, “contains 30” should read --contains 20--;
Line 24, “method” should read --developer--;
Line 45, “wit” should read --with--;
Line 62, “wit” should read --with--; and
Line 63, “wit” should read --with--.

UNITED STATES PATENT AND TRADEMARK OFFICE

CERTIFICATE OF CORRECTION

PATENT NO. : 6,696,211 B2
APPLICATION NO. : 09/788397
DATED : February 24, 2004
INVENTOR(S) : Satoshi Yoshida et al.

It is certified that error appears in the above-identified patent and that said Letters Patent is hereby corrected as shown below:

COLUMN 97

Line 4, “contains 30” should read --contains 20--;
Line 24, “method” should read --developer--;
Line 45, “wit” should read --with--;
Line 62, “wit” should read --with--; and
Line 63, “wit” should read --with--.

COLUMN 98

Line 20, “member” should read --member;--
Line 31, “minter” should read --number--;
Line 42, “articles,” should read --particles,--; and
Line 67, “Kn=(SD/D1)×100,” should read --Kn=(Sn/D1)×100,--.

COLUMN 100

Line 43, “hat” should read --has--;
Line 47, “the” should be deleted--;
Line 54, “varied” should read --carried--; and
Line 60, “wit” should read --with--.

COLUMN 101

Line 4, “Conned” should read --formed--;
Line 6, “unto” should read --onto--; and
Line 32, “particles,” should read --particles;--

UNITED STATES PATENT AND TRADEMARK OFFICE

CERTIFICATE OF CORRECTION

PATENT NO. : 6,696,211 B2
APPLICATION NO. : 09/788397
DATED : February 24, 2004
INVENTOR(S) : Satoshi Yoshida et al.

It is certified that error appears in the above-identified patent and that said Letters Patent is hereby corrected as shown below:

COLUMN 102

Line 12, “least 090.” should read --least 0.90.--;
Line 21, “range” should read --size range--;
Line 31, “contain.” should read --contains--; and
Line 55, “compound,” should read --compound;--.

Signed and Sealed this

Twenty-second Day of August, 2006

JON W. DUDAS
*Director of the United States Patent and Trademark Office*